US008844160B2

(12) United States Patent
Beihoff et al.

(10) Patent No.: US 8,844,160 B2
(45) Date of Patent: Sep. 30, 2014

(54) MODULAR FABRIC REVITALIZING SYSTEM

(75) Inventors: Bruce C. Beihoff, Stevensville, MI (US); Karl D. McAllister, Stevensville, MI (US); Janice M. Kaeding, Lawrence, MI (US); Tremitchell Wright, Elkhart, IN (US); Alexander V. Minkin, Saint Joseph, MI (US); Joel A. Luckman, Benton Harbor, MI (US); Colleen M. Doyle, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1007 days.

(21) Appl. No.: 12/893,657

(22) Filed: Sep. 29, 2010

(65) Prior Publication Data

US 2011/0016928 A1 Jan. 27, 2011

Related U.S. Application Data

(60) Continuation of application No. 12/570,395, filed on Sep. 30, 2009, now abandoned, which is a continuation of application No. 11/483,209, filed on Jul. 7, 2006, now abandoned, application No. 12/893,657, which is a continuation-in-part of application No. 12/273,635, filed on Nov. 19, 2008, now Pat. No. 8,262,741, which is a continuation of application No. 10/027,160, filed on Dec. 20, 2001, now abandoned, which is a division of application No. 09/520,653, filed on Mar. 7, 2000, now Pat. No. 6,451,066, which is a division of application No. 09/038,054, filed on Mar. 11, 1998, now Pat. No. 6,045,588.

(60) Provisional application No. 60/045,072, filed on Apr. 29, 1997, provisional application No. 60/775,194, filed on Feb. 21, 2006.

(51) Int. Cl.

| | |
|---|---|
| ***F26B 11/02*** | (2006.01) |
| ***D06F 58/22*** | (2006.01) |
| ***D06F 58/20*** | (2006.01) |

(52) U.S. Cl.

CPC ..... *D06F 58/203* (2013.01)
USPC ..... 34/409; 34/411; 34/480; 34/82; 34/595

(58) Field of Classification Search

USPC ..... 68/13 R, 18 R, 18 C, 18 F, 19.1, 19.2, 20, 68/24, 58; 34/409, 411, 480, 61, 77, 82, 34/595

See application file for complete search history.

(56) References Cited

U.S. PATENT DOCUMENTS

| | | | |
|---|---|---|---|
| 1,453,711 | A | 5/1923 | Hoting |
| 1,607,841 | A | 11/1926 | Nelson |

(Continued)

FOREIGN PATENT DOCUMENTS

| | | | |
|---|---|---|---|
| EP | 0743389 | A1 | 11/1996 |
| EP | 1156150 | A2 | 11/2001 |

(Continued)

*Primary Examiner* — Joseph L Perrin

(57) ABSTRACT

A modular system according to one embodiment of the invention for treating a fabric load comprises a first module and a second module. The first module can include a chamber having an interior for holding a fabric load, and the second module can have at least one of a fluid delivery system, a fluid removal system, and a fluid recycling system. The modular system can further include conduits for coupling the systems of the second module with the first module.

23 Claims, 50 Drawing Sheets

(56) References Cited

U.S. PATENT DOCUMENTS 1,731,290 A 10/1929 Boltz
1,995,064 A 3/1935 Hetzer
2,108,084 A 2/1938 Strobridge
2,109,469 A 3/1938 Cohn et al.
2,114,776 A 4/1938 Davis
2,262,186 A 11/1941 Lindberg
2,438,995 A 4/1948 Forney
2,443,557 A 6/1948 Fitpold
2,486,315 A 10/1949 Morris
2,496,517 A 2/1950 Bradley, Jr.
2,556,303 A 6/1951 Traube
2,589,284 A 3/1952 O'Neil
2,608,769 A 9/1952 O'Neil
2,651,113 A 9/1953 Milby et al.
2,652,708 A 9/1953 Rimsha et al.
2,675,628 A 4/1954 O'Neil
2,718,711 A 9/1955 Clark
2,724,905 A 11/1955 Zehrbach
2,758,461 A 8/1956 Tann
2,777,313 A 1/1957 Dodge
2,792,640 A 5/1957 Patterson
2,797,567 A 7/1957 Heien
2,798,973 A 7/1957 Doyle
2,812,593 A 11/1957 Olthuis
2,813,353 A 11/1957 McMillan
2,818,659 A 1/1958 Hague
2,834,121 A 5/1958 Geldhof
2,846,776 A 8/1958 Clark
2,853,798 A 9/1958 Morrison
2,868,006 A 1/1959 Tingley, Jr.
2,873,539 A 2/1959 Morey
2,893,135 A 7/1959 Smith
2,921,384 A 1/1960 Smith
2,927,379 A 3/1960 Tann
2,929,674 A 3/1960 Tann
2,940,179 A 6/1960 Czech
2,941,389 A 6/1960 Morrison
2,957,330 A 10/1960 Cline
2,975,623 A 3/1961 Eichhorn et al.
2,986,917 A 6/1961 Smith
3,002,288 A 10/1961 Conlee
3,017,758 A 1/1962 Haverstock et al.
3,022,580 A 2/1962 Doty
3,026,699 A 3/1962 Rhodes
3,039,285 A 6/1962 Smith
3,040,440 A 6/1962 Mellinger et al.
3,091,955 A 6/1963 Taylor et al.
3,103,450 A 9/1963 Janson
3,113,004 A 12/1963 Shaw
3,116,243 A 12/1963 Khan et al.
3,130,570 A 4/1964 Rentzepis
3,139,633 A 7/1964 Fecho et al.
3,157,475 A 11/1964 Stainbrook
3,180,037 A 4/1965 Kenreich et al.
3,231,909 A 2/1966 Candor
3,261,185 A 7/1966 Rihr
3,267,701 A 8/1966 Mandarino
3,270,761 A 9/1966 Pansing
3,321,843 A 5/1967 Taran
3,358,301 A 12/1967 Candor et al.
3,387,385 A 6/1968 Mandarino, Jr. et al.
3,401,052 A 9/1968 Berger et al.
3,402,576 A 9/1968 Krupsky
3,447,174 A 6/1969 Candor et al.
3,491,386 A 1/1970 Candor et al.
3,583,180 A 6/1971 Arbogast
3,597,851 A 8/1971 Arendt
3,612,500 A 10/1971 Cramer
3,617,208 A 11/1971 Burger
3,624,919 A 12/1971 Miller
3,634,947 A 1/1972 Furgal
3,660,013 A 5/1972 Payet et al.
3,732,628 A 5/1973 Blevens et al.
3,815,828 A 6/1974 Engel
3,861,179 A 1/1975 Orchard
3,899,902 A 8/1975 Conti
3,978,855 A 9/1976 McRae et al.
4,086,053 A 4/1978 Sommer, Jr.
4,106,214 A 8/1978 Schmidt
4,137,645 A 2/1979 Bullock
4,140,503 A 2/1979 Vandergriff
4,167,594 A 9/1979 Schwadtke et al.
4,207,683 A 6/1980 Horton
4,236,320 A 12/1980 Schwadike et al.
4,244,710 A 1/1981 Burger
4,250,628 A 2/1981 Smith et al.
4,481,786 A 11/1984 Bashark
4,642,908 A 2/1987 Brenner
4,726,005 A 2/1988 Bogaerts
4,800,655 A 1/1989 Mori et al.
4,808,237 A 2/1989 McCormick et al.
4,811,495 A 3/1989 Huang et al.
4,827,627 A 5/1989 Cardoso
4,866,859 A 9/1989 Kopelman
4,898,690 A 2/1990 Bitter et al.
4,916,863 A 4/1990 Burrous et al.
5,042,171 A 8/1991 Obata et al.
5,074,131 A 12/1991 Hirose et al.
5,097,556 A 3/1992 Engel et al.
5,107,603 A 4/1992 Durazzani
5,159,766 A 11/1992 Henig
5,207,764 A 5/1993 Akabane et al.
5,212,969 A 5/1993 Tsubaki et al.
5,253,378 A * 10/1993 Jung, Jr. ..... 8/149.1
5,272,892 A 12/1993 Janutka et al.
5,388,344 A 2/1995 Wallach
5,442,938 A 8/1995 Kislyuk
5,461,742 A 10/1995 Pasad et al.
5,640,739 A 6/1997 Campbell
5,651,192 A 7/1997 Horwitz
5,675,911 A 10/1997 Moser
5,711,819 A 1/1998 Miyasaki
5,749,163 A 5/1998 Staub et al.
5,804,548 A 9/1998 Davis
5,840,675 A 11/1998 Yeazell
5,865,851 A 2/1999 Sidoti et al.
5,887,456 A 3/1999 Tanigawa et al.
5,925,192 A 7/1999 Purer et al.
5,930,909 A 8/1999 McNally
5,954,933 A 9/1999 Ingalls et al.
5,960,563 A 10/1999 Kuboyama
5,966,831 A 10/1999 Anderson
5,992,039 A 11/1999 Bunch et al.
5,993,739 A 11/1999 Lyon
5,996,247 A 12/1999 Kuboyama
6,030,632 A 2/2000 Sawan et al.
6,045,588 A 4/2000 Estes et al.
6,105,533 A 8/2000 Boos
6,116,060 A 9/2000 Strader
6,117,190 A 9/2000 Chao et al.
6,214,421 B1 4/2001 Pidzarko
6,346,126 B1 2/2002 Chao et al.
6,427,365 B2 8/2002 MacGregor et al.
6,551,461 B2 4/2003 Hermans et al.
6,558,432 B2 5/2003 Schulte et al.
6,584,633 B2 7/2003 Chute et al.
6,618,958 B2 9/2003 Myung et al.
6,655,047 B2 12/2003 Miller, II
6,673,121 B2 1/2004 Mettlach et al.
6,691,536 B2 2/2004 Severns et al.
6,736,859 B2 5/2004 Racette et al.
6,755,871 B2 6/2004 Damaso et al.
6,757,986 B2 7/2004 Miller et al.
6,793,685 B2 9/2004 Noyes et al.
6,811,811 B2 11/2004 Gerald France et al.
6,840,068 B2 1/2005 Pasin et al.
6,849,094 B1 2/2005 North
6,889,399 B2 5/2005 Steiner et al.
6,889,449 B2 5/2005 Silver
6,893,469 B1 5/2005 Van Hauwermeiren et al.
6,898,951 B2 5/2005 Severns et al.
6,954,995 B2 10/2005 Kitamura et al.
6,966,124 B2 11/2005 Ryu
6,966,203 B2 11/2005 Matsuda et al.

(56) References Cited

U.S. PATENT DOCUMENTS

| | | | | |
|---|---|---|---|---|
| 7,024,795 | B2 | 4/2006 | Tadano et al. | |
| 7,043,855 | B2 | 5/2006 | Heilman et al. | |
| 7,047,666 | B2 | 5/2006 | Hahn et al. | |
| 7,055,262 | B2 | 6/2006 | Goldberg et al. | |
| 7,059,065 | B2 | 6/2006 | Gerlach et al. | |
| 7,062,863 | B2 | 6/2006 | Chung et al. | |
| 7,084,099 | B2 | 8/2006 | Radomyselski et al. | |
| 7,117,612 | B2 | 10/2006 | Slutsky et al. | |
| 7,146,749 | B2 | 12/2006 | Barron et al. | |
| 7,162,812 | B2 | 1/2007 | Cimetta et al. | |
| 7,178,264 | B2 | 2/2007 | Kim | |
| 7,204,040 | B2 | 4/2007 | Myung et al. | |
| 7,235,109 | B2 | 6/2007 | Kleker | |
| 7,241,728 | B2 | 7/2007 | Radomyselski et al. | |
| 7,251,906 | B2 | 8/2007 | Kajihara et al. | |
| 7,300,468 | B2 | 11/2007 | Wright et al. | |
| 7,309,026 | B2 | 12/2007 | Griese et al. | |
| 7,320,184 | B2 | 1/2008 | Zhang et al. | |
| 7,325,330 | B2 | 2/2008 | Kim et al. | |
| 7,340,790 | B2 | 3/2008 | Aouad et al. | |
| 7,356,945 | B2 * | 4/2008 | Choi et al. | 34/597 |
| 7,395,612 | B2 | 7/2008 | Jeong et al. | |
| 7,415,781 | B2 | 8/2008 | Barron et al. | |
| 7,448,146 | B2 | 11/2008 | Cho et al. | |
| 7,513,132 | B2 | 4/2009 | Wright et al. | |
| 7,555,856 | B2 | 7/2009 | Sunshine et al. | |
| 7,562,543 | B2 | 7/2009 | Kendall et al. | |
| 7,587,917 | B2 | 9/2009 | Gilboe et al. | |
| 7,617,702 | B2 | 11/2009 | Sunshine et al. | |
| 7,624,600 | B2 | 12/2009 | Sunshine et al. | |
| 7,628,043 | B2 | 12/2009 | Sunshine et al. | |
| 7,665,227 | B2 | 2/2010 | Wright et al. | |
| 2001/0010101 | A1 | 8/2001 | Hage | |
| 2002/0053607 | A1 | 5/2002 | Gaaloul et al. | |
| 2002/0056163 | A1 | 5/2002 | Estes et al. | |
| 2002/0056164 | A1 | 5/2002 | Estes et al. | |
| 2002/0069465 | A1 | 6/2002 | Chute et al. | |
| 2002/0133886 | A1 | 9/2002 | Severns et al. | |
| 2003/0001408 | A1 | 1/2003 | Hockenberry et al. | |
| 2003/0019601 | A1 | 1/2003 | Hermans et al. | |
| 2003/0070238 | A1 | 4/2003 | Radomyselski et al. | |
| 2003/0089138 | A1 | 5/2003 | Kawamura et al. | |
| 2003/0134094 | A1 | 7/2003 | Zafiroglu et al. | |
| 2003/0136022 | A1 | 7/2003 | Myung et al. | |
| 2003/0196282 | A1 | 10/2003 | Fyvie et al. | |
| 2003/0204917 | A1 | 11/2003 | Estes et al. | |
| 2003/0224965 | A1 | 12/2003 | Conley et al. | |
| 2004/0003511 | A1 | 1/2004 | Silver | |
| 2004/0025242 | A1 | 2/2004 | Leung et al. | |
| 2004/0025368 | A1 | 2/2004 | Gerlach et al. | |
| 2004/0026404 | A1 | 2/2004 | Lerner | |
| 2004/0040586 | A1 | 3/2004 | Kumar | |
| 2004/0045187 | A1 | 3/2004 | Curry et al. | |
| 2004/0079121 | A1 | 4/2004 | Yabuuchi et al. | |
| 2004/0117919 | A1 | 6/2004 | Conrad et al. | |
| 2004/0123489 | A1 | 7/2004 | Pancheri et al. | |
| 2004/0134090 | A1 | 7/2004 | Heilman et al. | |
| 2004/0134094 | A1 | 7/2004 | Hahn et al. | |
| 2004/0134237 | A1 | 7/2004 | Sunshine et al. | |
| 2004/0139555 | A1 | 7/2004 | Conrad et al. | |
| 2004/0143994 | A1 | 7/2004 | Baron et al. | |
| 2004/0187527 | A1 | 9/2004 | Kim et al. | |
| 2004/0187529 | A1 | 9/2004 | Kim et al. | |
| 2004/0188058 | A1 * | 9/2004 | Good | 165/4 |
| 2004/0206131 | A1 | 10/2004 | Kleker | |
| 2004/0216326 | A1 | 11/2004 | Kitamura et al. | |
| 2004/0216327 | A1 | 11/2004 | Chung | |
| 2004/0221403 | A1 | 11/2004 | Pyles et al. | |
| 2004/0244432 | A1 | 12/2004 | Kim et al. | |
| 2004/0255391 | A1 | 12/2004 | Kim et al. | |
| 2004/0259750 | A1 | 12/2004 | DuVal et al. | |
| 2005/0000031 | A1 | 1/2005 | Price et al. | |
| 2005/0022311 | A1 | 2/2005 | Zhang et al. | |
| 2005/0034248 | A1 | 2/2005 | Oh et al. | |
| 2005/0034249 | A1 | 2/2005 | Oh et al. | |
| 2005/0034250 | A1 | 2/2005 | Oh et al. | |
| 2005/0034487 | A1 | 2/2005 | Oh et al. | |
| 2005/0034488 | A1 | 2/2005 | Oh et al. | |
| 2005/0034490 | A1 | 2/2005 | Oh et al. | |
| 2005/0043196 | A1 * | 2/2005 | Wright et al. | 510/276 |
| 2005/0050644 | A1 | 3/2005 | Severns et al. | |
| 2005/0071928 | A1 * | 4/2005 | Wright et al. | 8/142 |
| 2005/0076453 | A1 | 4/2005 | Lucas et al. | |
| 2005/0076532 | A1 | 4/2005 | Ward et al. | |
| 2005/0076533 | A1 | 4/2005 | Huston et al. | |
| 2005/0076534 | A1 | 4/2005 | Ofosu-Asante et al. | |
| 2005/0090035 | A1 | 4/2005 | Kim | |
| 2005/0091755 | A1 | 5/2005 | Conrad et al. | |
| 2005/0091879 | A1 | 5/2005 | DuVal et al. | |
| 2005/0092352 | A1 | 5/2005 | Luckman et al. | |
| 2005/0120584 | A1 | 6/2005 | DuVal et al. | |
| 2005/0120586 | A1 | 6/2005 | Hwang et al. | |
| 2005/0126034 | A1 | 6/2005 | Jeong et al. | |
| 2005/0132503 | A1 | 6/2005 | Yang et al. | |
| 2005/0132504 | A1 | 6/2005 | Yang et al. | |
| 2005/0132756 | A1 | 6/2005 | Yang et al. | |
| 2005/0144734 | A1 | 7/2005 | Yang et al. | |
| 2005/0144735 | A1 | 7/2005 | Yang et al. | |
| 2005/0155393 | A1 * | 7/2005 | Wright et al. | 68/3 R |
| 2005/0172511 | A1 | 8/2005 | Cimetta et al. | |
| 2005/0183208 | A1 | 8/2005 | Scheper et al. | |
| 2005/0183284 | A1 | 8/2005 | Hwang et al. | |
| 2005/0204583 | A1 | 9/2005 | Kim | |
| 2005/0251924 | A1 | 11/2005 | Du Val et al. | |
| 2005/0257812 | A1 | 11/2005 | Wright et al. | |
| 2006/0000111 | A1 | 1/2006 | Cho et al. | |
| 2006/0016092 | A1 | 1/2006 | Kim et al. | |
| 2006/0021250 | A1 | 2/2006 | Myung et al. | |
| 2006/0037213 | A1 | 2/2006 | Kajihara et al. | |
| 2006/0117596 | A1 | 6/2006 | Kim et al. | |
| 2006/0123654 | A1 | 6/2006 | Zhang et al. | |
| 2006/0162180 | A1 | 7/2006 | Heilman et al. | |
| 2006/0174511 | A1 | 8/2006 | Lee et al. | |
| 2006/0179676 | A1 | 8/2006 | Goldberg et al. | |
| 2006/0179678 | A1 | 8/2006 | Jonsson et al. | |
| 2006/0253999 | A1 | 11/2006 | Christ et al. | |
| 2006/0260065 | A1 | 11/2006 | Wright et al. | |
| 2007/0006484 | A1 | 1/2007 | Moschuetz et al. | |
| 2007/0094888 | A1 | 5/2007 | Barron et al. | |
| 2007/0151041 | A1 | 7/2007 | McAllister et al. | |
| 2007/0235140 | A1 | 10/2007 | Schuler et al. | |
| 2007/0251115 | A1 * | 11/2007 | Bringewatt et al. | 34/134 |
| 2007/0256322 | A1 | 11/2007 | Kim et al. | |
| 2008/0141554 | A1 | 6/2008 | Bae et al. | |
| 2010/0146807 | A1 | 6/2010 | Gibson | |
| 2010/0186176 | A1 | 7/2010 | Wright et al. | |

FOREIGN PATENT DOCUMENTS

| | | | |
|---|---|---|---|
| EP | 1305468 | A1 | 5/2003 |
| EP | 1441059 | A1 | 7/2004 |
| EP | 1441060 | A1 | 7/2004 |
| EP | 1634984 | A1 * | 3/2006 |
| JP | 09215894 | A | 8/1997 |
| WO | 0208510 | A1 | 1/2002 |
| WO | 03102289 | A1 | 12/2003 |
| WO | 2005003267 | A1 | 1/2005 |

* cited by examiner

MODULAR FABRIC REVITALIZING SYSTEM

CROSS-REFERENCE TO RELATED APPLICATION

This application is a continuation of currently pending U.S. patent application Ser. No. 12/570,395, filed Sep. 30, 2009, which is a continuation of U.S. patent application Ser. No. 11/483,209, filed Jul. 7, 2006, which claims priority from U.S. Patent Application No. 60/755,194, filed Dec. 30, 2005. All of which are incorporated by reference.

This application is also a continuation in part of and claims the benefit of currently pending U.S. patent application Ser. No. 12/273,635, filed Nov. 19, 2008, which is a continuation of U.S. patent application Ser. No. 10/027,160, filed Dec. 20, 2001, which is a divisional of U.S. patent application Ser. No. 09/520,653, filed Mar. 7, 2000, now issued as U.S. Pat. No. 6,451,066 on Sep. 17, 2002, which is a divisional of U.S. patent application Ser. No. 09/038,054, filed Mar. 11, 1998, now issued as U.S. Pat. No. 6,045,588 on Apr. 4, 2000, which claims priority from U.S. Patent Application No. 60/045,072, filed May 5, 1997. All of which are incorporated herein in their entirety.

BACKGROUND OF THE INVENTION

1. Field of the Invention

The invention relates to a modular fabric revitalizing system.

2. Description of the Related Art

Conventional fabric cleaning methods for portable fabrics typically employ a liquid bath wash to clean clothing fabrics and other materials composed of textiles. A typical household washing machine and dryer arrangement is used for cleaning durable types of clothes that may contain water soluble stains and easily removable particulates. A dry cleaning process is used for those fabrics that are susceptible to changes, such as shrinkage or damage, during a regular wash process.

Single wear usage of otherwise clean clothing typically results in the accumulation of small amounts of particulates, such as soils, and hairs, on the fabric surface, or the occasional relatively minor stain or odor that may become impregnated into the fabric. In this "not clean, not dirty" zone, one finds oneself confronted with the dilemma of either wearing the slightly soiled clothing article in limited situations where one's embarrassment is minimized or expending the time, cost, and energy of having the clothing article laundered or professionally treated to clean status prior to re-wear.

Several prior art products have been developed that permit some degree of fabric cleaning removal of soils, particulates, and hairs from a worn yet not dirty (i.e., not clean, not dirty) clothing article. These products include specialty clothing brushes and adhesive-based rollers as a means to remove loosely bound particulates, soils, and hairs. Certain stain pretreatments permit removal of stain spots from clothing without having to subject the article to a complete cleaning process. Fabric deodorizing sprays facilitate masking or removal of odors from the clothing article.

While some of these approaches do improve the overall appearance of the clothing article, they are limited typically to the treatment method employed. For example, while a clothing brush may be able to remove pet hairs from a sports coat, any odors that may derive from perfume or cigarette smoke will persist on the sports coat. Thus, there is currently a need to offer a more comprehensive approach to restoring clothing articles to their clean appearance.

SUMMARY OF THE INVENTION

A modular system according to one embodiment for treating a fabric load comprises a first module comprising a chamber with an interior; at least one opening into the chamber for enabling user access to the interior of the chamber; a drying air flow system contained within the first module and configured to move air into the chamber, through the chamber drying the fabric load within the chamber, and out of the chamber; a particulate removal system in communication with the air flow system; and a fabric movement system for causing movement of the fabric load within the chamber. The modular system further comprises a second module having a revitalization fluid delivery system and a revitalization fluid removal system, the revitalization fluid delivery and removal systems being contained within the second module separate from the air flow system; a first conduit fluidly coupling the revitalization fluid delivery system with the interior of the chamber; and a second conduit fluidly coupling the revitalization fluid removal system with the interior of the chamber.

A modular system according to another embodiment for treating a fabric load comprises a first module comprising a rotatable container having an interior for holding a fabric load; at least one opening into the container for enabling user access to the interior; a drying air flow system contained within the first module and configured to move air into the interior, through the container interior drying the fabric load within the interior, and out of the interior; and a particulate removal system in communication with the air flow system. The modular system further comprises a second module having a revitalization fluid delivery system and a revitalization fluid removal system, the revitalization fluid delivery and removal systems being contained within the second module separate from the air flow system, and a conduit fluidly coupling the revitalization fluid delivery system with the interior.

DETAILED DESCRIPTION OF THE PREFERRED EMBODIMENT

Clothing refreshing is a process whereby the clothing article is restored to its clean condition without the requirement of subjecting the clothing article to a conventional full cleaning process of either washing/drying in the washer/the dryer or dry cleaning. A refreshed clothing article can have the appearance of a clean article that includes improved hand and a restored vibrant appearance. The invention of the instant disclosure provides a novel approach to clothing fabric refreshing/revitalization that can be accomplished economically and conveniently in the home setting. Additionally, a refreshed garment can have reduced wrinkles and/or minimal odors as compared to its pre-processed condition.

By offering a refreshing process, the consumer can have reduced efforts in making their fabrics "like new again." Additionally, by not having to place fabrics through a complete cleaning process (e.g., immersion or non-immersion wash followed by drying), fabrics will be less damaged and as a result may last longer.

The present invention makes use of the discovery that dehydrated clothing fabrics are uniquely amenable to a fabric refreshing process that can result in many benefits, including the removal of loosely bound particulates, such as soils, stains, and odors, and wrinkles from the fabrics. In a system and method according to one embodiment of the invention, fabrics are initially dehydrated through a controlled heating process and the like, then subjected to aeration using a high flow rate air source to remove the loosened or dried particulates, such as soils and/or hairs, from the fabric, and finally subjected to a rehydration process. Fabric revitalization can leave clothing fabrics with a clean, vibrant appearance and improved hand or feel in addition to improved wrinkle and odor performance. Examples of fabric clothing articles include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), can be revitalized with the disclosed system and method. The fabric can have any fabric composition, examples of which include, but are not limited to, cotton, polyester, wool, silk, nylon, rayon, rubber, plastic, leather, and blends thereof.

Though the following disclosure is drawn to revitalization or refreshing of fabric materials, the system and method has broad utility for revitalizing a variety of non-fabric surfaces that contain particulates, such as stains, soils, or other foreign matter.

Figure 1:
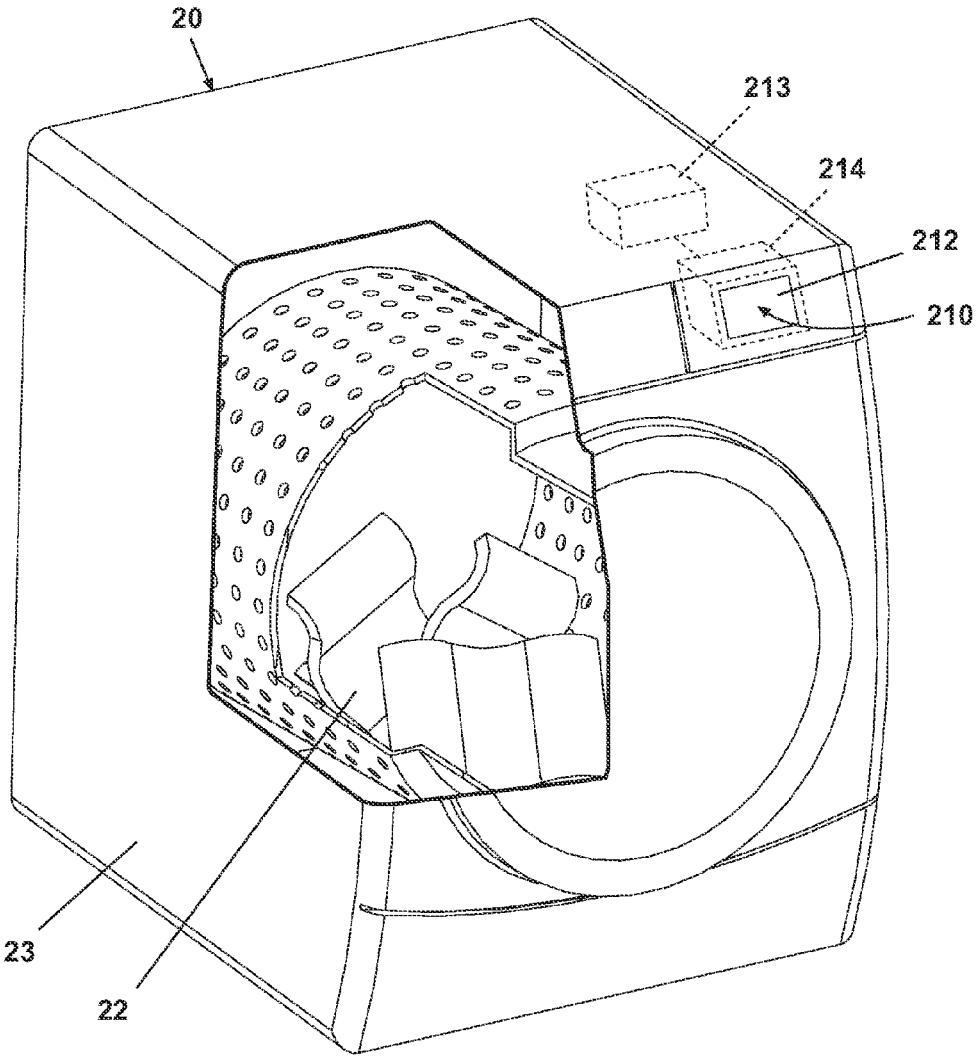
FIG. 1 depicts an exemplary enclosure and user interface and control for a revitalization system according to one embodiment of the invention in which a revitalization chamber is formed by a horizontal rotatable drum.
Figure 2B:
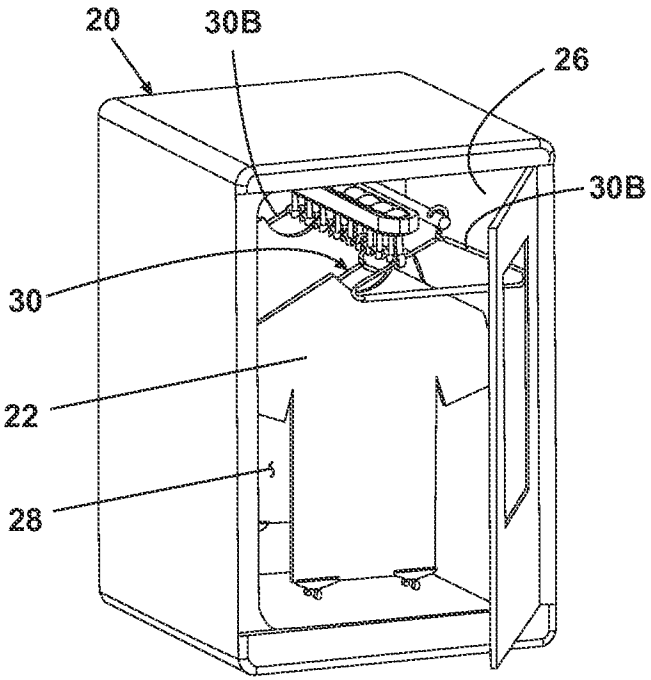
FIGS. 2A-2D depict alternative exemplary enclosures and revitalization chambers for the revitalization system.
Figure 2A:
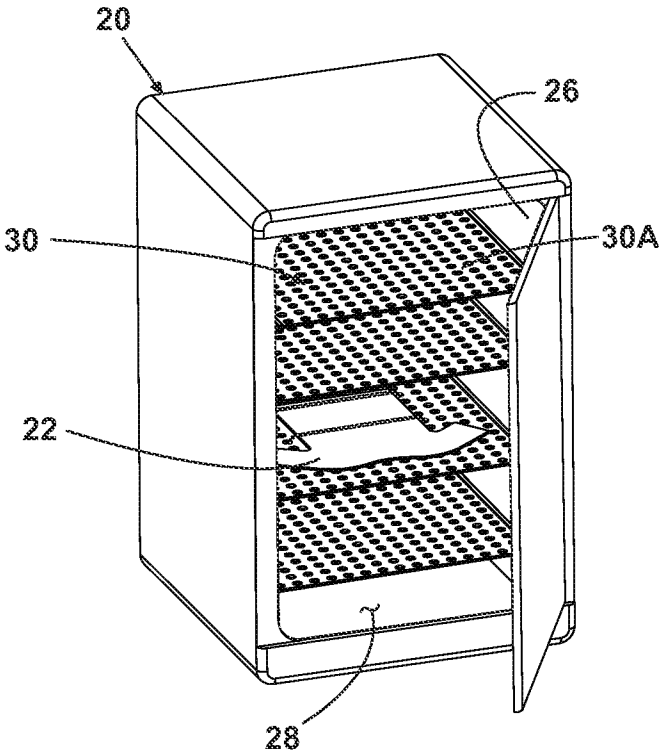
Figure 2D:
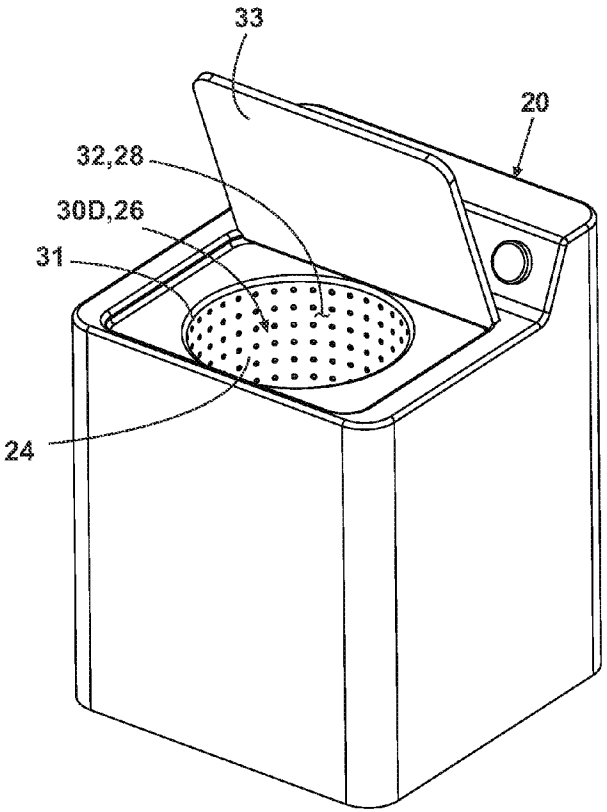
Figure 2C:
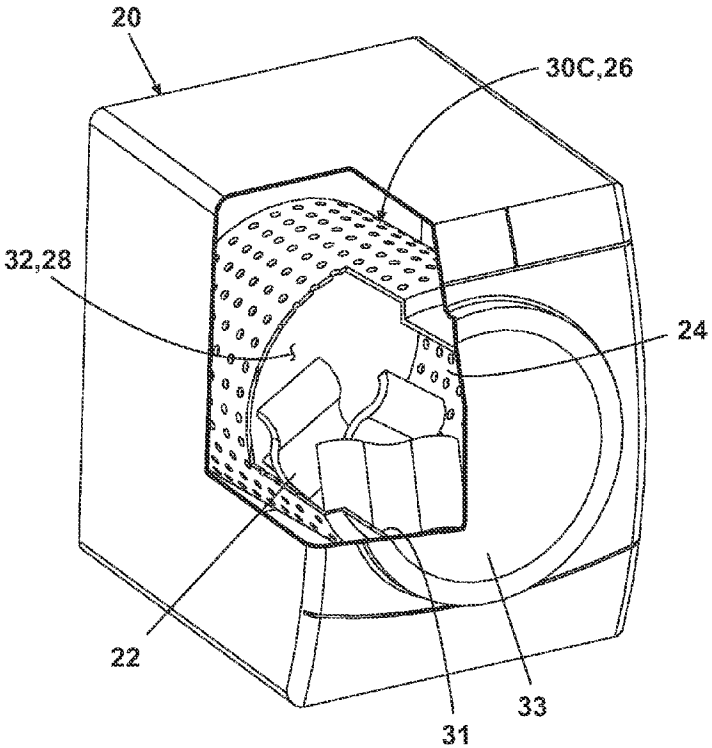

Components of the Fabric Revitalization System:

Enclosure:

Referring to FIG. 1, at least one enclosure 20 houses components necessary for accomplishing the fabric revitalization method on a fabric load 22. Though the invention contemplates the principles of modularity to achieve unification of the components necessary to carry out the disclosed process, the illustrated embodiment of the invention includes a single enclosure 20 for housing the system components as well as the fabric load 22 within the enclosure 20. The enclosure 20 and subassemblies thereof can be composed of suitable materials to withstand the various revitalization processes to which the fabric load 22 is subjected. An outer housing 23 of the enclosure 20 can be composed of aluminium, steel, or similar material. The enclosure 20 houses inner components or subassemblies that can be coated or composed of materials to withstand the various temperatures, pressures, and/or chemistries used during the method.

Chamber:

Referring to FIGS. 2A-2D, the illustrated embodiment contains a chamber 26 inside the enclosure 20. The chamber 26 provides an interior 28 that can include a support substrate 30 for the fabric load 22 during the refreshing process. The chamber 26 can include a substantially horizontal support substrate 30A (e.g., a shelf, FIG. 2A), a substantially vertical support substrate 30B (e.g., a hanger, FIG. 2B), or a cylindrical support substrate, such as a cylindrical horizontal chamber 30C (e.g., an imperforate drum or perforated drum (basket), FIG. 2C) or a cylindrical vertical chamber 30D (e.g., an imperforate drum or perforated drum (basket), FIG. 2D). When the support substrate 30 comprises the horizontal chamber 30C or the vertical chamber 30D, the support substrate 30 forms the chamber 26.

For stationary refreshing systems, the support substrate 30 can be the substantially horizontal support substrate 30A or substantially vertical support substrate 30B. For non-stationary refreshing systems (e.g., dynamic or tumbling processes), the support substrate 30 can be the cylindrical chamber 30C in the shape of a drum or the cylindrical chamber 30D in the shape of a basket, wherein both the drum and/or the basket have an inner surface 24 defining an interior 32 for placement of the fabric load 22. The interior 32 can be accessed through an opening 31, which enables user access to the interior 32, and the opening 31 can be selectively closed by a closure 33, such as a hinged door.

Figure 3A:
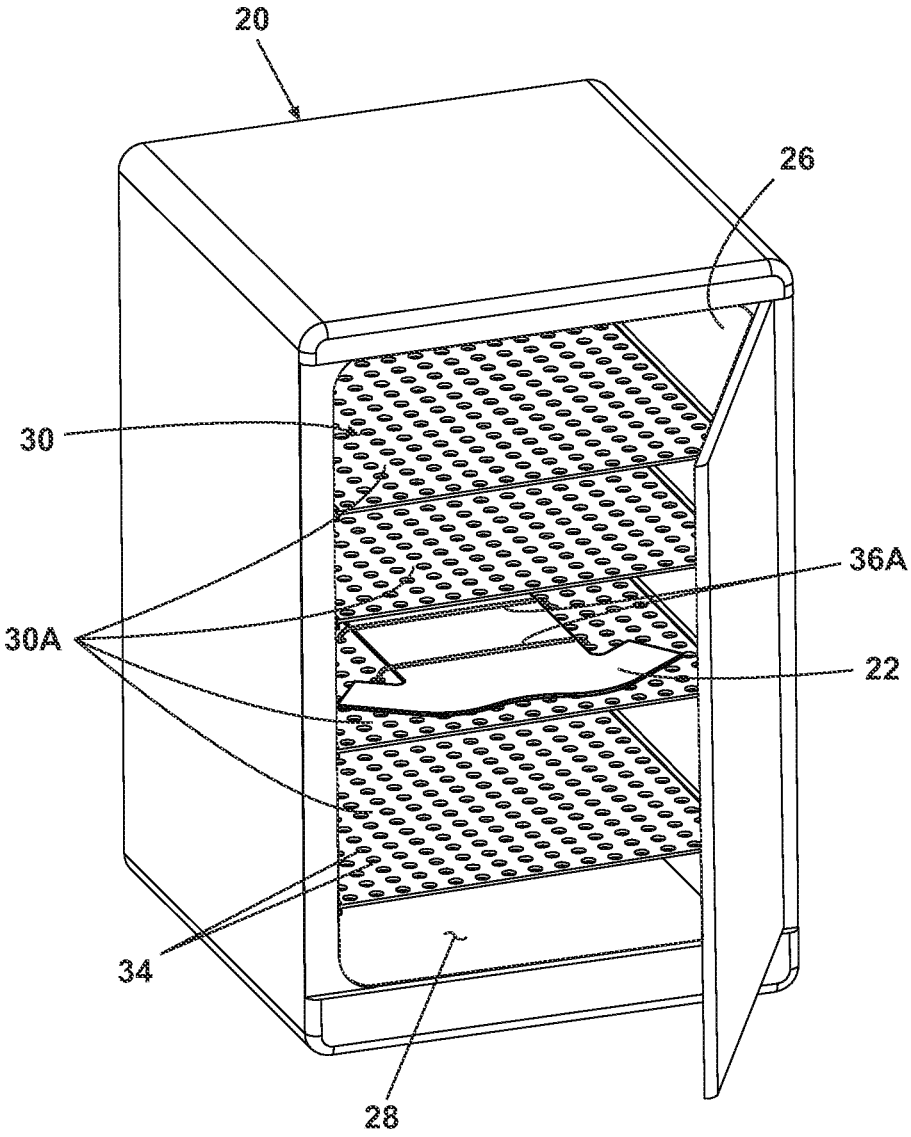
FIG. 3A depicts an exemplary enclosure for a stationary revitalization system that includes substantially horizontal support substrates for fabric.

Referring to FIG. 3A, for the stationary refreshing systems that include the substantially horizontal support substrates 30A, a plurality of the horizontal support substrates 30A can be permanently mounted at designated heights in the interior 28 of the chamber 26. Alternatively, a plurality of the horizontal support substrates 30A can be adjustable and installed in the interior 28 of the chamber 26 at heights determined by the consumer. Each of the horizontal support substrates 30A can include pores or openings 34 to permit passage of air through the horizontal support substrate 30A. As will be explained in greater detail below, the passage of air through the pores or openings 34 permits the flow of air to contact the fabric load 22 supported by the horizontal support substrate 30A. Optionally, the horizontal support substrates 30A can include fabric load restraints 36A (e.g., pins, ties, clips, a secondary horizontal support substrate) to hold an article of the fabric load 22 in place during the revitalization process.

Figure 3B:
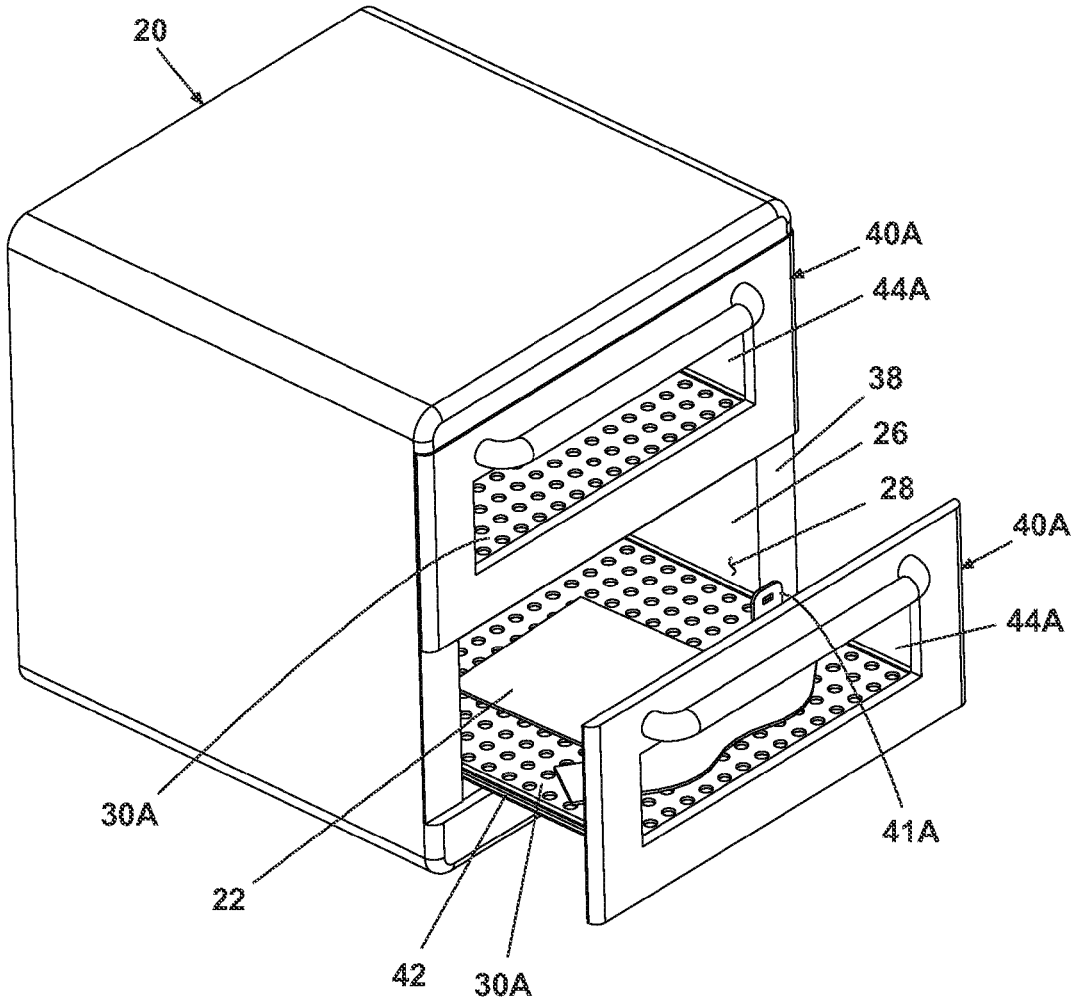
FIG. 3B depicts an exemplary enclosure for a stationary revitalization system that includes a cabinet having at least one horizontal drawer and substantially horizontal support substrates.

Referring to FIG. 3B, the stationary refreshing systems that include the substantially horizontal support substrates 30A can optionally include a cabinet 38 having at least one horizontal drawer 40A with at least one of the horizontal support substrates 30A in the horizontal drawer 40A or forming a portion of the horizontal drawer 40A. The horizontal drawer 40A can be mounted on a horizontal sliding mechanism 42 to enable the horizontal drawer 40A to slide open and closed for the purposes of placing articles of the fabric load 22 into the interior 28 of the chamber 26. The horizontal drawer 40A can establish a locked connection with the enclosure 20, such as by using a suitable locking mechanism 41A commonly employed in the art, which can include a mechanical locking means, an electronic locking means, or any other suitable locking means. Optionally, individual horizontal drawers 40A can establish a locked connection with the enclosure 20, such as by using the suitable locking mechanism 41A commonly employed in the art, which can include a mechanical locking means, an electronic locking means, or any other suitable locking means. Alternatively, all of the horizontal drawers 40A can establish a uniform, simultaneous, locked connection with the enclosure 20, such as by using the suitable locking mechanism 41A commonly employed in the art, which can include a mechanical locking means, an electronic locking means, or any other suitable locking means. Optionally, each of the horizontal drawers 40A can include a window 44A to enable the consumer to view the revitalization process as it proceeds (see below).

Figure 3C:
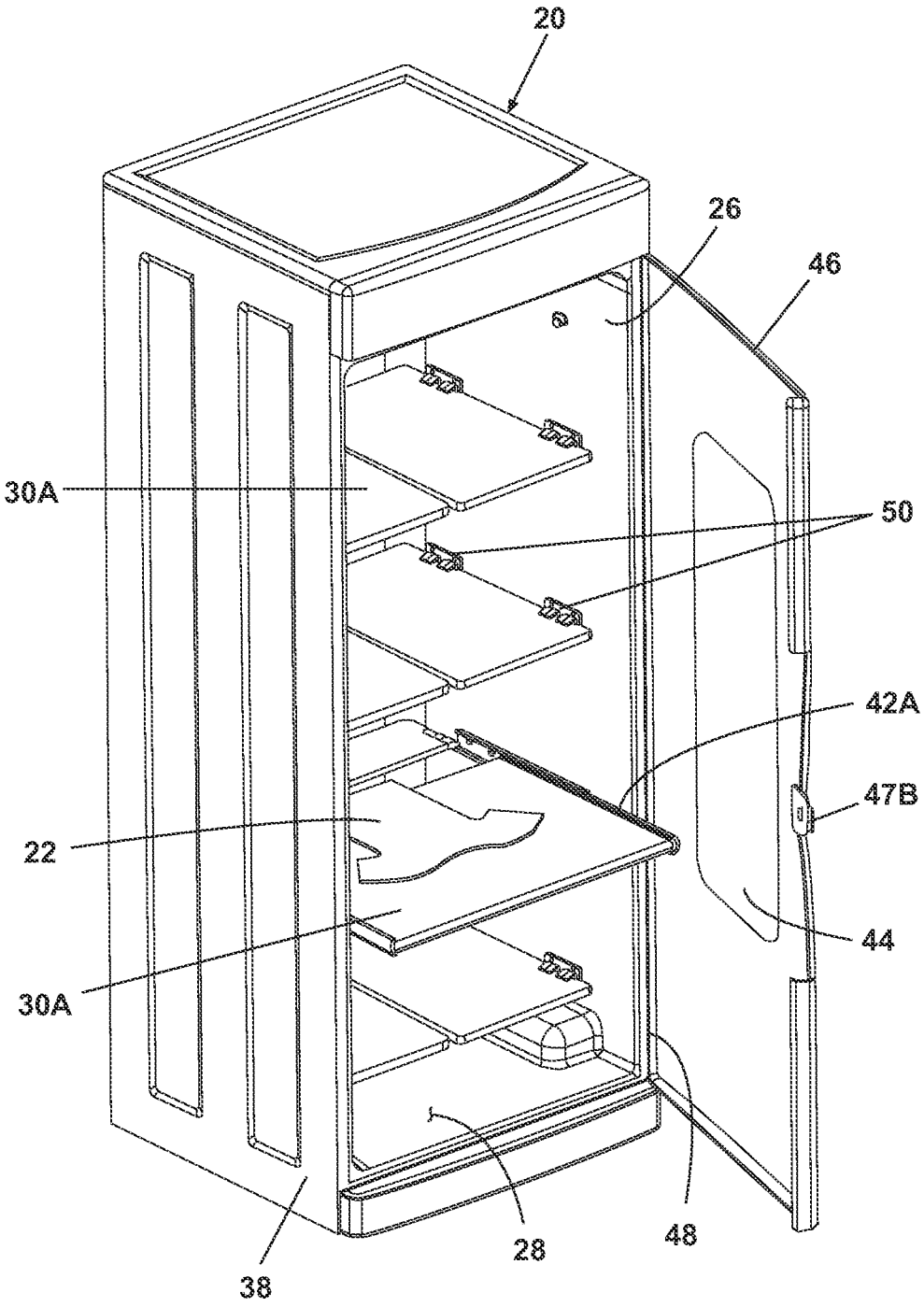
FIG. 3C depicts an exemplary enclosure for a stationary revitalization system that includes a cabinet having a door and substantially horizontal support substrates.

Referring to FIG. 3C, the stationary refreshing systems that include the substantially horizontal support substrates 30A can optionally include a cabinet 38 having at least one door 46 that the consumer can open to access the interior 28 of the chamber 26. The door 46 can be connected to the enclosure 20 through the use of a suitable connector 48 (e.g., hinge), which is designed to permit the consumer to open the door 46 to the chamber 26 in any fashion commonly understood to one skilled in the art. Though FIG. 3C depicts the door 46 opening rightward from the connector 48 located on a right side of the cabinet 38, it will be understood that the connector 48 can be mounted in any relationship between the door 46 and the enclosure 20 so as to permit rightward, leftward, downward, and upward opening movement or any other type of movement relative to the closed position of door 46. The door 46 can establish a locked connection with the enclosure 20, such as by using a suitable locking mechanism 47B commonly employed in the art, which can include a mechanical locking means, an electronic locking means, or any other suitable locking means. Optionally, the door 46 can include a window 44 to enable the consumer to view the revitalization process as it proceeds (see below).

Optionally, the stationary refreshing systems that include the substantially horizontal support substrates 30A can include the horizontal support substrates 30A mounted on movable or non-movable support structures 50 (e.g., support pins or hinges). Alternatively, the cabinet 38 can include the horizontal support substrate 30A mounted on a sliding mechanism 42A to enable the horizontal support substrate 30A to slide open and closed for the purposes of placing articles of the fabric load 22 into the interior 28 of the chamber 26. Optionally, the cabinet 38 can include both the horizontal support substrates 30A mounted on the movable or non-movable support structures 50 and the horizontal support substrates 30A mounted on the sliding mechanism 42A.

Figure 3D:
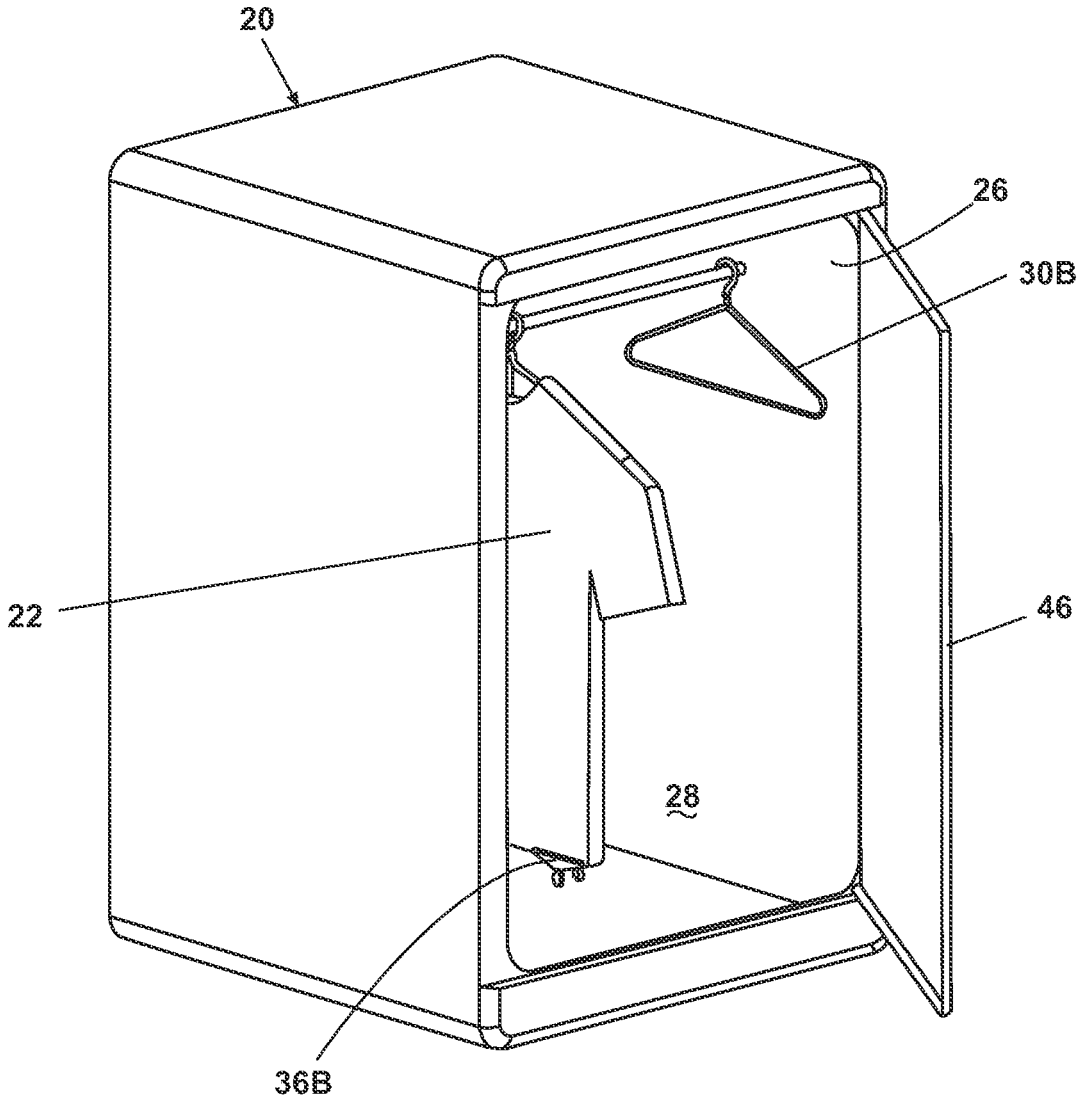
FIG. 3D depicts an exemplary enclosure for a stationary revitalization system that includes substantially vertical support substrates.

Referring to FIG. 3D, for stationary refreshing systems that include the substantially vertical support substrates 30B, a plurality of the vertical support substrates 30B can be permanently mounted at designated locations in the interior 28 of the chamber 26. Alternatively, a plurality of the vertical support substrates 30B can be adjustable and installed in the interior 28 of the chamber 26 at locations determined by the consumer. Optionally, the vertical support substrates 30B can include fabric load restraints 36B (e.g., pins, ties, clips, a secondary vertical support substrate, etc.) to hold an article of the fabric load 22 in place during the revitalization process.

Figure 3E:
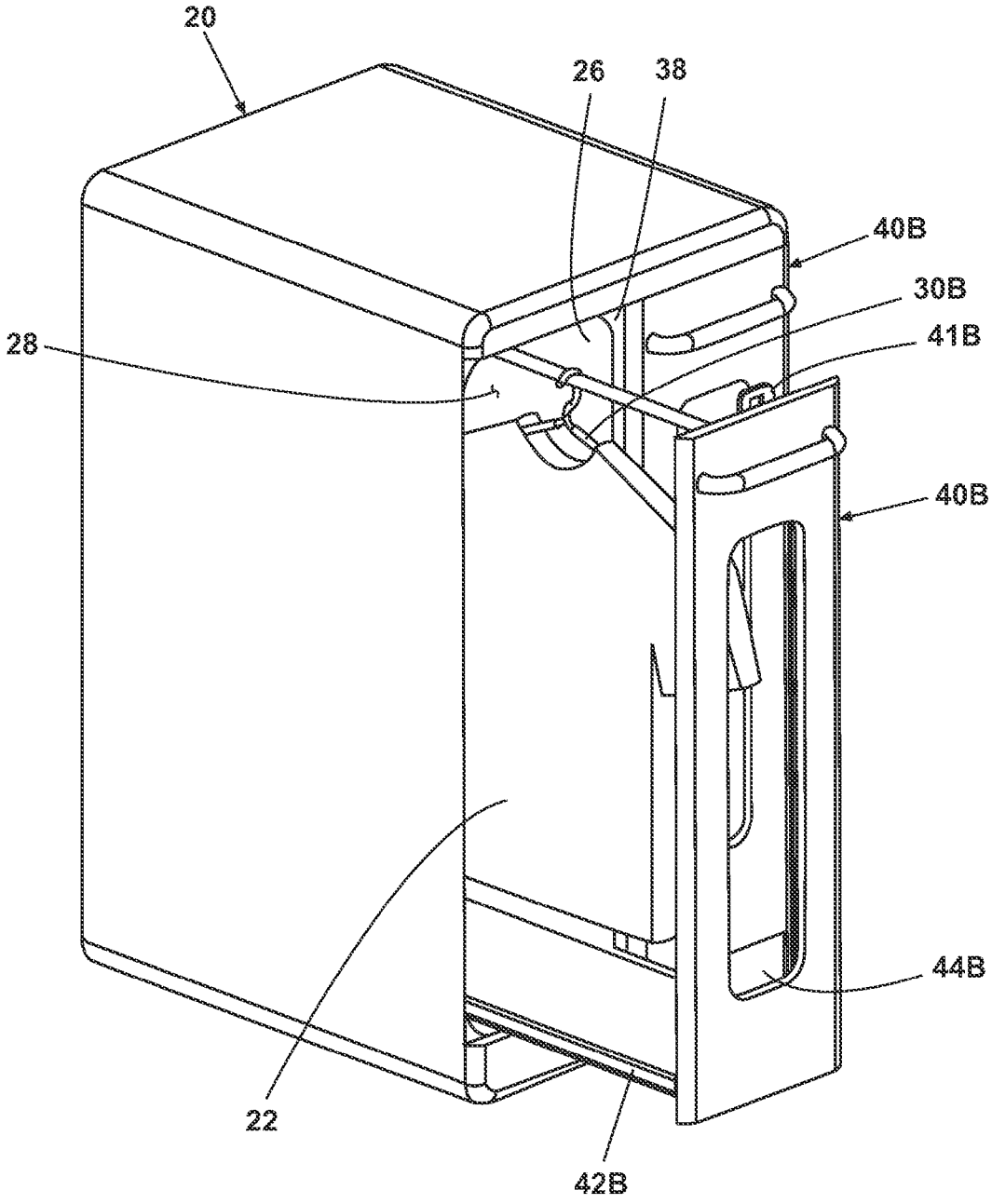
FIG. 3E depicts an exemplary enclosure for a stationary revitalization system that includes a cabinet having at least one vertical drawer and substantially vertical support substrates.

Referring to FIG. 3E, the stationary refreshing systems that include the substantially vertical support substrates 30B can optionally include a cabinet 38 having at least one vertical drawer 40B with at least one of the vertical support substrates 30B in the vertical drawer 40B or forming a portion of the vertical drawer 40B. The vertical drawer 40B can be mounted on a horizontal sliding mechanism 42B to enable the vertical drawer 40B to slide open and closed for the purposes of placing articles of the fabric load 22 into the interior 28 of the chamber 26. The vertical drawer 40B can establish a locked connection with the enclosure 20, such as by using a suitable locking mechanism 41B commonly employed in the art, which can include a mechanical locking means, an electronic locking means, or any other suitable locking means. Optionally, individual vertical drawers 40B can establish a locked connection with the enclosure 20, such as by using the suitable locking mechanism 41B commonly employed in the art, which can include a mechanical locking means, an electronic locking means, or any other suitable locking means. Alternatively, all of the vertical drawers 40B can establish a uniform, simultaneous, locked connection with the enclosure 20, such as by using the suitable locking mechanism 41B commonly employed in the art, which can include a mechanical locking means, an electronic locking means, or any other suitable locking means. Optionally, each of the vertical drawers 40B can include a window 44B to enable the consumer to view the revitalization process as it proceeds (see below).

Figure 3F:
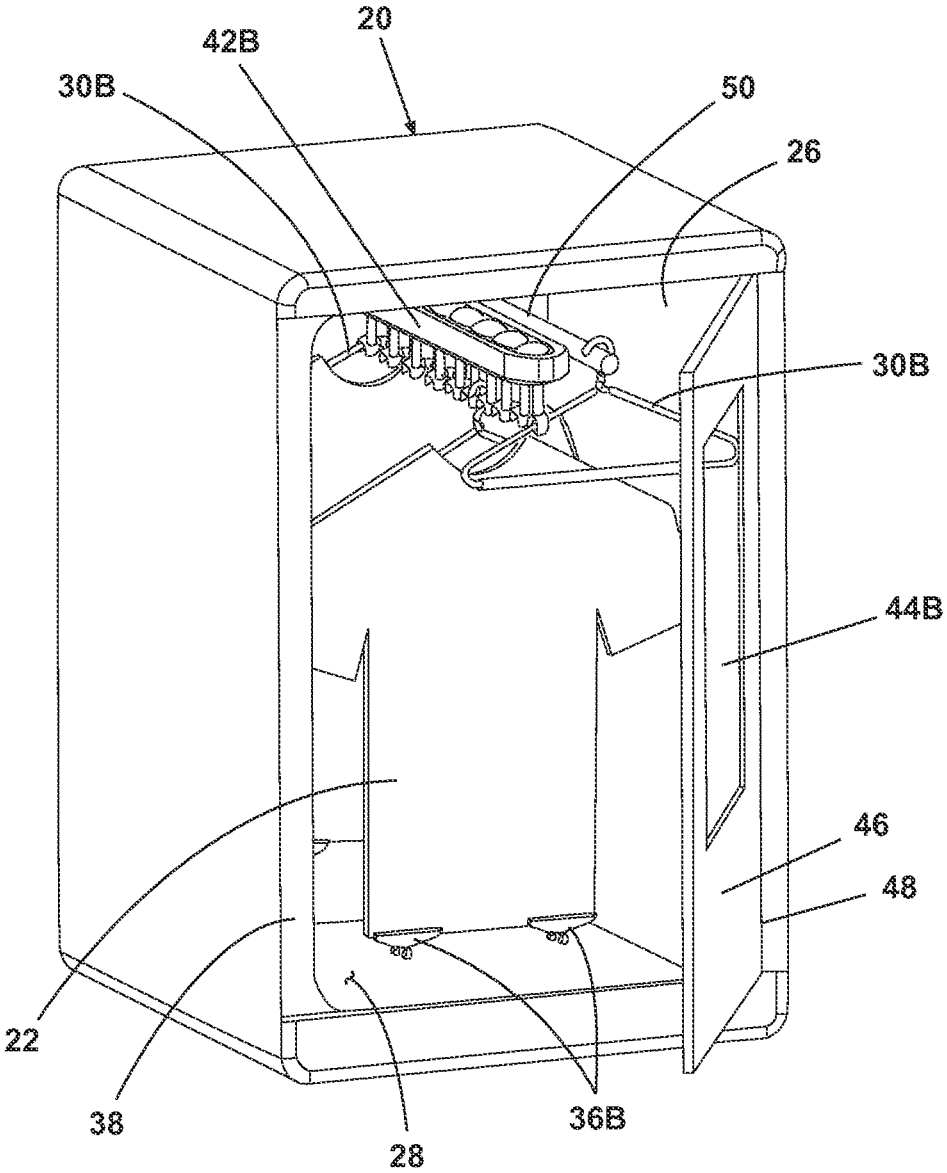
FIG. 3F depicts an exemplary enclosure for a stationary revitalization system that includes a cabinet having a door and substantially vertical support substrates.

Referring to FIG. 3F, the stationary refreshing systems that include the substantially vertical support substrates 30B can optionally include a cabinet 38 having at least one door 46 that the consumer can open to access the interior 28 of the chamber 26. The door 46 can be connected to the enclosure 20 through the use of a suitable connector 48 (e.g., hinge), which is designed to permit the consumer to open the door 46 to the enclosure 20 in any fashion commonly understood to one skilled in the art. Though FIG. 3F depicts the door 46 opening rightward from the connector 48 located on a right side of the cabinet 38, it will be understood that the connector 48 can be mounted in any relationship between the door 46 and the enclosure 20 so as to permit rightward, leftward, downward, and upward opening movement or any other type of movement relative to the closed position of the door 46. Optionally, the door 46 can include a window 44B to enable the consumer to view the revitalization process as it proceeds (see below).

Optionally, the stationary refreshing systems that include the substantially vertical support substrates 30B can include the vertical support substrates 30B mounted on non-movable support structures 50 (e.g., support pins). Alternatively, the cabinet 38 can include the vertical support substrate 30B mounted on a sliding mechanism 42B to enable the vertical support substrate 30B to slide open and closed for the purposes of placing articles of the fabric load 22 into the interior 28 of the chamber 26. Optionally, the cabinet 38 can include both the vertical support substrates 30B mounted on the non-movable support structures 50 and the vertical support substrates 30B mounted on the sliding mechanism 42B. As another option, the non-movable support structures 50 and the sliding mechanism 42B can be vertically adjustable within the cabinet 38.

While the following detailed description of the functional elements of the illustrated embodiment for the revitalizing system and method are in the context of a rotatable cylindrical chamber having a generally horizontal axis, it will be appreciated that the features can be readily adapted for use with any of the fabric containing structures in FIGS. 2A-2D and 3A-3F and that alternative means of providing mechanical, chemical, and thermal energy to the fabric load 22 can be used in accordance with the broadest concepts of the present invention. Because the following detailed description utilizes the rotatable cylindrical chamber, reference to the chamber 26 can be considered a reference to the drum 30C and vice-versa.

Figure 4:
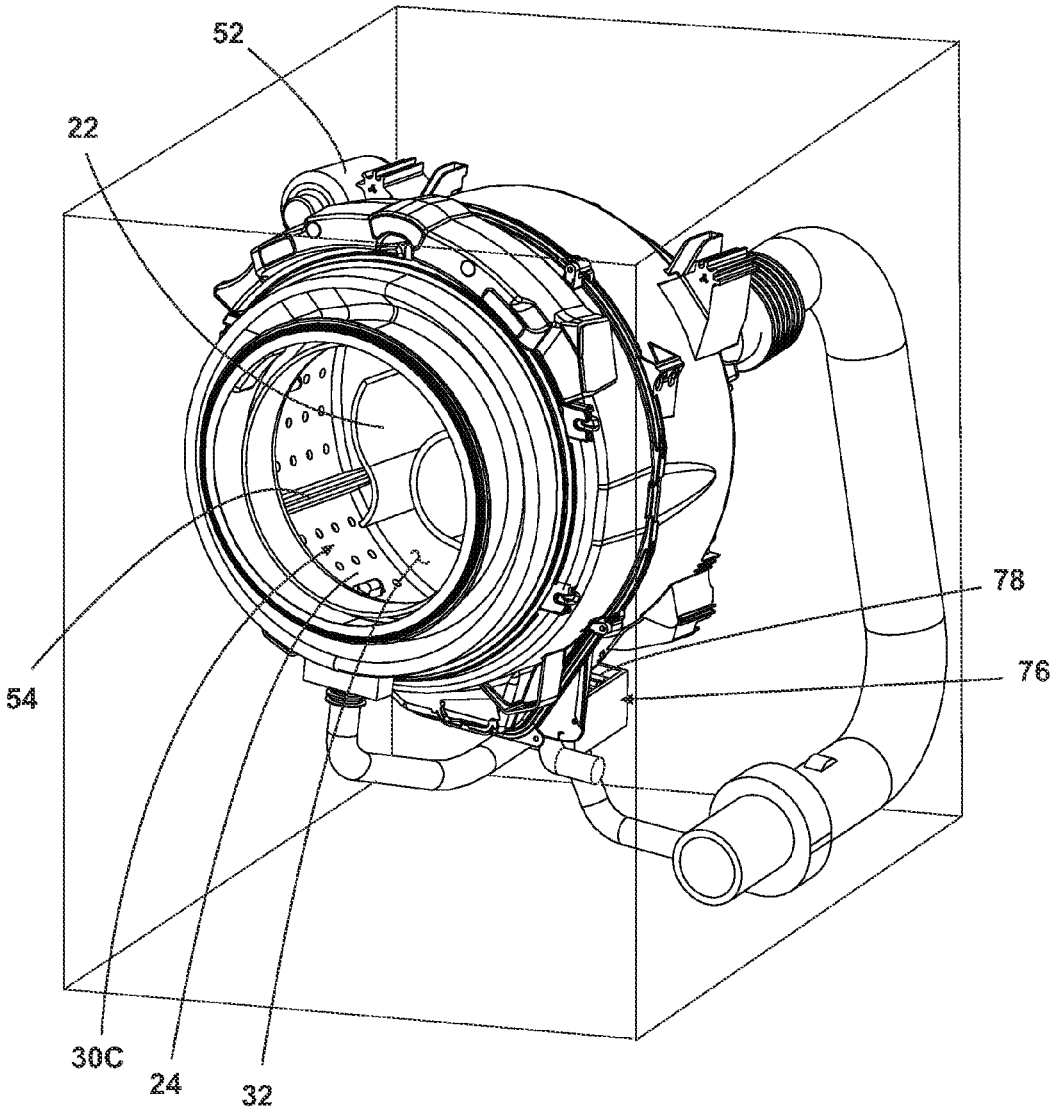
FIG. 4 depicts an exemplary revitalization chamber having a shape of a drum for a non-stationary revitalization system and heater control components of the revitalization system.

Referring to FIG. 4, a motor 52 drives the drum 30C and thereby, controls the rotational speed and rotational direction of the drum 30C. Control of the rotational speed of the drum 30C permits variation of the rotation of the drum 30C as a function of the dryness of the fabric load 22. The ability to vary the rotational speed of the drum 30C improves the uniform distribution of added chemistries at different stages of the refreshing process. Optionally, the motor 52 can reverse rotational direction of the drum 30C during operation. The reversible aspect of the drum 30C promotes uniformity of dehydration of the fabric load 22 during the initial phase of the refreshing process and the uniformity of fluid distribution throughout the fabric load 22 during the latter phase the process. The motor 52 can be considered to be a part of a fabric movement system for causing movement of the fabric load 22. It is within the scope of the invention, however, to employ other systems for causing movement of the fabric load 22.

The drum 30C can contain a plurality of baffles 54. The baffles 54 can be located along the inner surface 24 of the drum 30C defining an interior circumference of the drum 30C. The baffles 54 can be oriented generally parallel to a rotational axis of the drum 30C. The baffles 54 facilitate the tumbling action of the fabric load 22 within the drum 30C as the drum 30C rotates about the rotational axis. The combination of the baffles 54 and the reversible rotation of the drum 30C promotes a reduction in tangling of clothing articles; a reduction in balling of textile fabrics, such as sheets, rugs, or towels; and a reduction in wrinkles in fabrics. The surfaces of fabric articles become more open during tumbling, which greatly facilitates movement of loose particulates, such as soils, stains, and hairs, from the fabric surfaces to an air outlet of the drum 30C. The air outlet of the drum 30C will be discussed in more detail below.

Figure 5A:
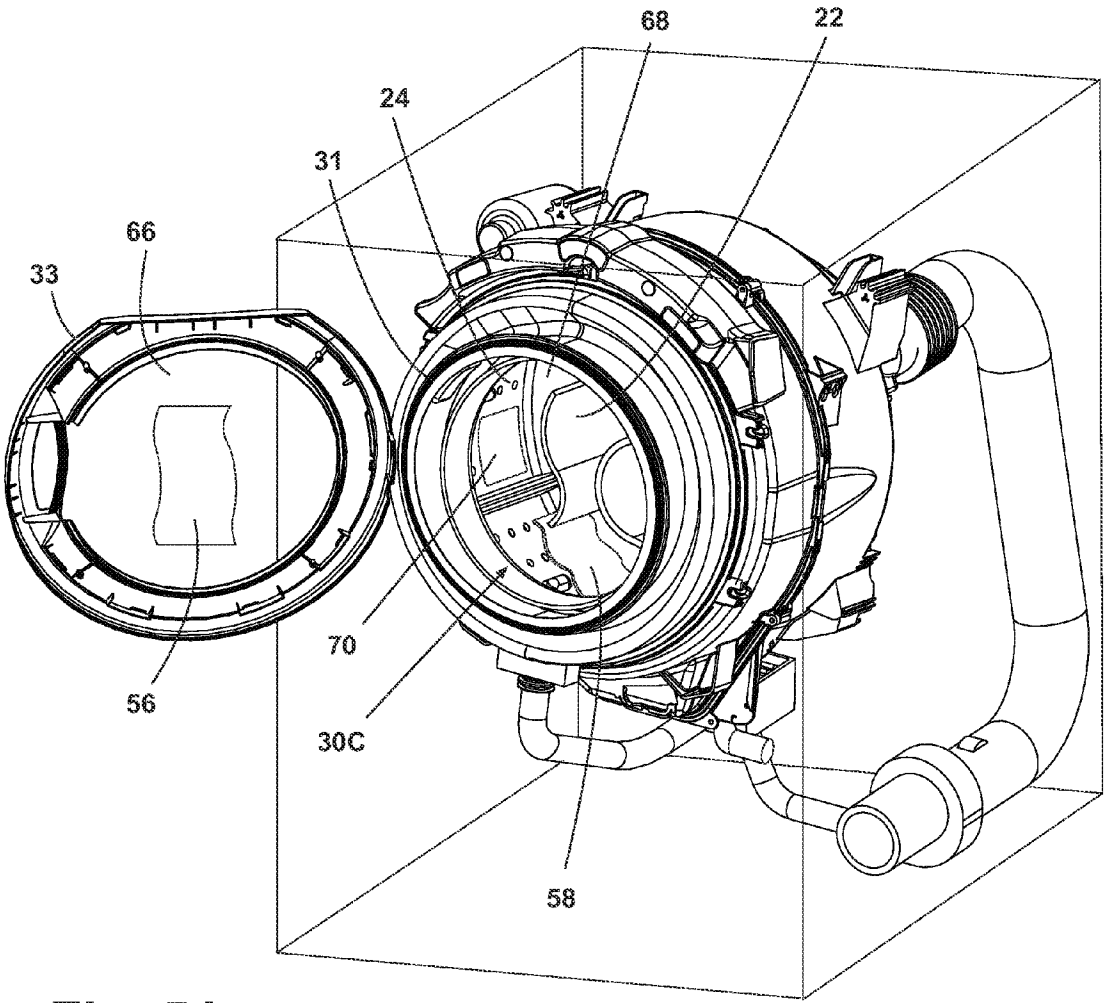
FIG. 5A depicts exemplary textured substrate surfaces for lining a drum of a non-stationary revitalization system.
Figure 5B:
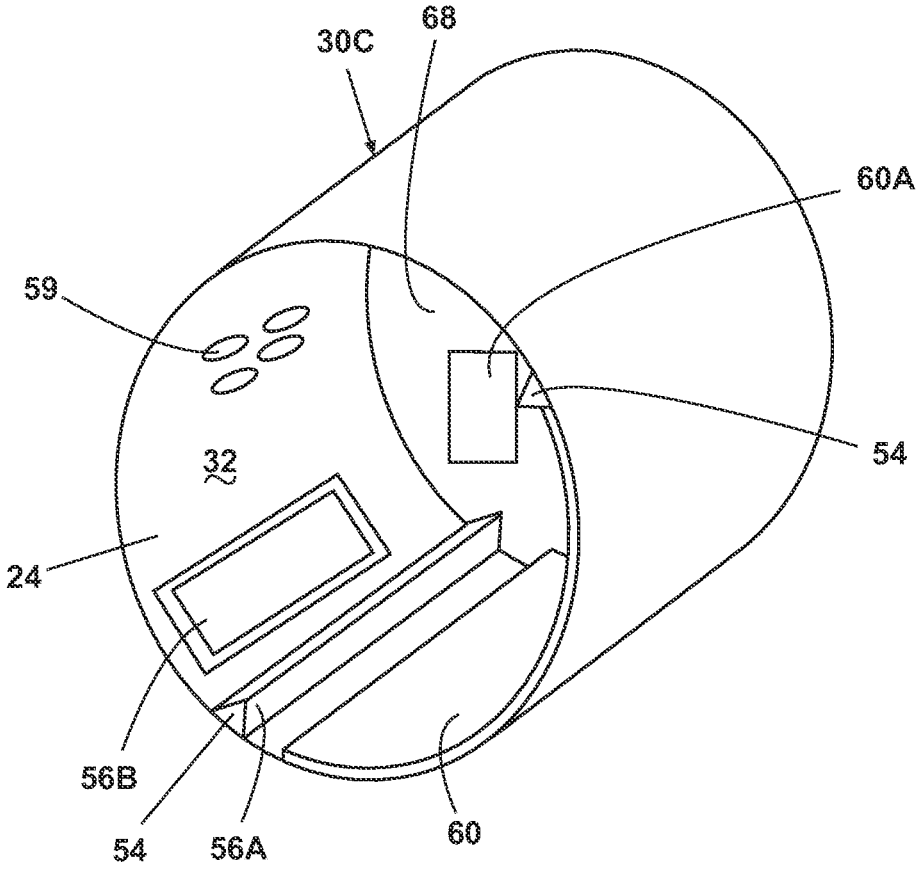
FIG. 5B depicts alternative exemplary textured substrate surfaces for lining a drum of a non-stationary revitalization system.

Textured Substrate Surface:

Referring to FIGS. 5A and 5B, in addition to the plurality of the baffles 54, the drum 30C can contain a textured substrate surface 56. The textured substrate surface 56 can contain a low (moisture) absorbency substrate 58. The low absorbency substrate 58 can be a non-(moisture) absorbing substrate having sound absorbing properties. The sound absorbing properties can be beneficial for absorbing at least a portion of the sound of the fabric load 22 moving in the drum 30C, such as sound generated by buttons clanking against the inside surface 24 of the drum 30C during rotation of the drum 30C.

The textured substrate surface 56 can be an integral design feature of the interior construction of the drum 30C, wherein the textured substrate surface 56 can be a machined aspect of the inside surface 24 of the drum 30C, such as a textured surface machined into the inside surface 24 of the drum 30C, or, optionally, a textured powder-coated treatment affixed to the inside surface 24 of the drum 30C. Optionally, the textured substrate surface 56 can coat or line the baffles 54 as shown at 56A. Optionally, the textured substrate surface 56 can be an independently manufactured article that is separate from the drum 30C, as shown at 56B. The textured substrate surface 56 can be provided on any surface of the drum 30C or on a surface of the door/closure 33 that comes in contact with the fabric load 22, including in a recess or depression formed in such surface for accepting a removable textured pad, as shown at 57 in FIG. 5C, or on a protrusion formed on such surface to which a textured surface is applied, as shown at 59 in FIG. 5B.

Providing the textured substrate surface 56 on the baffles 54, as shown at 56A, or on a feature or component protruding partially into the interior 32 of the drum 30C, as shown at 59, facilitates engagement of the textured surface with the fabric load 22, thereby, increasing mechanical energy and chemical transfer to the fabric load 22. It further facilitates manufacture of the textured substrate surface 56 because materials that might be inappropriate for use for the entire drum 30C can be used for the baffle 54 or the feature or component protruding into the drum 30C, as shown at 59. Further, these materials can also be used for the removable pad or other independent textured component 56B.

Figure 5C:
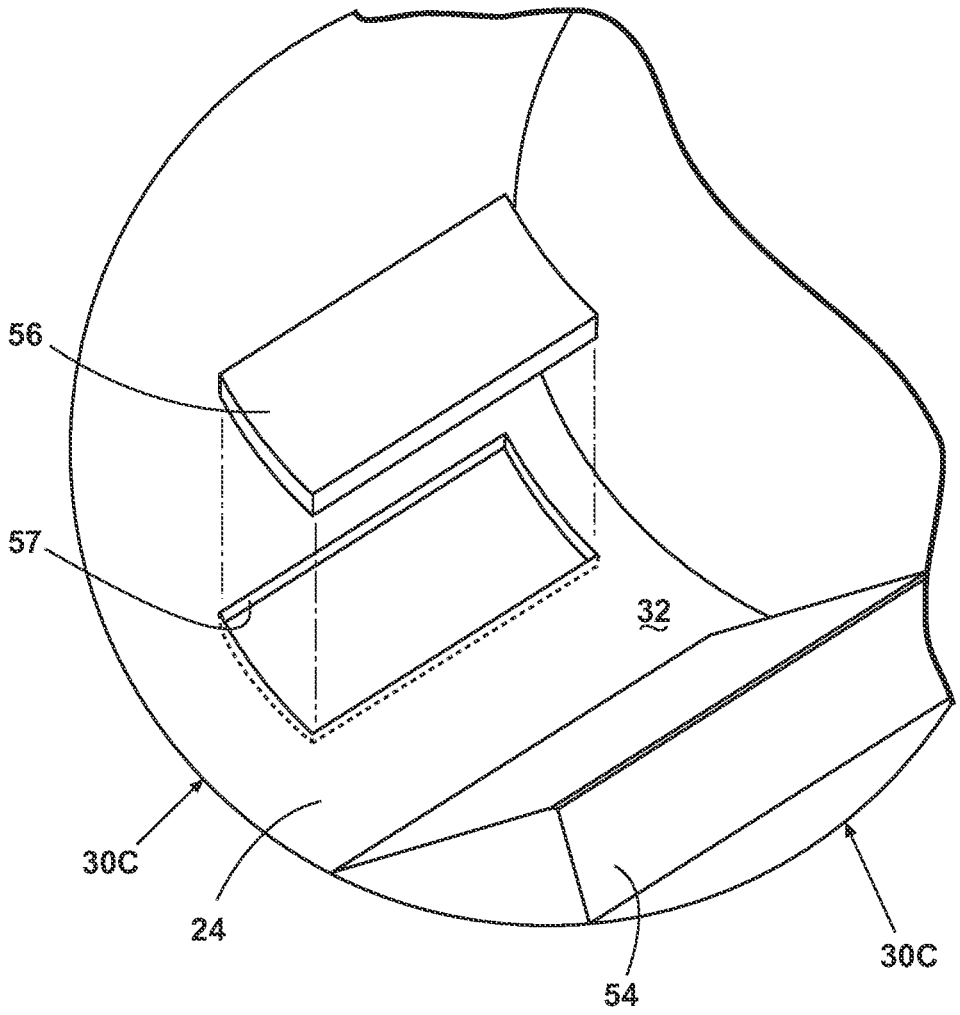
FIG. 5C depicts another alternative exemplary textured substrate surface for lining a drum of a non-stationary revitalization system, wherein the textured substrate surface is received within a recess in the drum.

In contrast, if it is desired to use a textured surface that does not protrude significantly into the interior 32 of the drum 30C due to the design of the revitalization system, the fabric to be treated, or the chemistry to be used, a textured pad or component can be mounted in a recess in the surface of the drum 30C as shown at 57 in FIG. 5C so that the textured substrate surface 56 is substantially aligned with the inside surface 24 of the drum 30C.

Referring back to FIGS. 5A and 5B, the low-absorbing textured substrate surface 56 can include a removable or permanent insert or pad 60 that lines at least a portion of the inside surface 24 of the drum 30C. As an option, the low-absorbing textured substrate surface 56 can include one or more of the pads 60 that substantially line the inside surfaces 24 of drum 30C between the baffles 54. Optionally, the textured substrate surface 56 can include one or more pads 60A that substantially line a front wall 66 and/or a back wall 68 of the drum 30C. In the illustrated embodiment, the back wall 68 of the drum 30C is formed by an inside surface of the closure 33. The pads 60 can also be attached to a surface of the drum 30C and protrude into the interior 32 of the drum 30C, as illustrated by example in FIG. 5D. Referring back to FIG. 5A, the textured substrate surface 56 can optionally be coverings 70 that cover pad liners that line the inside surface 24 of the drum 30C or are attached to the inside surface 24 of the drum 30C and project into the drum 30C. The pad liners can be removably or permanently attached to the inside surface 24 of the drum 30C.

The textured substrate surface 56 can comprise one or more separate elements. The textured substrate surface 56 can be a replaceable part that fits into a holder. The textured substrate surface 56 can be a non-continuous substrate (i.e., circular) that can have design elements that can be partially changed. The textured substrate surface 56 can contain rollers or balls to transfer the fluid from the surface to the drum 30C or to the fabric load 22. Finally, the textured substrate surface can optionally deliver chemistries and can contain an insert that fits into a pad where the chemistries can reside.

Figure 5D:
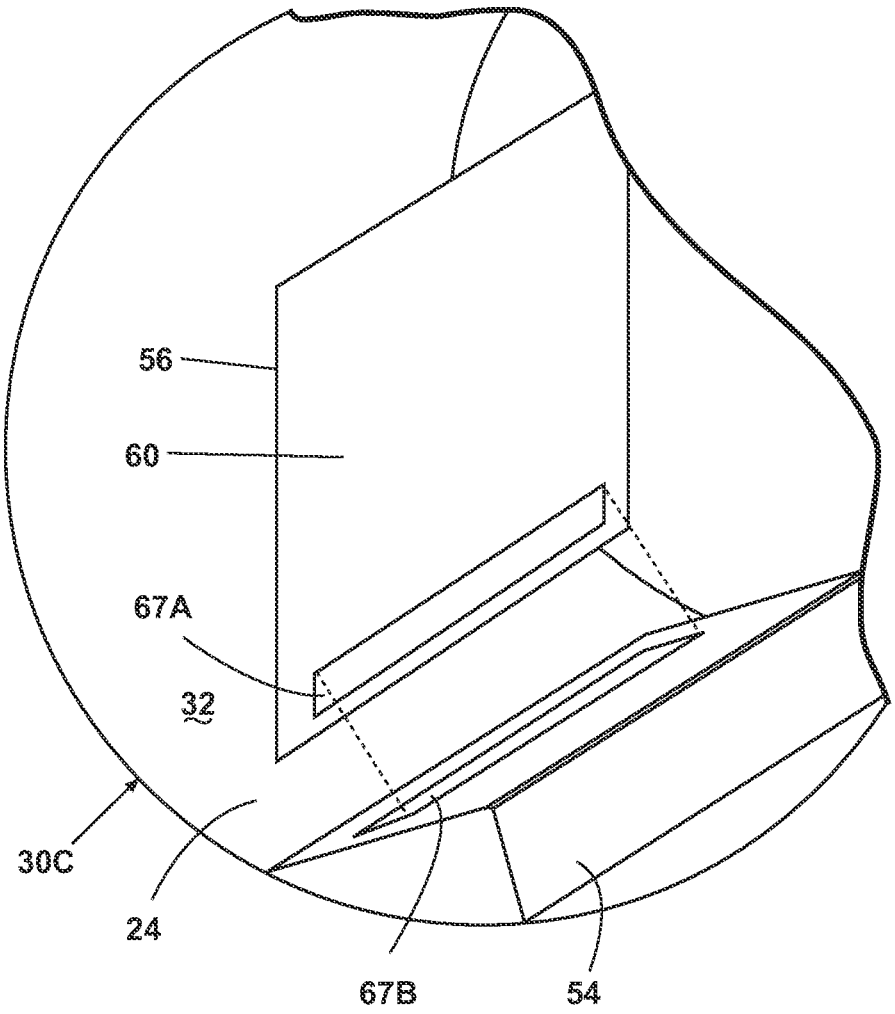
FIG. 5D depicts another alternative exemplary textured substrate surface for lining a drum of a non-stationary revitalization system, wherein the textured substrate surface can be attached to a baffle of the drum with first and second attachment means.

The textured substrate surface 56 can be permanently affixed to the inside surface 24 of drum 30C during final assembly of the drum 30C. Optionally, the textured substrate surface 56 can be removable from the inside surface 24 of the drum 30C. The textured substrate surface 56 can be coupled to a portion of the drum 30C with an attachment system, which can permanently or removably couple the textured substrate surface 56 to the portion of the drum 30C. Examples of the attachment system are illustrated in FIGS. 5C and 5D. In FIG. 5C, the attachment system comprises the recess 57 that receives the textured substrate surface 56. The recess 57 and the textured substrate surface 56 can form an interference fit that retains the latter in the former. Alternatively, the attachment system can comprise a first attachment means on the textured substrate surface 56 and a second attachment means on the drum 30C, as shown in FIG. 5D. The first and second attachment means in the illustrated example are Velcro® strips 67A, 67B that engage one another to couple the textured substrate surface 56 in the form of the pad 60 to the baffle 54 of the drum 30C. Other examples of attachment systems include, but are not limited to, mechanical fasteners, such as clips, and magnets. If the drum 30C is magnetic, then the attachment means can comprise a magnet located on the textured substrate surface 56, and the textured substrate surface 56 can be located anywhere in the drum 30C.

The textured substrate surface 56 can be made of any suitable materials. In addition to the examples provided above, other examples of materials for the textured substrate surface 56 include, but are not limited to, woven materials, non-woven materials, materials made of natural fibers, such as flax, cotton, wool, and felt, materials made of artificial fibers, such as rayon, acetate, nylon, polyester, triacetate, spandex, micro fibers, and lyocell. Other examples of suitable materials for the textured substrate surface 56 are provided below.

Optimally, the textured substrate surface 56 can be substantially non-absorbing. However, a low-absorbing surface can be used to approach the benefits of a non-absorbing surface, for example, if the low-absorbing surface provides other benefits, such as cost, durability, fabric care, or sound absorption, in addition to its low absorbency. The textured substrate surface 56 can have an open-cell structure, a closed-cell structure, or a combination thereof, depending on a desired degree of absorbency attributable to the textured substrate surface 56.

By "non-absorbing," it is meant that the material does not substantially absorb moisture. In relative terms, the textured substrate surface 56 that is non-absorbing will absorb less moisture than an absorbing textured open-cell substrate surface. The non-absorbing characteristics of the textured substrate surface 56 ensures that the substrate surface does not retain moisture during the initial process whereby the fabric load 22 is dehydrated and during the final phase when the fabric load 22 is rehydrated. Furthermore, any specialized chemistry or treatment that is added to the fabric load 22 during the process will be driven either into contact with the fabric load 22 or out of the drum 30C rather than being retained or trapped in the textured substrate surfaces 56, such as those that line the inside surface 24 of the drum 30C. Thus, use of the non-absorbing, textured substrate surface 56 can improve the efficiency of the process in terms of utilization of materials and time.

One purpose of the non-absorbing, textured substrate surface 56 is to provide a friction surface for imparting mechanical energy to the tumbling fabric load 22 in order to disrupt loose particulates, such as soils, hairs, and stains, from the surface of the fabric articles in the fabric load 22. One of the advantages of using the textured substrate surface 56 is a reduction in "button clatter" during the tumbling of the fabric load 22 in the drum 30C, owing to the intervening material between the fabric load 22 and the front and back walls 66, 68 and the inside surface 24 of the drum 30C. Because buttons of the fabric load 22 do not directly contact the front and back walls 66, 68 and the inside surface 24, which can be made of metal, of the drum 30C during the rotation of the drum 30C, the integrity of the buttons is also retained.

The textured substrate surface 56 can draw particulates, such as soils and hairs, away from the fabric load 22 and trap the particulates. The removable pads 60 or the coverings 70 are one type of the textured substrate surface 56 contemplated for use with the process, and these textured substrate surfaces can be removed from the drum 30C, such as for cleaning. Suitable cleaning procedures for these materials can include washing in conventional fabric washers and dishwashers, as well as vacuum cleaning, or mechanical agitation.

Optionally, the textured substrate surface 56 can include directional fibers similar to those found in a conventional lint brush. For example, when the fabric articles in the fabric load 22 contact the directional fibers in one orientation, lint is removed from the fabric. When the fabric articles in the fabric load 22 contact the directional fibers in the opposite orientation, lint is removed from the textured substrate surface 56 as a collective particulate matter and transferred to a lint filter 74, which will be described in more detail below. Optionally, the textured substrate surfaces 56 can be self-cleaning if the textured substrate surfaces 56 contain break-away particulate surface substructures that contain the entrapped particulate matter. The break-away particulate surfaces can be suitably caught in the lint filter 74 as part of the lint removed during the process. Optionally, the non-absorbing, textured substrate surface 56 can be subject to limited-use or single-use applications as disposable, throw-away materials to reassure the consumer that the fabric process is optimized for a particular fabric load.

The non-absorbing, textured substrate surface 56 can also contain impregnated nanoparticles as well as a microparticulate surface structure, encapsulated liquids, and other substructures for impregnating fluids on the textured substrate surface 56. These types of substructures can function as a fluid dispensing system and can hold fragrances, perfumes, and/or specialized chemistries that aid in the process to enhance the smell, feel, and appearance of the fabrics or that impart to the fabric specific chemical attributes, such as, for example, insect repellent or flame retardant properties, as well as a variety of alternative chemistries discussed infra under the section of this disclosure entitled Delivery System. The nanoparticles and/or microparticles can be activated by a variety of mechanisms, including changes in temperature, pressure, and/or humidity, or by a mechanical means.

Figure 6A:
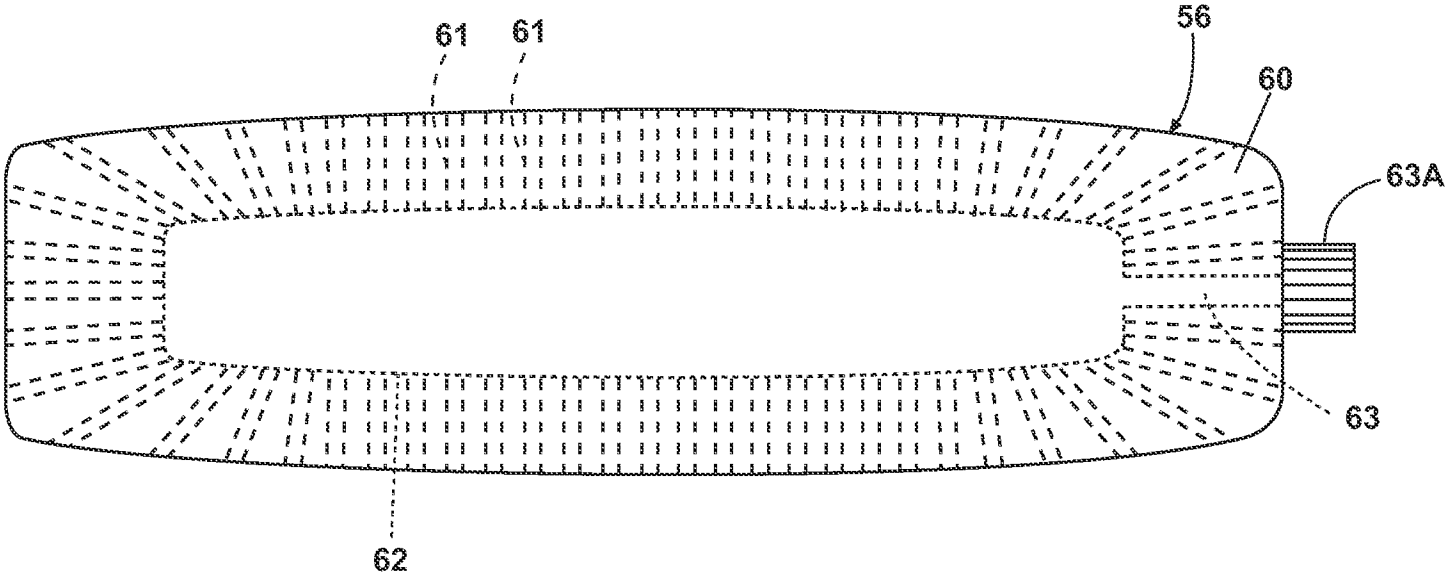
FIG. 6A depicts an exemplary textured substrate surface including an inner fluid reservoir.
Figure 6B:
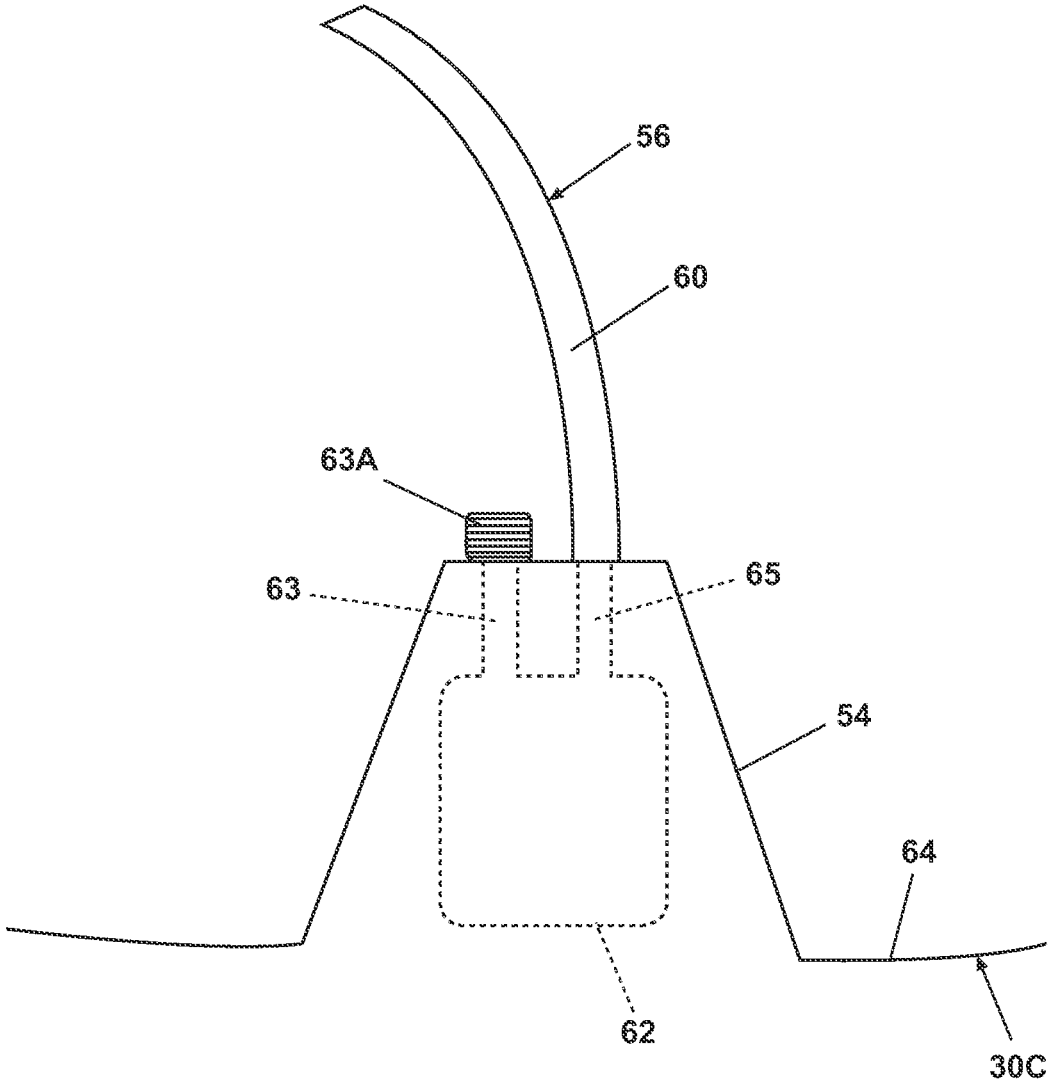
FIG. 6B depicts an alternative exemplary textured substrate surface fluidly coupled to a fluid reservoir located in a baffle of the drum.

The fluid dispensing system can comprise other means, examples of which are illustrated in FIGS. 6A and 6B. In FIG. 6A, the textured substrate surface 56 in the form of the pad 60 comprises an inner reservoir 62 inside the pad 60. The inner reservoir 62 can store a supply of fluid that can be transferred to the fabric load 22. The inner reservoir 62 can be a self-contained chamber that is pre-filled with the fluid and inserted into the pad 60, or the inner reservoir 62 can be coupled to a fluid conduit 63 that extends from the inner reservoir 62 to the surface of the pad 60. In the latter case, a user can fill the inner reservoir 62 with a desired fluid through the fluid conduit 63 and/or empty the inner reservoir 62 through the fluid conduit 63. The fluid conduit 62 can include a closure 63A, such as a screw-cap, to close the fluid conduit 63 when not in use or for filling or draining the inner reservoir 62. The pad 60 can further comprise a plurality of fluid channels 61 configured to deliver the fluid from the inner reservoir 62 to the surface of the pad 60. The fluid channels 61 can be designed to automatically, such as by capillary or wicking action, draw the fluid to the surface the pad 60, or the fluid can be forced through the fluid channels 61 as a result of mechanical interaction with the fabric load 22, such as by the weight of the fabric load 22 squishing the pad 60. Once the fluid is located at the surface of the pad 60, the fluid can be transferred to the fabric load 22 when the fabric load 22 contacts the pad 60.

FIG. 6B illustrates locating the inner reservoir 62 in one of the baffles 54 to which the textured substrate surface 56 in the form of the pad 60 is attached. The inner reservoir 62 can be accessed through a fluid conduit 63, which has a closure 63A, for filling and/or draining of the inner reservoir 62. The fluid in the inner reservoir 62 can be delivered to the pad 60 through one or more fluid delivery conduits 65 fluidly coupling the inner reservoir 62 to the pad 60. The fluid can be pumped through the fluid delivery conduit 65, or the fluid can flow through the fluid delivery conduit 65 as a result of gravity as the drum 30C rotates. Once the fluid reaches the pad 60, the fluid can be automatically transported, such as by capillary or wicking action, to the surface of the pad 60, or the fluid can be forced to the surface of the pad 60 as a result of mechanical interaction with the fabric load 22, such as by the weight of the fabric load 22 squishing the pad 60. Once the fluid is located at the surface of the pad 60, the fluid can be transferred to the fabric load 22 when the fabric load 22 contacts the pad 60.

The textured substrate surface 56 can also be configured to receive a solid form for delivering chemistry. In one embodiment, the chemistry itself can be the solid form.

Heater Control:

Referring back to FIG. 4, the system can comprise a heater 76 fluidly coupled to the interior 32 of the drum 30C to heat air flowing through the interior 32 of the drum 30C. The heater 76 illustrated in FIG. 4 having a plurality of sets of heating elements 78 is one type of heater that can be used in the system. For example, the heater 76 can include at least two sets of the heating elements 78. According to one embodiment, the heater 76 can quickly raise the temperature of the fabric load 22 from ambient temperature (about 70° F.) to a temperature substantially higher than ambient temperature, including a temperature within a temperature range from about 80° F. to about 144° F. Additionally, the heater 76, according to one embodiment, can quickly raise the temperature of the fabric load 22 from ambient temperature (about 70° F.) to a temperature equal to or less than an upper maximum limit ranging from about 140° F. to about 145° F. For example, the upper maximum limit can be about 144° F. This temperature maximum ensures that the stains on fabrics do not denature, yet provides for efficient dehydration of the fabrics and the elimination of odors and wrinkles without fabric damage. Both sets of the heating elements 78 can be subject to independent regulation so that one set can be shut off while leaving the second set on. The remaining set of active heating elements 78 can provide continued heating for fabric care during dehydration of the fabric load 22. For example, both sets of the heating elements 78 can be employed to quickly raise the temperature of the fabric load 22 to or near a predetermined temperature, and after the predetermined temperature has been reached, one set of the heating elements 78 can provide the continued heating during the dehydration of the fabric load 22 while the other set of the heating elements 78 is turned off. Operation of the heater 76, including one or more sets of the heating elements 78, can be governed by a heater control, which is discussed below.

In addition to dehydrating the fabric load 22, the heater 76 can be employed to revitalize the fabric load 22. For example, heat can be applied to the fabric load 22 to minimize wrinkles and odors. However, the amount of heat applied to the fabric load 22 must be controlled so as to prevent or reduce shrinkage of the fabrics in the fabric load 22.

Figure 7:
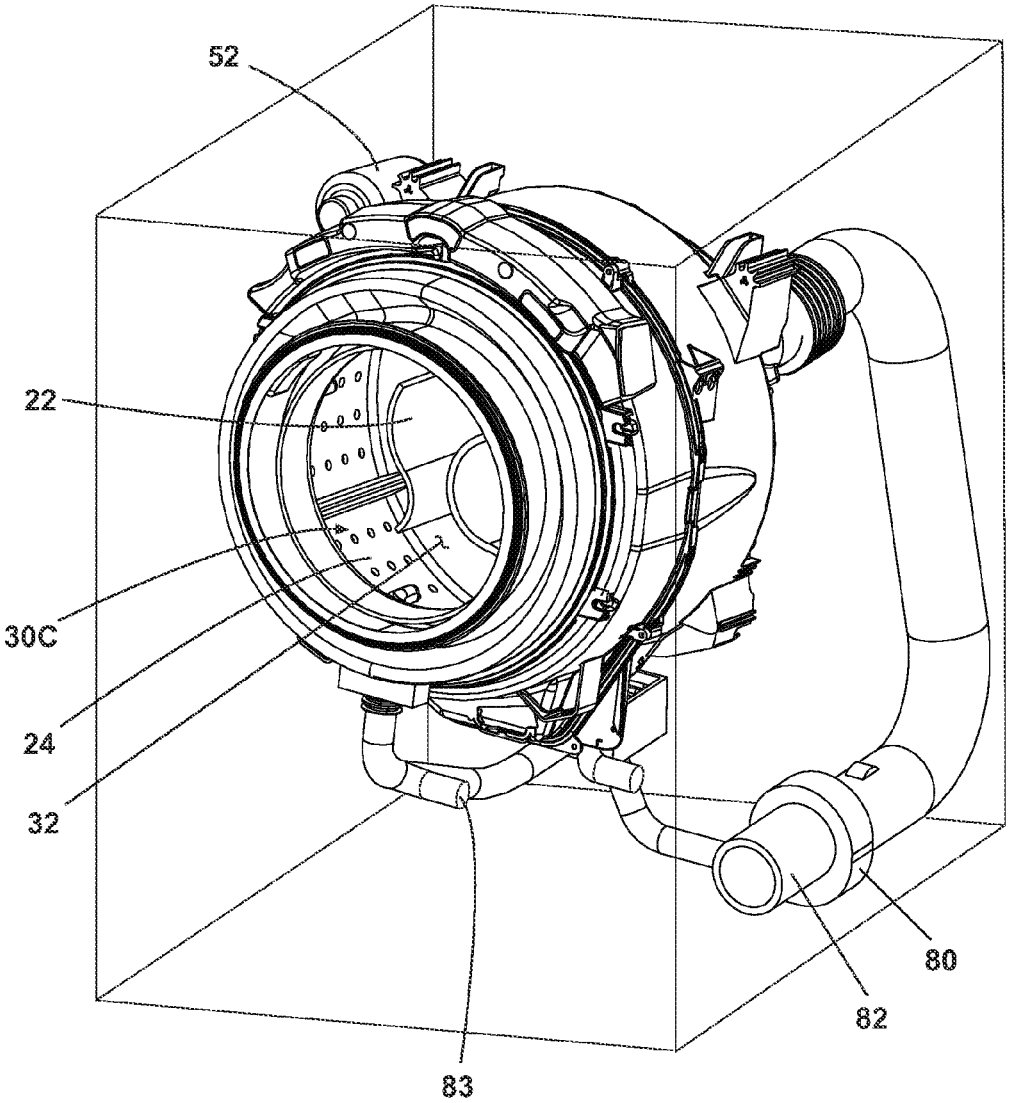
FIGS. 7 and 8 depict exemplary air flow components of the revitalization system.

Air Flow:

According to one embodiment of the invention, a high rate of air flow through the fabric load 22 in the drum 30C occurs during the dehydration and cleaning phases of the refreshing process, while little or no air flow through the fabric load 22 occurs during the rehydration. Air flow can be accomplished using a variety of means, including a fan, an air pump, an air compressor, an air source, an air tank, and the like. Referring to FIG. 7, a blower fan 80 connected to a regulated motor 82 is the illustrated source of air flow in the system. Because most conventional drum-based dryers contain a single motor that controls both drum rotation and fan speed, the blower fan 80 can be connected to the dedicated, independent motor 82. This preference is due to the fact that the motor 52 that controls the speed and rotational direction of the drum 30C does not always remain on during the times that the operation of the blower fan 80 is required, and the same holds true for the operation of the motor 82 for the blower fan 80 with respect to the operation of the drum 30C.

The illustrated blower fan 80 can operate at variable speeds, such as by variable speed operation of the motor 82, and can provide a source of high throughput air movement through the drum 30C. The variable speed control of the motor 82 for the blower fan 80 ensures that the blower fan 80 is capable of moving a constant air flow through the drum 30C despite the occurrence of air restrictions that can develop at an air outlet 83, which exhausts air from the drum 30C to the atmosphere. Furthermore, high throughput air movement through the drum 30C ensures that appropriate temperature reductions of the fabric load 22 are achieved and that the particulates, such as the soils and hair, are removed from the fabric load 22 and blown into the air outlet 83. The motor 82 for the blower fan 80 can also be disengaged to stop the blower fan 80 during the rehydration phase of the process.

Figure 8:
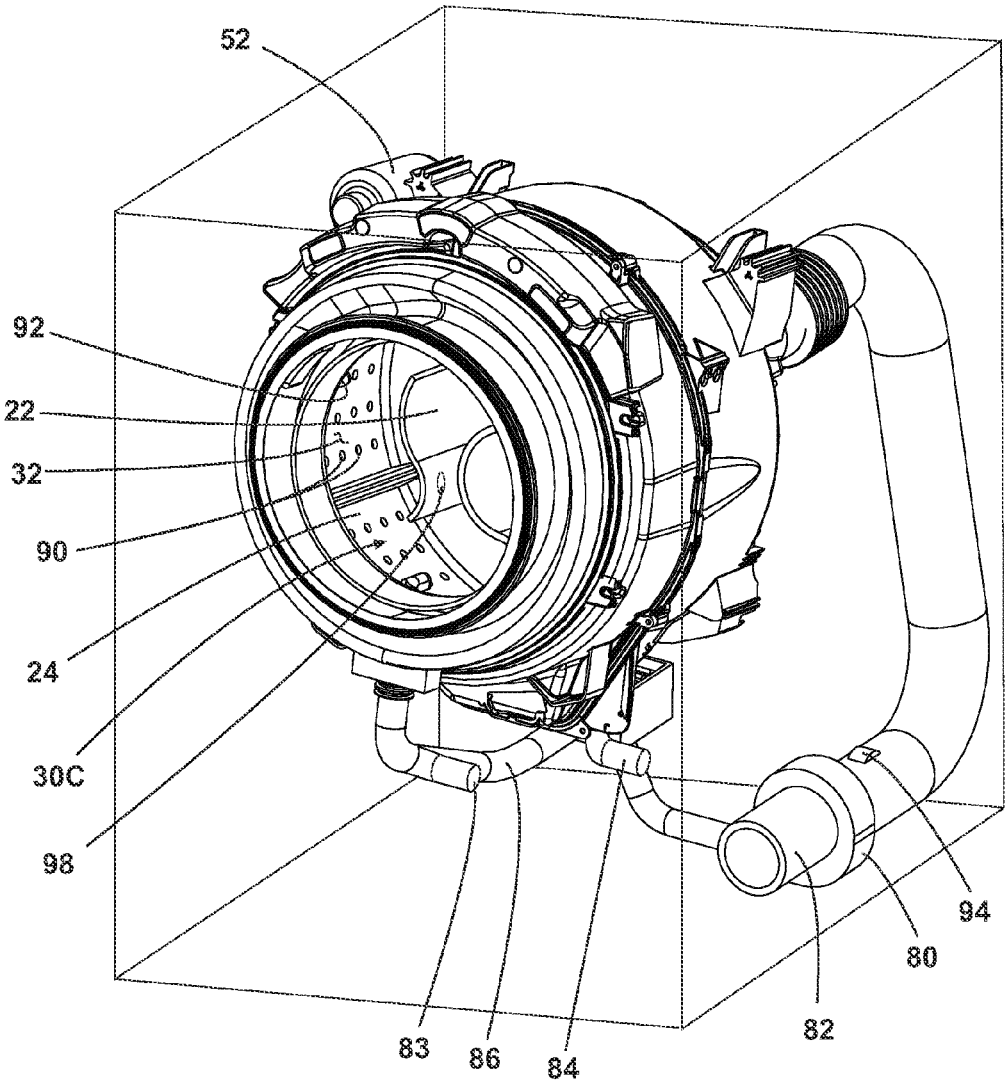
Figure 9A:
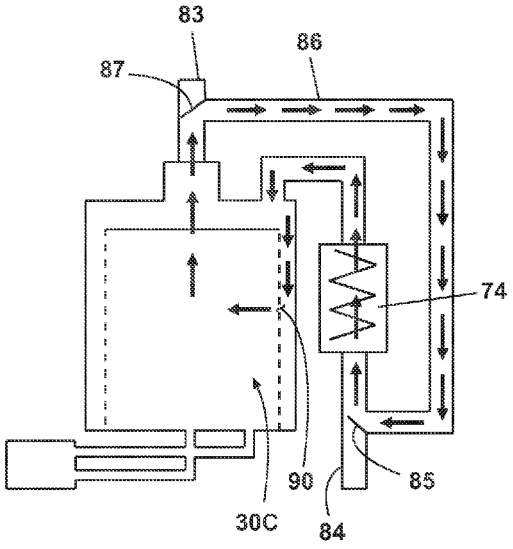
FIG. 9A depicts a schematic view of the air flow through the revitalization system, wherein air flow through the revitalization chamber comprises recirculated air.
Figure 9B:
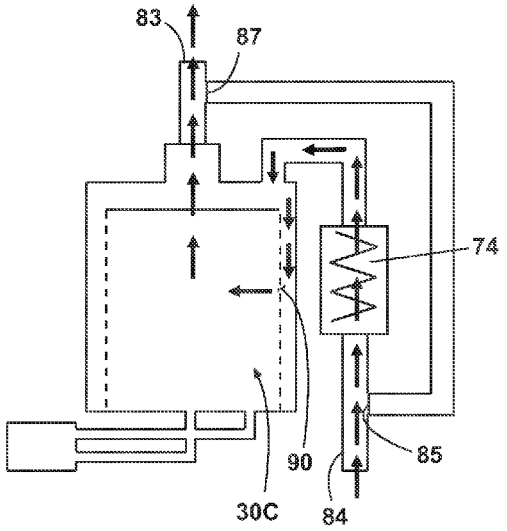
FIG. 9B depicts a schematic view similar to FIG. 9A, wherein the air flow through the revitalization chamber comprises fresh, non-recirculated air.

Referring to FIGS. 8 and 9A-9B, the air flow leaving the drum 30C can optionally be recirculated back to the drum 30C to promote maximal saturation of the intake air from an air inlet 84 to the drum 30C with moisture before release of the air to atmosphere via the air outlet 83. This can be accomplished in a variety of ways known in the art, including rerouting the outlet air back into the drum 30C through a recycle/recirculation loop 86 in fluid communication with the air inlet 84. Optionally, the recycle loop 86 can fluidly communication with openings 90 within the drum 30C for introducing the air into the drum 30C. The fluid saturation of the recirculating air can be ascertained from sensors, such as sensors 92, 94 located in the drum 30C or in the recirculation loop 86, respectively, or from a timed or event program derived from calculations. Optionally, the degree of fluid saturation within the fabric load 22 can be ascertained with sensors 98 affixed or focused onto the articles of the fabric load 22. Recirculation of the air flow thereby, provides a means to achieve decreased saturation of the fluid in the fabric load 22 during the dehydration phase of the revitalization process, or to achieve increased saturation of the fluid in the fabric load 22 during the rehydration phase of the revitalization process. Thus, during the rehydration phase, the fluid, which is carried by the air, leaves the drum 30C and returns to the drum 30C through the recycle loop 86 to achieve a desired saturation of the fluid in the fabric load 22.

Referring particularly to FIGS. 9A and 9B, the recirculating air passing through the recycle loop 86 can be passed through the lint filter 74, which is described in more detail below. Valves 85 and 87 in the recycle loop 86 can be provided to control air flow through the recycle loop 86. For example, the valve 85 can be actuated to prevent outside air from entering the recycle loop 86, as shown in FIG. 9A, so that only recirculating air in the recycle loop 86 enters the drum 30C, or to allow outside air to enter the recycle loop 86, as illustrated in FIG. 9B. The valve 87 can be actuated to direct air from the drum 30C to the atmosphere or to the recycle loop 86. The valves 85, 87 can have operating conditions other than those illustrated in FIGS. 9A and 9B. For example, the valve 85 can be positioned to allow the recirculating air from the recycle loop 86 as well as outside air to enter the drum 30C.

Figure 10:
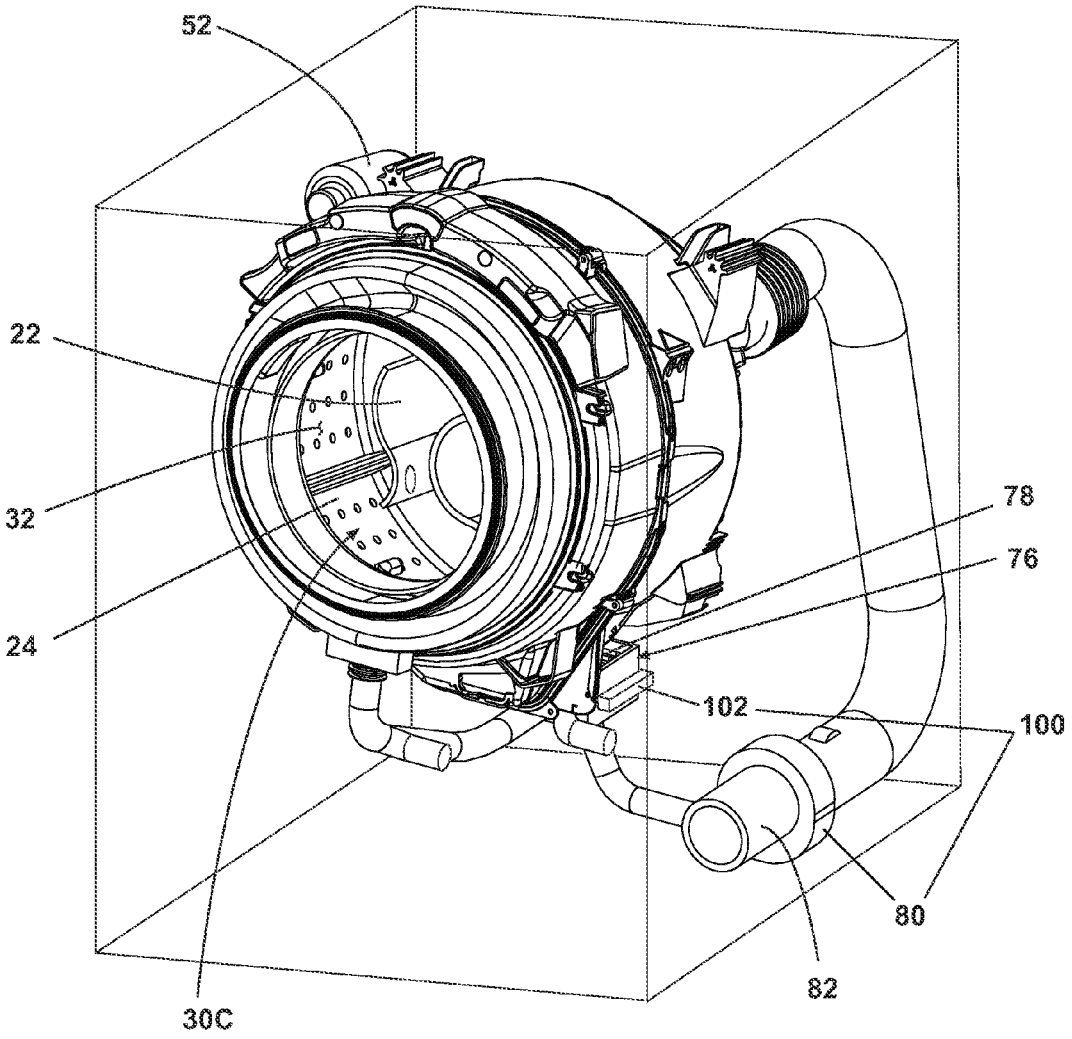
FIG. 10 depicts exemplary fluid removal system components of the revitalization system.

Fluid Removal System:

Referring to FIG. 10, the fabric revitalization system can include a dehydration or fluid removal system 100, which can be any suitable system for dehydrating or removing fluid from the fabric load 22. Exemplary embodiments for the fluid removal system include air condensers, desiccants, steam-drying, electrostatic-drying, microwave-drying, conduction, convection, radiation, and the like.

One embodiment of the fluid removal system 100 is an air convection system, such as that illustrated by the exemplary arrangement shown in FIG. 10 and described herein. The exemplary air convection system includes the heater 76 and the blower fan 80, which function to create a heated air flow to the fabric load 22 in the drum 30C. The heater 76 is disposed along the air flow system to heat the air flow generated by the blower fan 80. A heater control 102 controls the heater 76 to provide elevated temperature to the fabric load 22 by heating the air supplied to the drum 30C that holds the fabric load 22, while the speed-compensated air blower fan 80 provides the high throughput air flow to the drum 30C that holds the fabric load 22. The fluid removal system 100 therefore comprises the combination of the heater control 102 and the blower fan 80 functionalities that provides for dehydration of moisture contained in articles of the fabric load 22. As the heated air contacts the fabric load 22, moisture is removed from the fabric load 22 and carried out the air outlet 83.

The typical moisture content of the fabric load 22 prior to subjecting clothing articles to a refreshing process is about 10% (10 grams fluid per 100 grams fabric load). An exemplary moisture content of the fabric load 22 following the dehydration phase is a percentage within a range of about 0% to about 4%. For example, the moisture content of fabric load 22 following the dehydration phase can be about 1%, 2%, or 3%. According to one embodiment, the moisture content of the fabric load 22 following the dehydration phase is about 2%. Further, the moisture content of the fabric load 22 following the dehydration phase of a refreshing process, according to one embodiment, is at least 1% lower than the moisture content of an otherwise comparable fabric load that was not subjected to the process. The time required to efficiently dehydrate the fabric load 22 will vary as a function of several factors, such as the humidity of the air entering the air convection fluid removal system 100, air temperature, air pressure, and the air flow rate in the drum 30C containing the fabric load 22.

Figure 11:
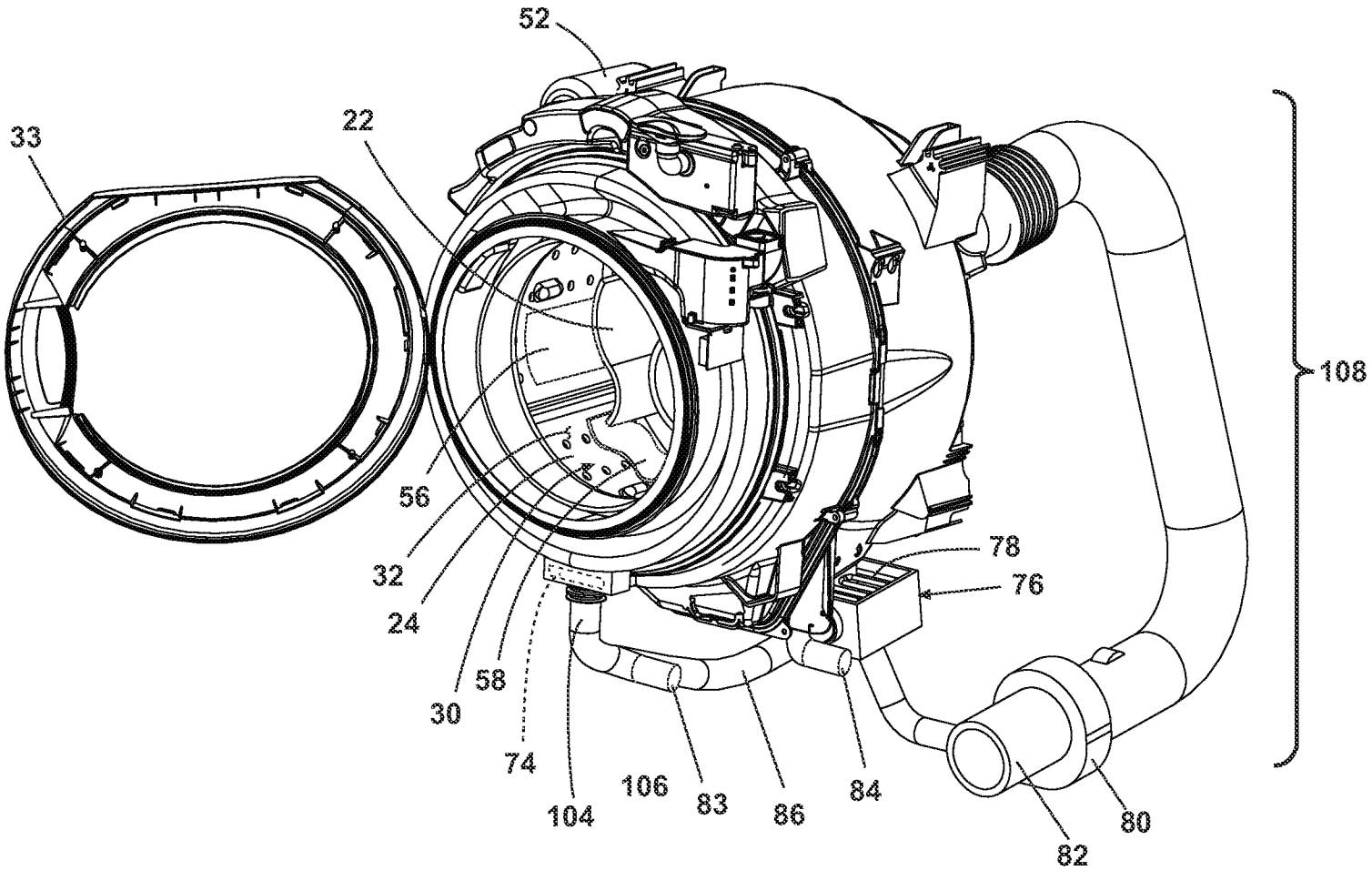
FIGS. 11 and 12 depict exemplary particulate removal and recovery system components of the revitalization system.

Particulate Removal and Recovery:

Referring to FIG. 11, particulates, such as soils, stains, malodors, and other materials (e.g., hair), can be removed from the fabric load 22 through a combination of the textured substrate surface 56 imparting mechanical energy to the fabric load 22, the high air flow rate passing through the fabric load 22 in the drum 30C, and the clothes in the fabric load 22 opening up during reversals of the drum 30C and/or varying the rotational speed of the drum 30C. These particulates, such as the soils and other materials, are carried out of the drum 30C by passing into the air outlet 83 and are trapped in the air outlet 83 by a suitable filter device, such as the lint filter 74.

According to one embodiment, as shown in FIG. 11, a conduit 104, which can be flexible, leading from the drum 30C to the air outlet 83 is in fluid communication with a lint filter housing 106 for the lint filter 74. Large particulates can be captured by the lint filter 74 to avoid the build-up of particulates on the components, such as the blower fan 80, the heater 76, etc., in a drying loop 108, which is a loop through which air flows and is heated prior to entering the drum 30C. The lint filter housing 106 can also include a filter lock that is adapted to lock down and seal the edges of the lint filter 74 when the revitalization process is activated to avoid a breach of the closed system. In addition, when the machine is deactivated, the consumer can clean the lint filter 74 as one normally would do in traditional drying machines. The lint filter 74 can also include a gasket at the interface of the lint filter 74 and the outer housing 23 of the enclosure 20.

While FIG. 11 depicts one of the lint filters 74, there can be a plurality of the lint filters 74 in the air flow path to collect as much particulates as possible, and the lint filters 74 can be located anywhere along any air path or recycle loop (e.g., 86) that can be otherwise incorporated into the system design. The lint filter housing 106 is in fluid communication with the air blower fan 80 to facilitate movement of lint particulates from the drum 30C, such as from the articles of the fabric load 22 or from the textured substrate surface 56, to the lint filter 74 as the air blower fan 80 operates.

Figure 12:
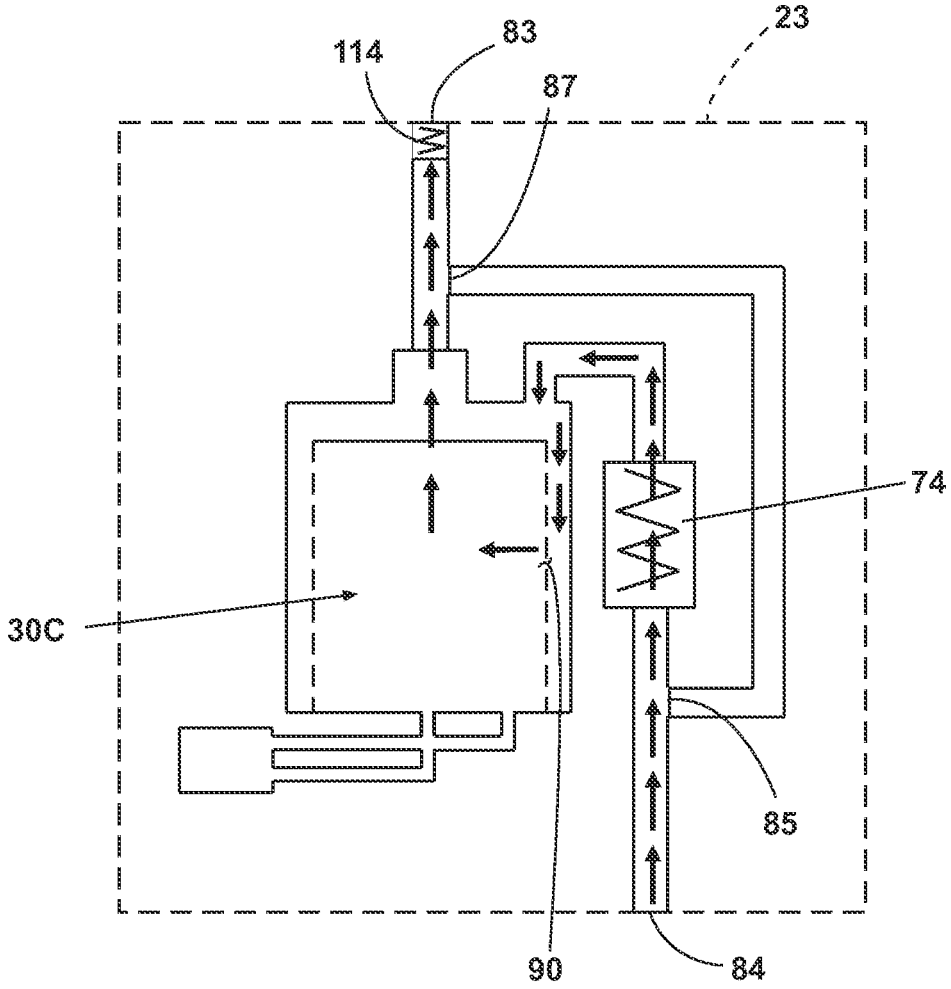

Smaller particulate matter may pass through the lint filters 74 described supra. To prevent release of the smaller particulate matter to the atmosphere external to the fabric revitalization system, an additional smaller particulate filter as a final outlet filter 114 can be installed in the enclosure 20, such as at the outer housing 23, as illustrated in FIG. 12. For example, use of a high efficiency particulate air (HEPA) filter or an ultra low penetration air (ULPA) filter as the final outlet filter 114 would result in recovery of the smaller particulate matter.

Other suitable filters that can be used for particulate removal and recovery include, but are not limited to a locked down sealed edge filter; a filter for a vapor, a fog, and/or a colloidal suspension; electrostatic filtering; filters impregnated with catalysts for producing species/radicals for cleaning; filters impregnated with reactants to chemically treat substances present in air; neutralizing filters to remove a previous treatment; and an air permeable matrix having a plurality of pores with a greatest pore dimension in a range from about 0.10 micron to about 1500 microns.

The individual lint and smaller particulate filters 74, 114 can be accessible to the consumer for cleaning and/or replacement as warranted following a revitalization process.

Figure 13:
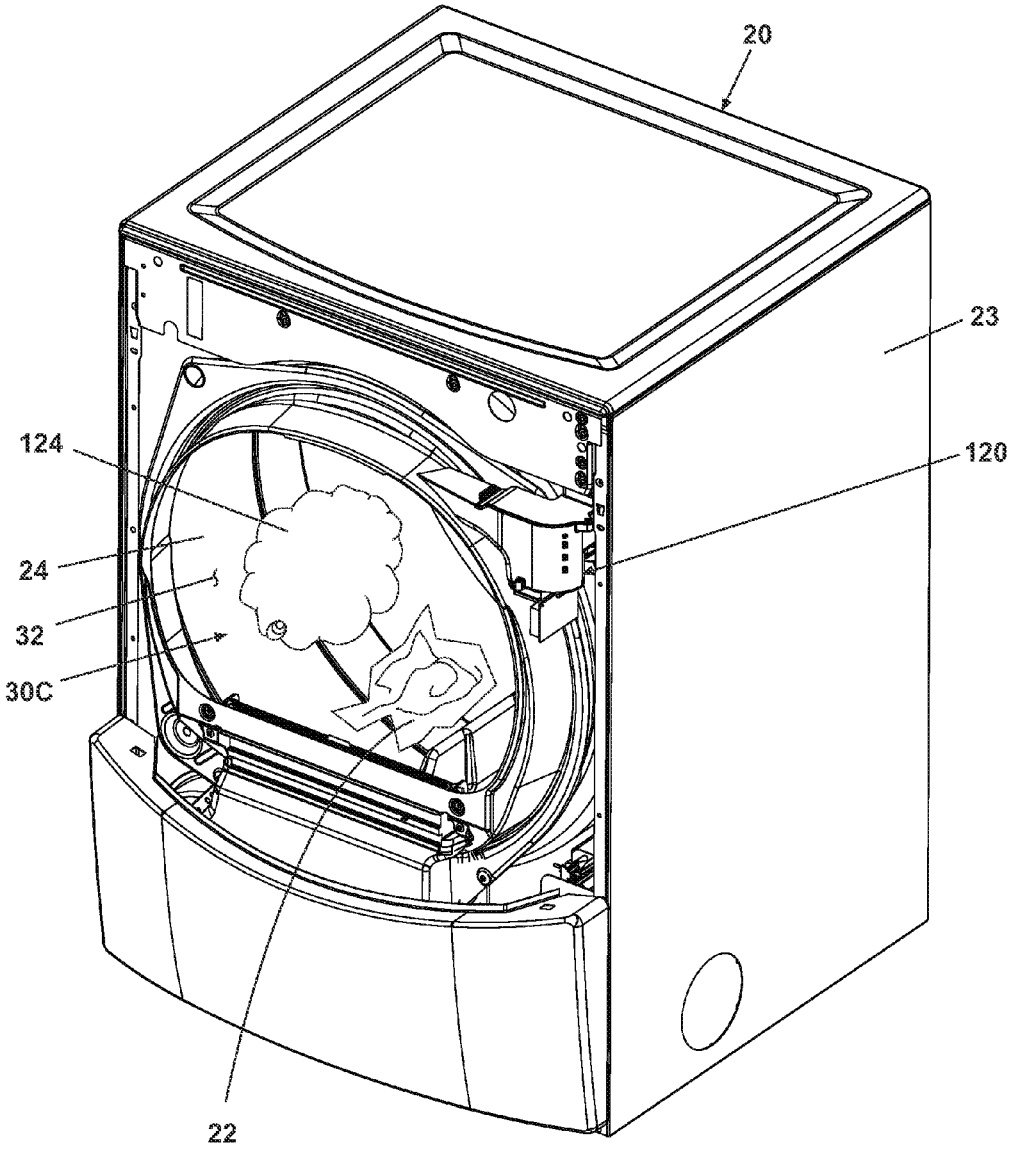
FIG. 13 depicts exemplary fluid delivery system components of the revitalization system.
Figure 14:
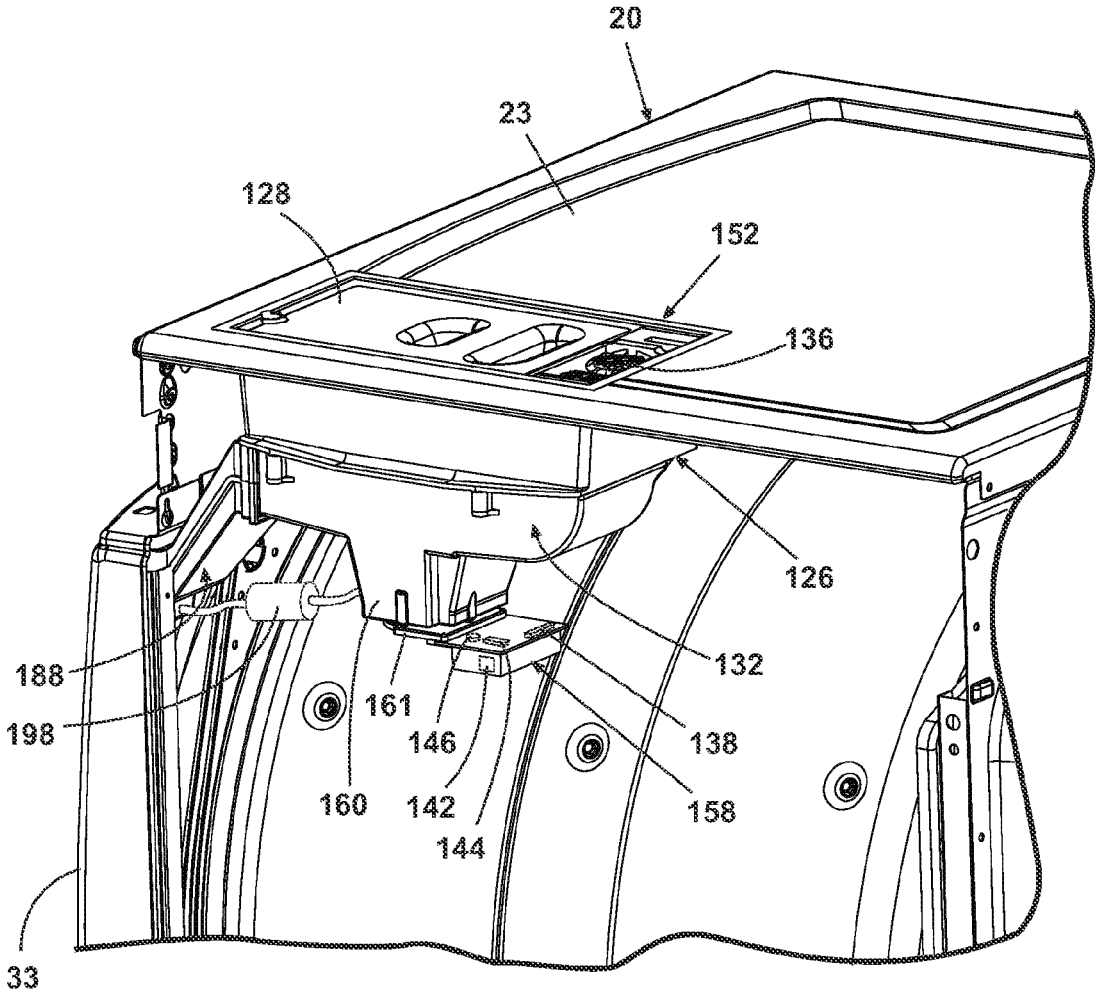
FIG. 14 depicts an exemplary nebulizer circuit and assembly for one embodiment of the fluid delivery system of the revitalization system.
Figure 15:
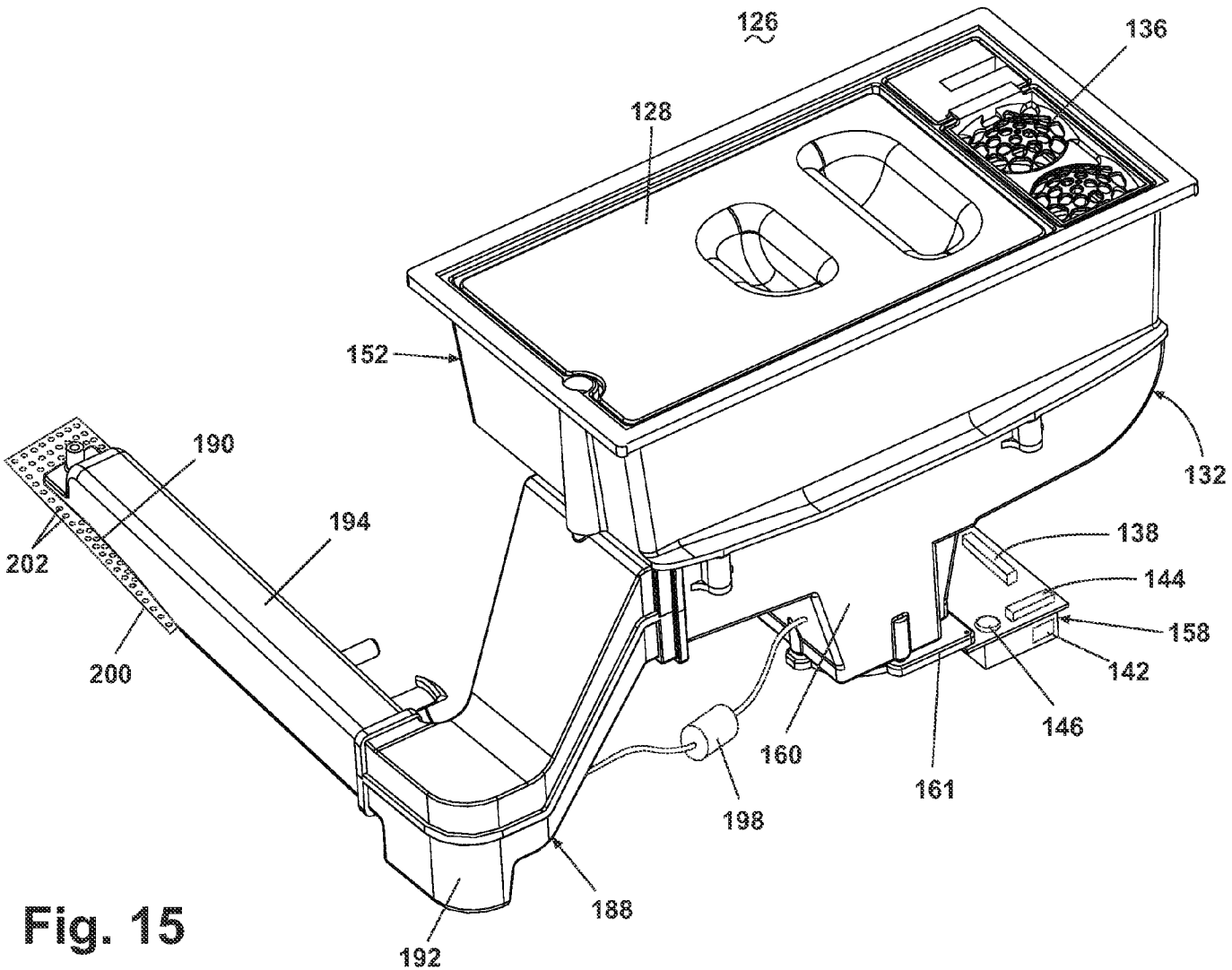
FIG. 15 depicts a perspective view the exemplary nebulizer assembly of FIG. 14.

Delivery System:

Referring to FIG. 13, the system includes a means 120 for delivering fluid (e.g., free fluid, available fluid, bound fluid, non-aqueous fluid) from a fluid storage system into the chamber 26/drum 30C for rehydrating the fabric load 22 typically after the dehydration and aeration are completed. Each of the fluid types and varieties can be dispensed at different levels. For example, the non-aqueous fluid level can be higher than the percentages previously described. The fluid form can include any one or a combination of the following: a liquid (e.g., organized liquid, pure liquid dispensed in nanoparticulates or in encapsulated microparticles, and the like); a mist (e.g., droplets produced from a nebulizer, a sonifier, and the like); a fog; a vapor; a gas; a foam (either a wet or dry foam); a steam; a solid (e.g., powders, blocks, pouches, etc.); a semi-solid (e.g., paste, gel, viscoelastic material, etc.); capillary channels; microparticulates (e.g., nanoparticles, encapsulated microparticles, and the like); a microemulsion; an electrostatic dispersant (e.g., ionizations); multi-phase chemistries; or the like. A delivery medium comprising a fluid (e.g., a vapor, a mist, a fog, a foam, a steam, or a liquid) can use aqueous fluids, semi-aqueous fluids, non-aqueous fluids, or a mixture of these fluids. These fluids can contain a washing additive. The washing additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control and removal agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, wrinkle release agents, soil release polymers, soil repellency agents, sunscreen agents, anti-fade agents, and mixtures thereof.

The fluid can be activated by any suitable means, such as chemistry; changes in temperature (e.g., applying heat or a cooling medium), light (e.g., photo-oxidation, photo-activation), pressure, or humidity; or by a mechanical means.

Where the delivery medium comprises a fluid, such medium can be delivered using a variety of chemical and mechanical processes, including temperature, pressure, pH, acoustics, friction, desolvation, dispersion, time-release, chemical activation/deactivation, flocculation, sublimation, mechanical action, and the like.

In general, the delivery means is a fluid management system that can comprise a fluid storage system fluidly coupled to a fluid conditioning system by a fluid transport system. The fluid transport system transports fluid stored in the fluid storage system to the fluid conditioning system, where the fluid is conditioned. For example, the fluid can be conditioned by changing the physical or chemical state or a physical or chemical property of the fluid. The fluid can be conditioned in any of several ways, such as by using a thermal energy generation device, a mechanical energy generation device, an electrochemical energy generation device, an electromagnetic energy generation device, and a chemical energy generation device. After the fluid has been conditioned, a fluid delivery system delivers the conditioned fluid to the drum 30C.

The delivery means 120 can comprise, for example, an injector, a sprayer, a mister, a foamer, a steamer, a heater, a vibrator, an agitator, an atomizer, a vapor insertion system, a fluid insertion system, a multi-phase chemistry insertion system, a nebulizer, and combinations thereof. The fluid delivery means 120 can also or alternatively comprise a device with capillary channels, vortex tubes, a venturi, and means for fluid displacement resulting from chemical reactions. For example, the delivery means 120 illustrated in FIG. 13 can comprise a nebulizer to produce a liquid mist 124 that is transmitted onto and/or into the fabric load 22 in the drum 30C.

FIGS. 14-18 illustrate an exemplary nebulizer circuit 122. As shown most clearly in FIG. 17, the nebulizer circuit 122 comprises a nebulizer assembly 126 that includes a fluid tank 128 that holds a fluid source, a fluid level control 130, a fluid reservoir 132, an air entry chamber 134, a fan 136, a power source 138, a mist generator in the form of a piezoelectric transducer 140, a logic control 142, a temperature control 144, and a fluid flow control 146. The structure and function of each component is described in detail below.

The fluid tank 128 holds fluid 148 that is destined to become the mist 124. As used herein, the mist 124 refers to several forms of the liquid, including a vapor and a spray. In this embodiment, the fluid tank 128 can be considered as part of the fluid storage system. For the purposes of rehydration of the fabric load 22, the fluid 148 can be sterile water. For other treatments, the fluid 148 can be an aqueous system, a non-aqueous system, or mix-aqueous/non-aqueous solvent system and can include but is not limited to one or more of the following alternative chemistries: hydrating materials, dehydrating materials, hydrophilic agents, hydrophobic agents, organic and inorganic solvents, dye fixer, oxidizing agents, such as hydrogen peroxide, electrolytic water, and silver, reducing agents, fabric enhancer, color enhancer, topical ointment/medicines, antibiotics, insect repellent, sun protective agents, wrinkle resistance-imparting chemistries, chemical activators/deactivators, perfumes, deodorizers, fragrances, pheromones, aroma therapy treatments, sanitizers, disinfectants, anti-static materials, electrostatic materials, ionized fluids, phase change materials, surfactants, waxes, oils, water-repellents, flame retardants, anti-microbial agents, anti-bacterial agents, anti-fungal agents, anti-parasitic agents, anti-viral agents, sheen enhancing agents, paint, ink, and dye coloring and decoloring agents, polishing and restorative agents, metal coatings, cellulose coatings, skin coatings, softening agents, anti-static agents, pH-dependent chemistries, acids, bases, detergents, multi-phase materials, foams, anti-corrosive agents, radiation-protective agents, enzymes, nucleic acids, dust and particulate repellents, pet hair or particulate attractants, plastic coatings, leather restorative coatings, sugar-based coatings, polymerizing agents, photoprotective coating, hydrocarbon repellents, hydrocarbon attractants, and the like, as well as combinations of any of the foregoing.

In one embodiment, the fluid tank 128 can be filled with the desired amount of fluid 148 and substantially hermetically sealed. Any sealing means known in the art that provides a substantially hermetically sealed container can be used. As an example, a lure-lock rubber casketed sealing means can be used to provide a substantially hermetically sealed enclosure for the fluid tank 128. The fluid tank 128 can be removably received within a fluid tank base 152 disposed above the fluid reservoir 132. When the fluid tank 128 is received within the fluid tank base 152, the fluid tank 128 fluidly communicates with the fluid reservoir 132 via the fluid level control 130.

The fluid level control 130 contains a controllable fluid tank outlet 154 that can be actuated upon placement of the fluid tank 128 into the fluid reservoir 132. The fluid 148 from the fluid tank 128 fills the fluid reservoir 132 until the desired level of the fluid 148 in the fluid reservoir 132 is achieved. In the exemplary embodiment, a sensor, such as a mechanical sensor, associated with the fluid tank outlet 154 can detect the desired level of the fluid 148 inside the fluid reservoir 132. The fluid tank outlet 154 can shut off or close when the fluid reservoir 132 is filled to the desired level with the fluid 148. The fluid tank 128 can optionally be vented to provide ambient pressure conditions as the fluid 148 from the fluid tank 128 flows to the fluid reservoir 132. The fluid reservoir 132 that holds the fluid 148 can also be considered as part of the fluid storage system.

Figure 16:
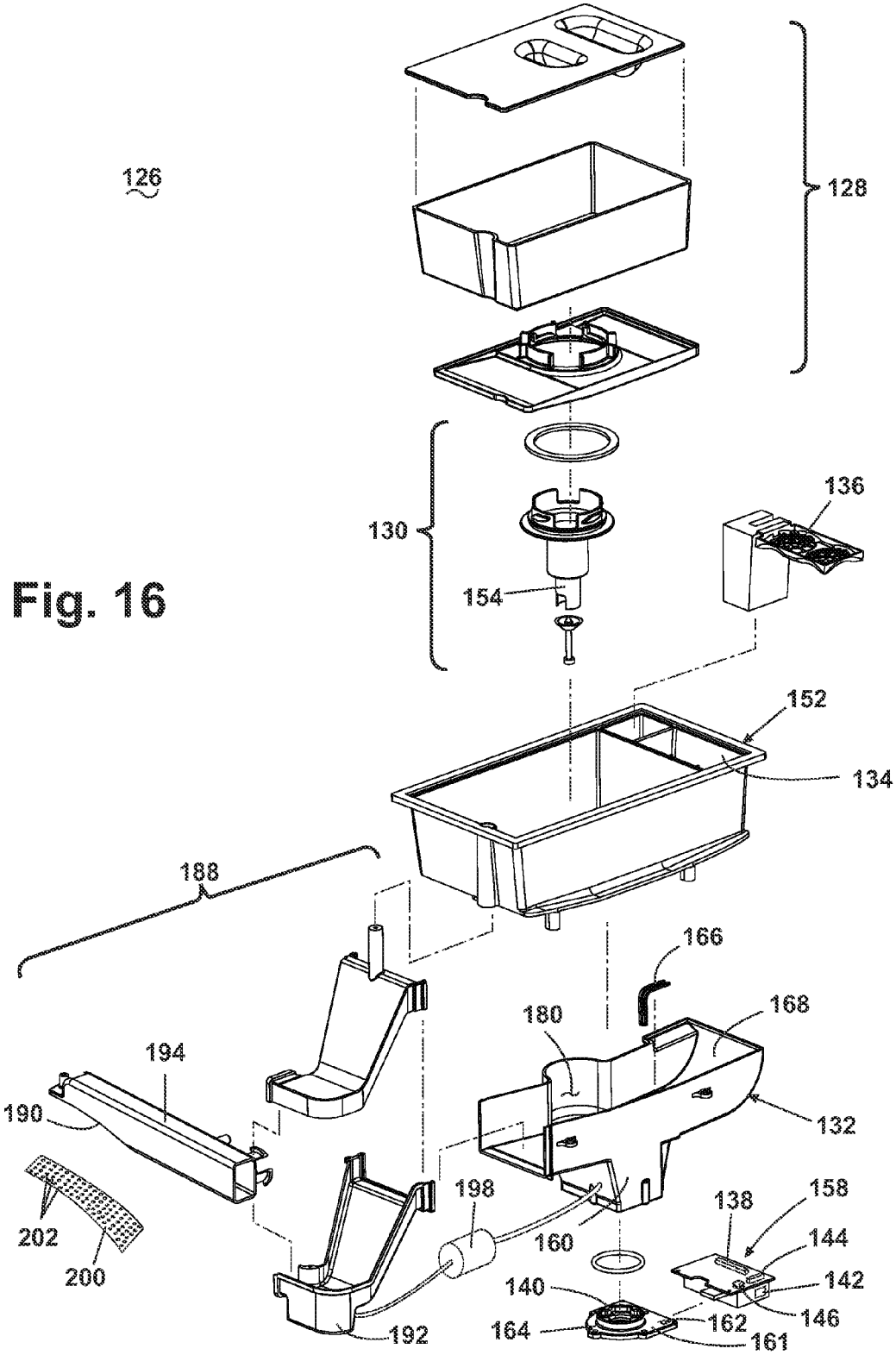
FIG. 16 depicts an exploded view of the exemplary nebulizer assembly of FIG. 14.
Figure 17:
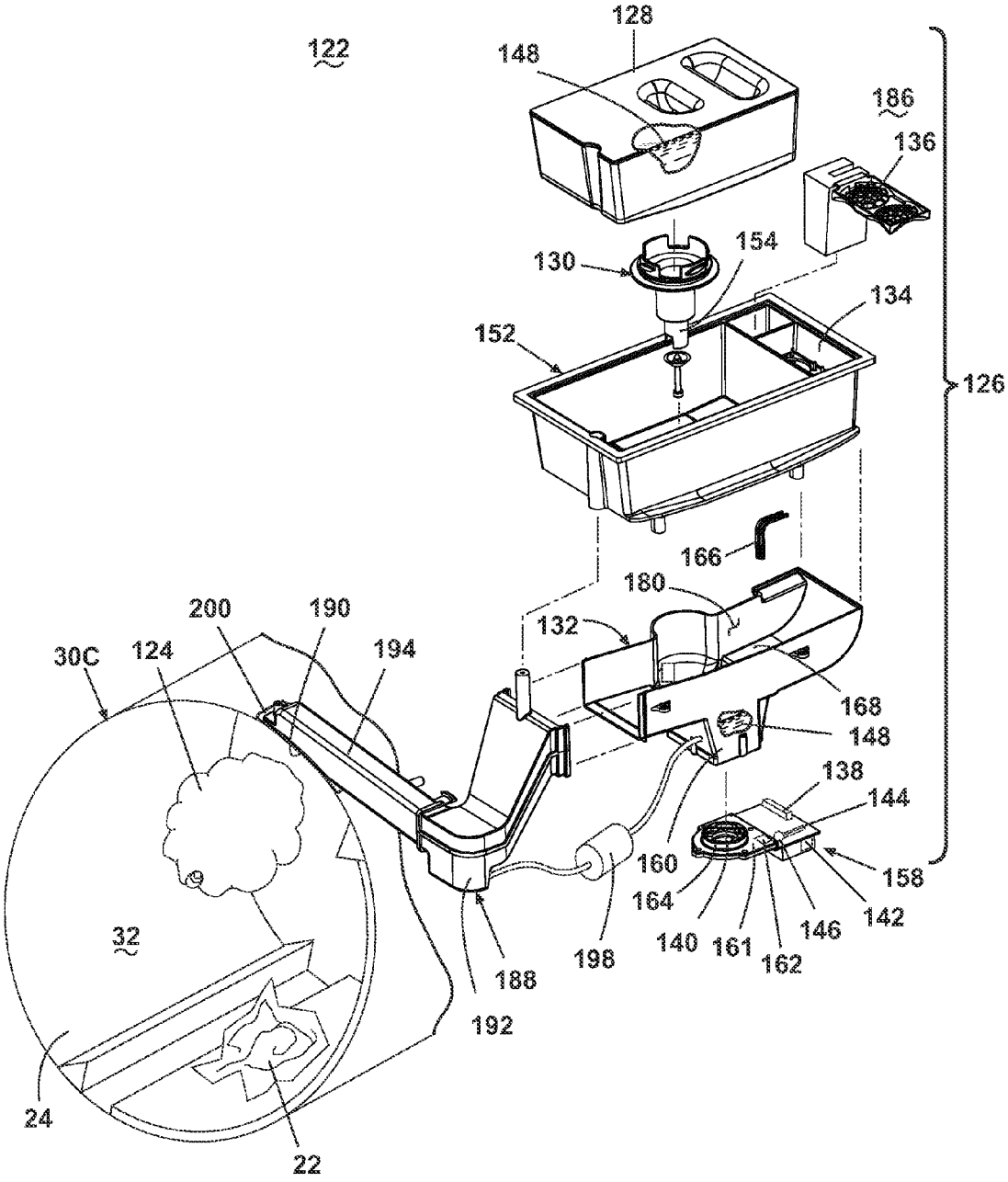
FIG. 17 depicts an exploded view of the exemplary nebulizer assembly of FIG. 14 and the revitalization chamber in the form of the drum.
Figure 18:
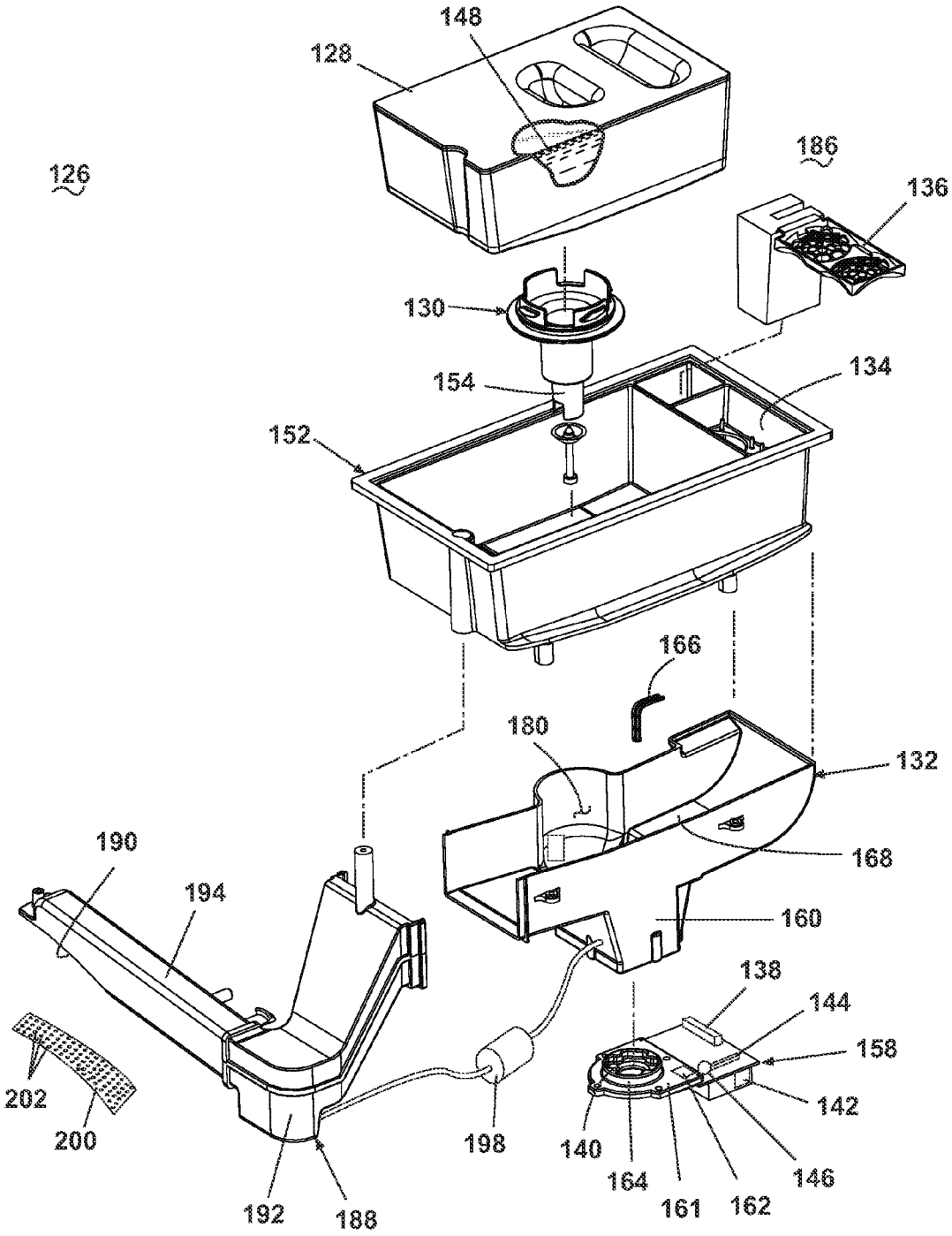
FIG. 18 depicts another exploded view of the exemplary nebulizer assembly of FIG. 14.

As shown in FIGS. 16-18, nebulizer controls 158 can be attached to a base 160 of the fluid reservoir 132. The base 160 of the fluid reservoir 132 forms a well that holds the fluid 148 supplied from the fluid tank 128 and includes a cut-out or opening to accommodate the piezoelectric transducer 140, which is supported by a metallic plate 161 operatively coupled to the nebulizer controls 158. Thus, the piezoelectric transducer 140 is in fluid communication with the fluid 148 in the fluid reservoir 132 through the cut-out in the base 160. The nebulizer controls 158 encompasses the necessary power source 138, the logic control 142, the temperature control 144, and the fluid flow control 146 to operate the piezoelectric transducer 140 and the associated fan(s) 136.

The piezoelectric transducer 140 is powered by a high output transistor circuit 162. Because the transistor circuit 162 produces substantial heat output during its normal operation, a heat sink 164 can be utilized to prevent overheating and destruction of the transistor circuit 162. In the illustrated embodiment, the heat sink 164 is in the form of a metallic ring that surrounds the piezoelectric transducer 140, and the transistor circuit 162 is thermally coupled to the heat sink 164 via the metallic plate 161. As a result, the transistor circuit 162 is thermally coupled to the fluid 148 in the fluid reservoir 132 to provide adequate heat dissipation. The heat generated by the transistor circuit 162 conducts through the metallic plate 161 and the heat sink 164 to the fluid 148 in the fluid reservoir 132.

In the event that the fluid reservoir 132 runs low on the fluid 148 or becomes depleted altogether of the fluid 148, a fluid level sensor 166 associated with the fluid reservoir 132 can be included. The fluid level sensor 166 can be coupled to the logic control 142 and the temperature control 144. The logic control 142 can utilize feedback from the fluid level sensor 166 to determine if a sufficient amount of the fluid 148 is present in the fluid reservoir 132 and communicate with the fluid flow control 130 to provide instructions to fill the fluid reservoir 132 to a desired level if there is not a sufficient amount of the fluid 148 present in the fluid reservoir 132. The temperature control 144 can utilize the feedback from the fluid level sensor 166 and cut off the power to the transistor circuit 162 if the amount of the fluid 148 in the fluid reservoir 132 is not sufficient.

The temperature control 144 can also optionally communicate with a temperature sensor associated with the transistor 162. Using feedback from the temperature sensor, the temperature control 144 can determine if the temperature of the transistor 162 is too high and cut off power to the transistor 162 to protect the transistor 162 from overheating. Furthermore, the temperature control 144 can optionally communicate with a temperature sensor configured to sense a temperature of the fluid 148 in the fluid reservoir 132 or fluid tank 128 and utilize the sensed temperature to control operation of an optional heater configured to heat the fluid 148. The heater can comprise any suitable heater, such as an immersion heater located in the fluid reservoir 132 or the fluid tank 128, a heat source embedded in the fluid reservoir 132 or in the fluid tank 128, or an in-line heater that heats the fluid 148 as it flows from the fluid tank 128 to the fluid reservoir 132.

With continued reference to FIGS. 16-18, an air flow chamber or channel 168 is situated in an interstitial space 180 formed between the fluid tank 128 and the fluid reservoir 132, particularly between the fluid tank base 152 and the fluid reservoir 132. At least one of the fans 136 communicates with the interstitial space 180, which is in fluid communication with an air space 186 outside the nebulizer assembly 126 via the air entry chamber 134. The air entry chamber 134 in the illustrated embodiment is formed in the fluid tank base 152, and the fan 136 is received within the air entry chamber 134.

Initiation of the nebulizer circuit 122 results in activation of the piezoelectric transducer 140 and production of the mist 124 at the surface of the fluid 148 in the fluid reservoir 132. The piezoelectric transducer 140 generates ultrasonic waves that energize through the fluid 148 and result in generation of the mist 124 at the surface of the fluid 148 when the ultrasound waves encounter the air at the surface of the fluid 148. Activation of the fan 136 draws air into the air flow channel 168 of the nebulizer assembly 126 and across surface of the fluid 148 in the fluid reservoir 132 that contains mist 124, and carries the mist 124 from the air flow channel 168 through a fluid transport system comprising a transition assembly 188 that connects the nebulizer assembly 126 to the drum 30C that contains the fabric load 22. The fluid flow control 146 controls the operation of the fan 136 to control the flow of the mist 124 to the drum 30C. In particular, the fluid flow control 146 sets the speed of the fan 136, which affects the speed at which the mist 124 is delivered to the drum 30C and the rate at which the mist 124 moistens the fabric load 22 in the drum 30C. The set speed of the fan 136 can depend on several factors, including, but not limited to, the rate of mist generation, the volume of mist generated, and the density of the fluid 148 used to create the mist 124.

The transition assembly 188 preferably comprises a bulkhead outlet 190, a sump 192, a connection 194 in the form of a channel between the bulkhead outlet 190 and the sump 192, wherein a slight elevation exists in the connection 194 from the sump 192 to the bulkhead outlet 190, and a sump pump 198. A screen 200 associated with the bulkhead outlet 190 provides enhanced dispersion of the mist 124 into the interior 32 of the drum 30C that contains the fabric load 22. Furthermore, the screen 200 can include openings 202 of sufficient size to prevent accumulated mist 124 from covering the openings 202 and blocking the bulkhead outlet 190 yet prevent lint and debris from the drum 30C from entering the transition assembly. According to one embodiment, the arrangement of the openings 202 in the screen 200 includes a geometrical configuration to promote the movement of collected mist 124/condensation to travel away from the bulkhead outlet 190 to the sump 192 or the fluid reservoir 132. In this manner, any trapped mist 124 or other condensation at the bulkhead outlet 190 will be channeled to the sump 192 or the fluid reservoir 132. Finally, the sump pump 198 facilitates moving the condensation by pumping the condensation in the sump 192 to the fluid reservoir 132.

The fluid storage system can have embodiments other than the reservoir. For example, the fluid storage system could be a containment-type fluid storage system similar to a hard-sided container or a soft sides pouch. The hard-sided container can resemble a cartridge, and the fluid to be dispensed can be contained within the cartridge. The chemistry alone can be contained in the cartridge and/or the soft sides pouch and can be coupled with an in-line fluid valve that can help to dilute the chemistry prior to contact with the fabric load.

Optionally, the nebulizer assembly 126 can comprise a sanitization means to inhibit or prevent the growth of bacteria, fungi, and other unsanitary micro-organisms or microbes. For example, the sanitization means can be in the form of a material embedded into or coated onto one or more surfaces of the nebulizer assembly 126. Exemplary surfaces of the nebulizer assembly 126 that are especially conducive to growth of micro-organisms include surfaces of the fluid reservoir 132, the air flow channel 168, the fluid tank 128, and the transition assembly 188. While the sanitization means can comprise any suitable material, examples of sanitization materials include materials comprising silver ions, titanium dioxide, and other oxides. Further exemplary means of sanitizing the nebulizer assembly are discussed infra in the section of this disclosure titled Sanitization Processes.

Figure 19:
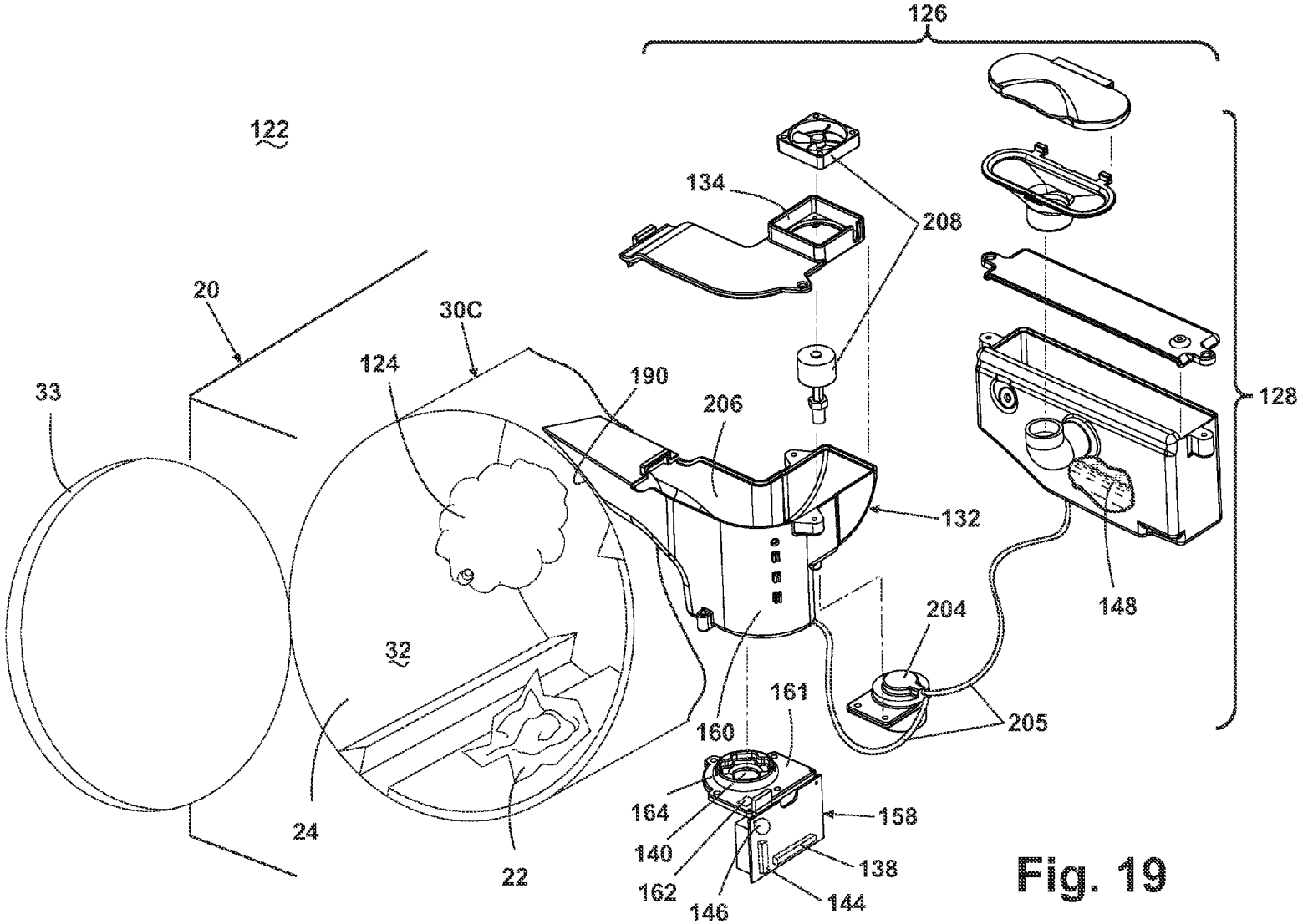
FIG. 19 depicts an exemplary nebulizer circuit and assembly for another embodiment of the fluid delivery system of the revitalization system.

Referring to FIG. 19, which illustrates the embodiment of the nebulizer assembly 126 shown as the fluid delivery means 120 in FIG. 13, a dedicated pump 204 can be used to pump the fluid 148 from the fluid tank 128 into the fluid reservoir 132. In this embodiment, the pump 204 can be considered to be the fluid level control. Additionally, the fluid reservoir 132 of this embodiment is modified to include an enclosed air channel 206 and an associated fan 208 for moving the mist 124 created by the piezoelectric transducer 140 to the drum 30C that contains the fabric load 22. The enclosed air channel 206 incorporates the bulkhead outlet 190 to the drum 30C, thereby eliminating the need for the transition assembly 188. However, the nebulizer assembly 126 of FIG. 19 can be modified to include the transition assembly 188. In the embodiment of FIG. 19, the nebulizer circuit 122 can reside inside the enclosure 20, wherein the fluid tank 128 is not hermetically sealed. The fluid tank 128 can be vented to provide ambient pressure conditions as the pump 204 moves the fluid 148 from the fluid tank 128 to the fluid reservoir 132.

The dedicated pump 204 permits physical and spatial decoupling of the fluid tank 128 from the fluid reservoir 132. As used herein, the physical and spatial decoupling/separation of the fluid tank 128 and the fluid reservoir 132 refers to the ability to physically locate the fluid tank 128 in a location, either within or exterior to the enclosure 20, that is different than the location of the fluid reservoir 132. Even though the fluid tank 128 and the fluid reservoir 132 can be located apart from one another, the fluid tank 128 and the fluid reservoir 132 are fluidly coupled to one another, such as through a conduit 205, so that the fluid 148 in the fluid tank 128 can be provided to the fluid reservoir 132, such as with the assistance of the pump 204. The physical separation of the fluid tank 128 and the fluid reservoir 132 offers advantages in the operation of the nebulizer assembly 126. Such advantages include ease of servicing the nebulizer assembly 126, the facile replenishment of the fluid 148 into the nebulizer assembly 126, and greater hygienic control of the components of the nebulizer assembly 126 and the associated fluid 148, as elaborated below. By uncoupling the fluid tank 128 from the remaining portion of the nebulizer assembly 126, the fluid tank 128 can be situated elsewhere in enclosure 20 to provide greater aesthetic and/or ergonomic appeal. Furthermore, the remaining components of the nebulizer assembly 126 can be isolated from external environment to promote greater protection from bacterial or fungal contamination. For example, the fluid reservoir 132 can be emptied using the dedicated pump 204 by redirecting the fluid 148 from the fluid reservoir 132 back to the fluid tank 148 following a refreshing process. In this case, the pump 204 can be a pump, such as a peristaltic pump, capable of reversing the direction of fluid flow. Optionally, the pump 204 can be used to flush the fluid reservoir 132 with a bacterial disinfectant to sanitize the fluid reservoir 132 between uses.

Figure 20:
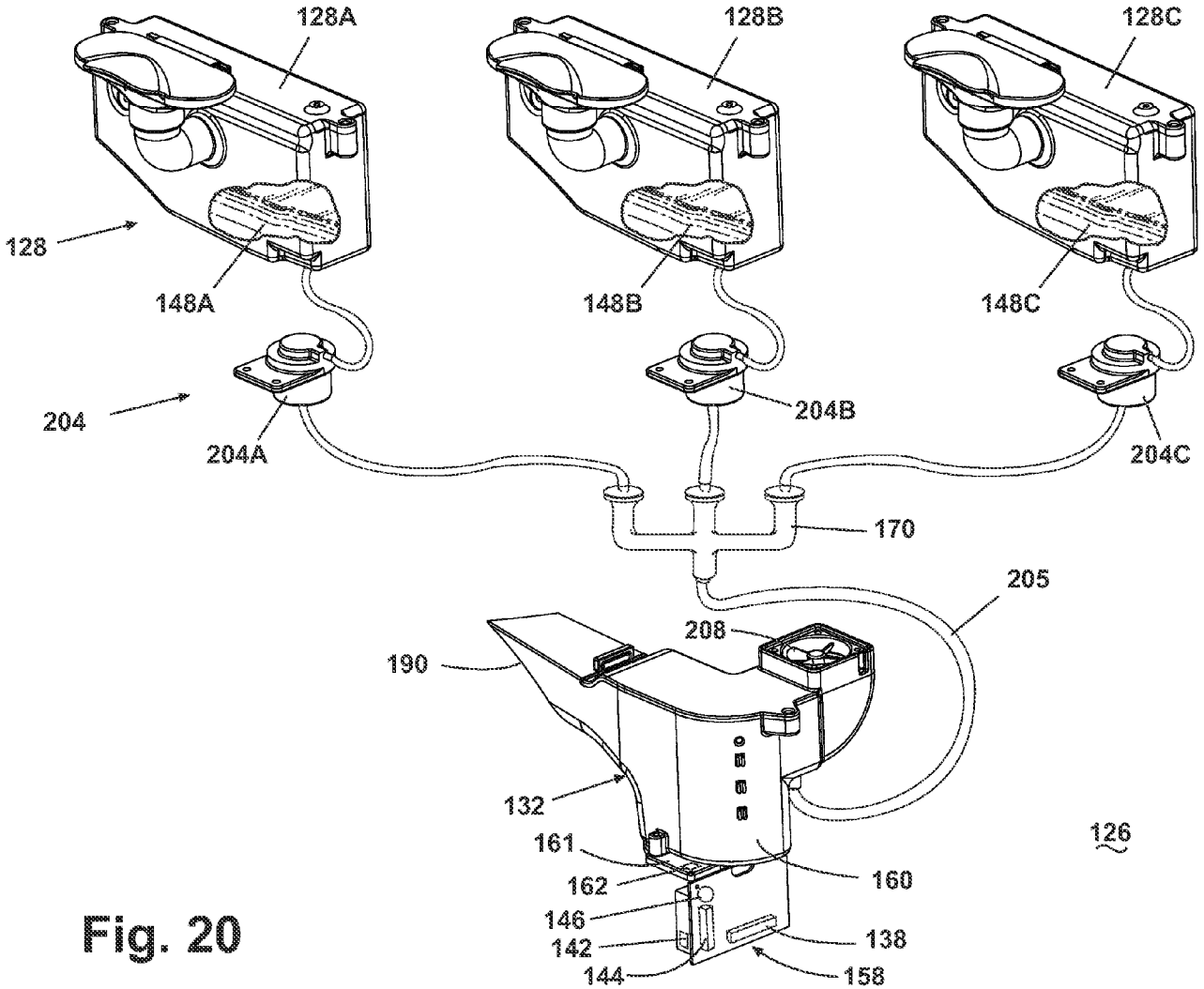
FIG. 20 depicts a schematic view of the exemplary nebulizer assembly of FIG. 19 configured to deliver a plurality of fluids to the revitalization chamber.

To accommodate the use of more than one fluid with the nebulizer assembly 126, the nebulizer assembly can comprise a manifold 170, as illustrated in the alternative embodiment of FIG. 20. The embodiment shown in FIG. 20 is similar to the embodiment of FIG. 19, except that the former comprises the manifold 170, a plurality of the fluid tanks 128 and associated dedicated pumps 204. The manifold 170 fluidly couples each of the fluid tanks 128 to the fluid reservoir 132, and each of the fluid tanks 128 has a corresponding dedicated pump 204 to pump the fluid 148 from the respective fluid tank 128 to the manifold 170.

The fluid tanks 128 can each store a different fluid that can be used during different stages of the revitalization process or to clean or rinse the fluid reservoir 132 between usage of differing fluids. For example, with the configuration shown in FIG. 20, two of the fluid tanks 128, such as a first fluid tank 128A and a second fluid tank 128B, can store differing fluids, such as first revitalization fluid 148A and a second revitalization fluid 148B, respectively, that are employed at different times during the revitalization process, while the other tank 128, such as a third fluid tank 128C, can store a rinse fluid 148C. During the revitalization process, a first pump 204A for the first fluid tank 128A can deliver the first revitalization fluid 148A to the manifold 170 for introduction into the fluid reservoir 132. After use of the first revitalization fluid, the first pump 204A can pump the first revitalization fluid 148A back to the first fluid tank 128. Next, the rinse fluid 148C from the third fluid tank 128C can be pumped by a third pump 204C to the fluid reservoir 132 through the manifold 170 to rinse the fluid reservoir 132. The used rinse fluid 148C can be drained from the fluid reservoir 132 or pumped back to the third fluid tank 128C by the third pump 204C. Thereafter, the second revitalization fluid 148B can be pumped by a second pump 204B to the fluid reservoir 132 through the manifold 170. After use of the second revitalization fluid 148B, any excess can be pumped back to the second fluid tank 128B by the second pump 204B.

Optionally, the fluids can be mixed in the fluid reservoir 132 or in the manifold 170 prior to entrance to the fluid reservoir 132. Further, rather than each of the fluid tanks 128 having a dedicated pump 204, it is within the scope of the invention for the fluid tanks 128 to share a single pump, which can be located between the manifold 170 and the fluid reservoir 132. It is also within the scope of the invention to employ a single fluid tank capable of storing more than one fluid rather than using multiple separate tanks Additionally, the manifold 170 can be omitted and replaced by separate inlets for each of the fluids into the fluid reservoir. In another embodiment, each fluid can have an associated nebulizer assembly 126 rather than the fluids sharing a single nebulizer assembly 126.

The use of multiple fluids with the nebulizer assembly 126 has been described with respect to the embodiment shown in FIG. 20; however, it is within the scope of the invention to modify the nebulizer assembly of FIGS. 14-18 or any other nebulizer assembly to accommodate the use of multiple fluids.

The fluid delivery system can further comprise an ionizer, which can be a stand alone device or can be used in conjunction with the nebulizer assembly 126. The ionizer purifies fluids, including liquids and gases, with ions as the fluid passes through the ionizer. The ions function to neutralize odors and kill or remove potentially harmful micro-organisms and microbes from the fluid. As a result, the ionizer refreshes and purifies the fluid, whether fluid in the form of the mist 124 from the nebulizer assembly 126 or other fluid, prior to entrance to the chamber 26.

To be clear, the exemplary delivery systems described hereinabove are exemplary systems for the chemistry currently contemplated by the inventors. It will be appreciated that an alternative chemistry can be selected for use in a revitalization system of the present invention, including a chemistry subsequently formulated to optimize the operation of the revitalization system. The chemistry can be deliverable in liquid, gaseous, steam, particulate, or other form. The chemistry form can be transient. For example, if the chemistry is available but is too high in viscosity for optimal use, it can be heated at the point of application to the fabric load 22 as to reduce viscosity. Similarly, if available in particle form, the particles can be applied entrained in air so that they will behave more like a fluid. Furthermore, chemistries can be applied sequentially, as required, to obtain optimal results.

Figure 21:
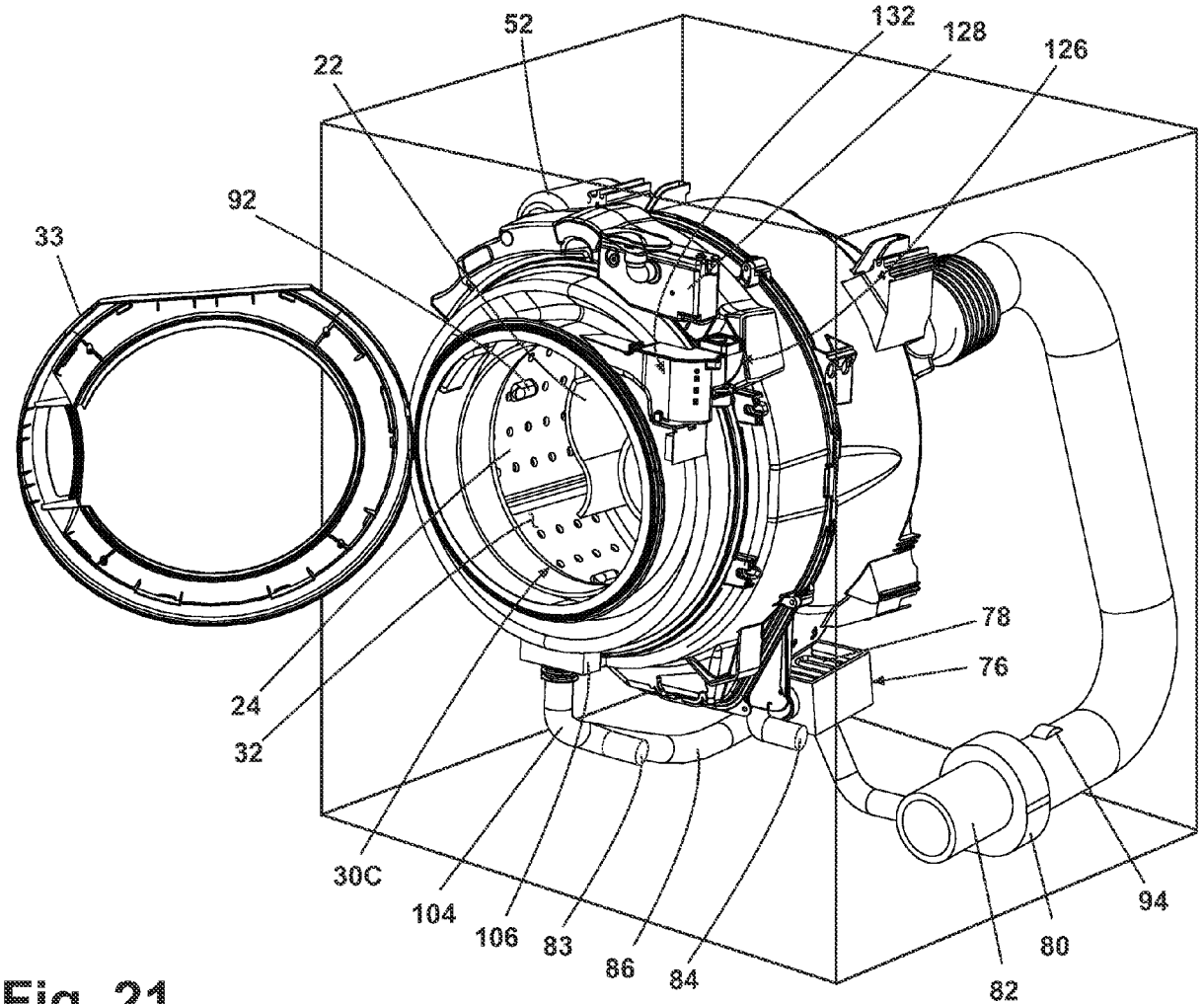
FIG. 21 depicts an exemplary embodiment of sensors of the revitalization system.

Sensors:

Referring to FIGS. 18 and 21, various sensors, such as the sensors 92, 94, can be located along any path, including at or near the air inlet 84, at or near the air outlet 83, in the recirculation or recycle path 86, inside the chamber 26/drum 30C, attached to or in association with the fabric load 22, and inside or near the nebulizer assembly 126, including the fluid tank 128, the fluid reservoir 132, the air flow channel 168, the sump 192, and at the bulkhead outlet screen 200.

For example, temperature and humidity sensors can be associated with the chamber 26 to monitor the temperature and moisture content of the fabric load 22. Other sensors can include a single pressure sensor to monitor the pressure at a given point. Other sensors can include leak sensors to sense for fluid leaks; flow rate sensors or meters to measure the quantity of fluid or quantity of air that has moved past the flow meter point or to monitor air restrictions; a weight sensor to estimate the size of the fabric load 22; sensors to indicate when the machine is deactivated so that the consumer can interact with it (e.g., ready to clean the lint and smaller particulate filters 74, 114, ready to refill the fluid tank 128; ready to load/unload the fabric load 22, etc.).

Other sensors that are considered within the spirit of the invention include any type of sensor that can detect a physical property of the environment in the chamber 26. Such sensors include, but are not limited to, temperature, pressure, humidity, force, torque, acceleration, inertia, mass, frequency, vapor, moisture, oxygen, CO, $CO_2$, electrical conduction, enzyme level, aqueous and/or non-aqueous solvent vapor level, turbidity, optical spectrum, ultrasonic, shaped electromagnetic field (SEF), float sensing, laser deflection, petrotape (for petroleum and fuels) chemtape (for chemicals and petrochemicals), electric field imaging, capacitance, resistance, pH, non-dispersive infrared, solid state, acoustic wave, oxidation-reduction potential, metal oxide semiconductor sensors, etc.

User Interface and Control:

Referring back to FIG. 1, the revitalization system can include a user interface and control 210 that provides information, such as status information and safety or emergency information, representative of the fabric revitalization system. While illustrated in the front right corner of the enclosure 20 in FIG. 1 for ease of illustration, it will be appreciated that the user interface and control 210 can be located elsewhere on the enclosure 10, such as elsewhere on the front of the enclosure 20, on top of the enclosure 20, or on the door, as is well known in the art. The user interface and control 210 preferably includes a control panel 212 to communicate the information representative of the revitalization system. For example, the information can be status information, such as time remaining, cycle step, and unbalanced load information. The information can also be different types of safety or emergency information, such as blocked conduits, valve failure, clogged filters, breach of the closed system, fluid leak, fluid level, pressure drops, temperature increase, chemical leakage, etc. After receiving the information from the control panel 212, the user can interact with the control panel 212 to send information, such as control signals, including turn-on signals, shut-off signals, and a command to delay or start of all or part of the process. The control panel 212 can also store any information in a memory storage unit 214 so that the information can be retrieved later. For example, the information can relate to the type of fabric in the fabric load 22. Clothing articles of a particular fabric type (e.g., silk) can have specific process parameters that differ from parameters used for clothing articles composed of a different fabric material (e.g., cotton or wool). Additionally, bar code readers, RFID readers, and outer short distance communication means can be utilized to communicate information about the garment. For example, the user interface and control 210 or other suitable component of the machine can incorporate the reader, while garment packaging, a container holding the garment, the garment itself, or some other object associated with the garment can include a corresponding data storage medium, such as a bar code and a RFID tag, containing the information regarding the garment. Upon receiving the information, the user interface and control 210 can utilize the information for various purposes, such as expanding or upgrading cycles. The information can be useful for creating fabric-specific revitalization profiles. Furthermore, other types of information beneficial during servicing and machine diagnostics can be stored in the user interface and control 210.

The user interface and control 210 can further comprise a control 213 that can be separate from or integrated with the memory storage unit 214. The control 213 communicates with the control panel 212 and the memory storage unit 214 and controls various components of the fabric revitalization system to execute the revitalization method.

Figure 22:
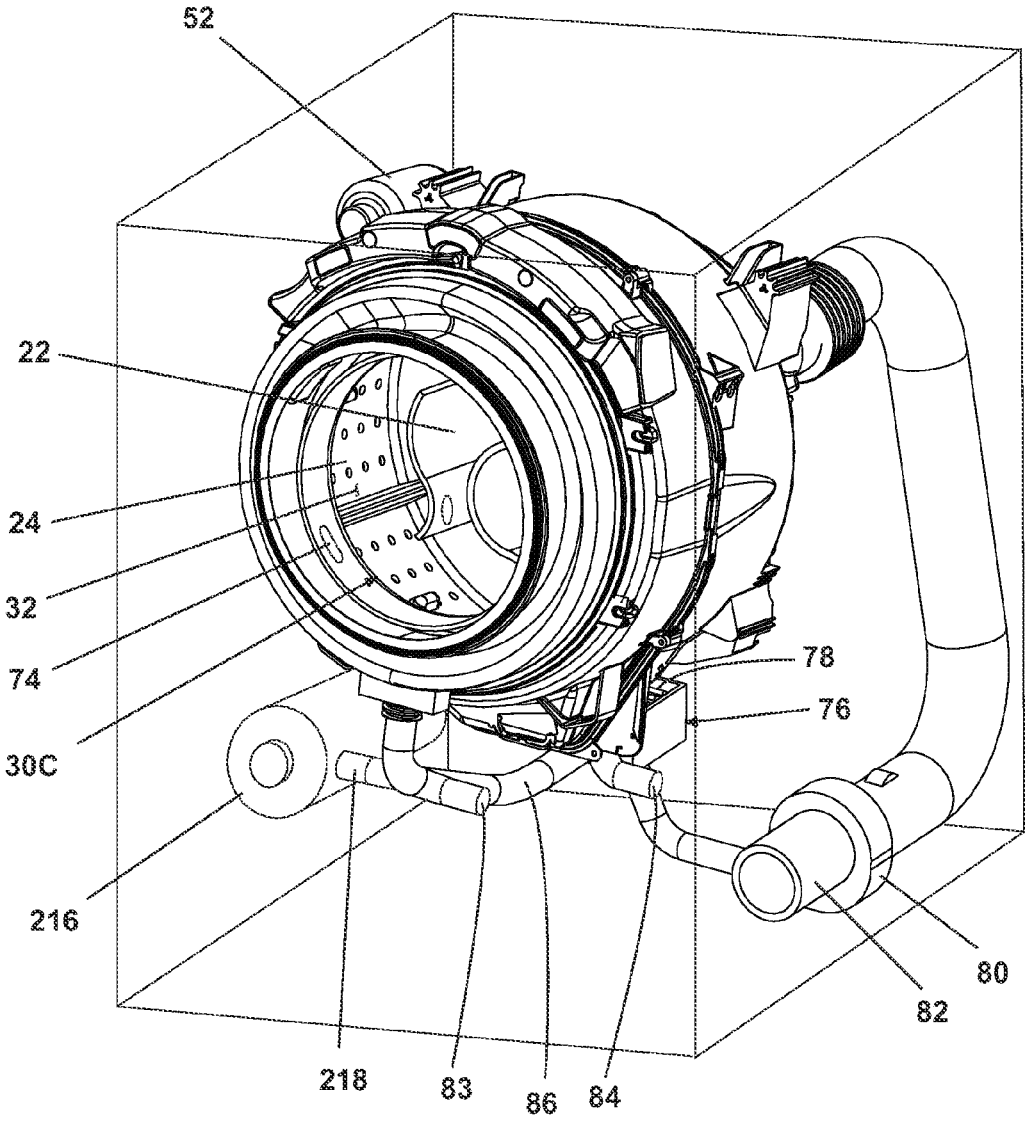
FIG. 22 depicts an exemplary vacuum system of the revitalization system.

Vacuum System:

Referring to FIG. 22, the system can contain an optional vacuum system comprising a vacuum source 216. Reduced pressure within the chamber 26/drum 30C due to the vacuum source 216 promotes removal of particulates, such as soils, from the articles in the fabric load 22. The vacuum source 216 provides adequate levels of air suction to substantially reduce the pressure within the chamber 26. The vacuum source 216 can be optionally configured as part of a separate air flow circuit 218 independent of the air inlet 84, the air outlet 83, and the recycle/recirculation path 86. In this case, the air flow circuit 218 can contain the lint filter 74 or other suitable filter to trap particulates, such as soils and other matter, removed from the chamber 26. In one embodiment, the vacuum source 216 can be configured as part of an air outlet system so that particulates, such as soils and other matter that are removed from the chamber 26 are caught in the lint filter 74 or other suitable filter after or upon leaving the chamber 26.

Moisture Level Control:

A moisture level of the fabric load 22 can be controlled by controlling the pressure and temperature of the chamber 26. For example, the vacuum source 216 can be used to control the pressure inside the chamber 26, and a refrigerant system can be used to control the temperature inside the chamber 26 and of the fabric load 22. The vacuum source 216 and the refrigerant system can be used separately or in combination with one another for a synergistic effect. Other means can be used to control the pressure and/or temperature. Examples of means for controlling the temperature include a heat pump, an air condenser, and the air flow system either alone or in combination with the heater 76.

The moisture level of the fabric can also be controlled by chemical or mechanical means. For example, the fabric load 22 can be exposed to or coated with a chemistry that limits the amount of moisture that the fabric can absorb or increases the amount of moisture that the fabric can absorb. Further, the drum 30C can be rotated to tumble the fabric load 22, which opens the fabric load 22 to expose more surfaces of the fabric load 22 to the moisture, which increases the moisture level, or to a heated or unheated air flow through the chamber 26, which decreases the moisture level.

Stain Removal Station:

Certain stains in fabrics of the fabric load 22 can require pre-treatment in order to facilitate their removal. The pre-treatment can be targeted, localized, or manual by nature. Referring to FIGS. 23, 24, and 25A-25D, the illustrated embodiments include an integrated stain treatment station 224 to facilitate stain and spot removal. The stain treatment station 224 can be fitted with different chemistries for administration to articles of the fabric load 22. The chemistries administered to the fabric articles depend upon the type of stain or spot impregnated on the fabric.

Figure 23:
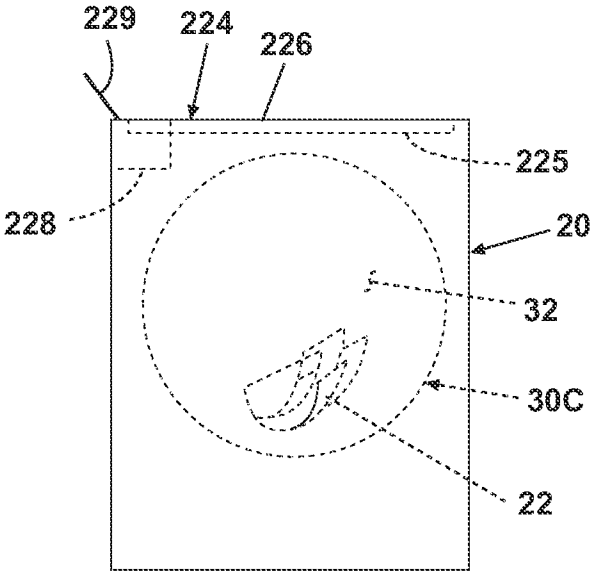
FIG. 23 depicts an exemplary stain removal station of the revitalization system.

In the example illustrated in FIG. 23, the stain treatment station 224 includes a work surface 226 fitted into a recess 225 in the top of the enclosure 20 of the fabric revitalizing system. A storage compartment 228 for storing one or more pre-treatment fluids is recessed into the top and is selectively enclosed by a door 229. The fabric to be treated can be placed on the work surface 226 and treated with the one or more pre-treatment fluids stored in the storage compartment 228. The one or more pre-treatment fluids can be dispensed from the storage compartment 228 in any suitable manner, such as by a wand, which is described in more detail below.

Figure 24:
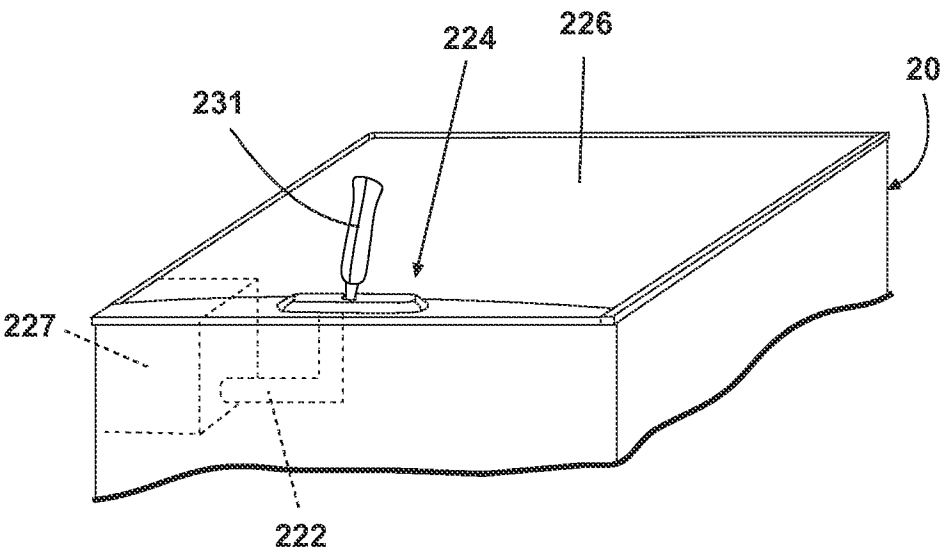
FIG. 24 depicts another exemplary stain removal station of the revitalization system.

In the example illustrated in FIG. 24, the stain treatment station 224 includes a work surface 226 integrated into the top of the enclosure 20 of the fabric revitalizing system. A fluid reservoir 227 configured to store one or more fluids is recessed into the top of the enclosure 20 and is designed to selectively supply the one or more fluids via a conduit 222 to a dispensing device 231, such as a wand, that can be movably mounted to the top of the enclosure 20. The fabric to be treated can be placed on the work surface 226 and treated with the one or more fluids stored in the fluid reservoir 227 through the dispensing device 231.

Figure 25A:
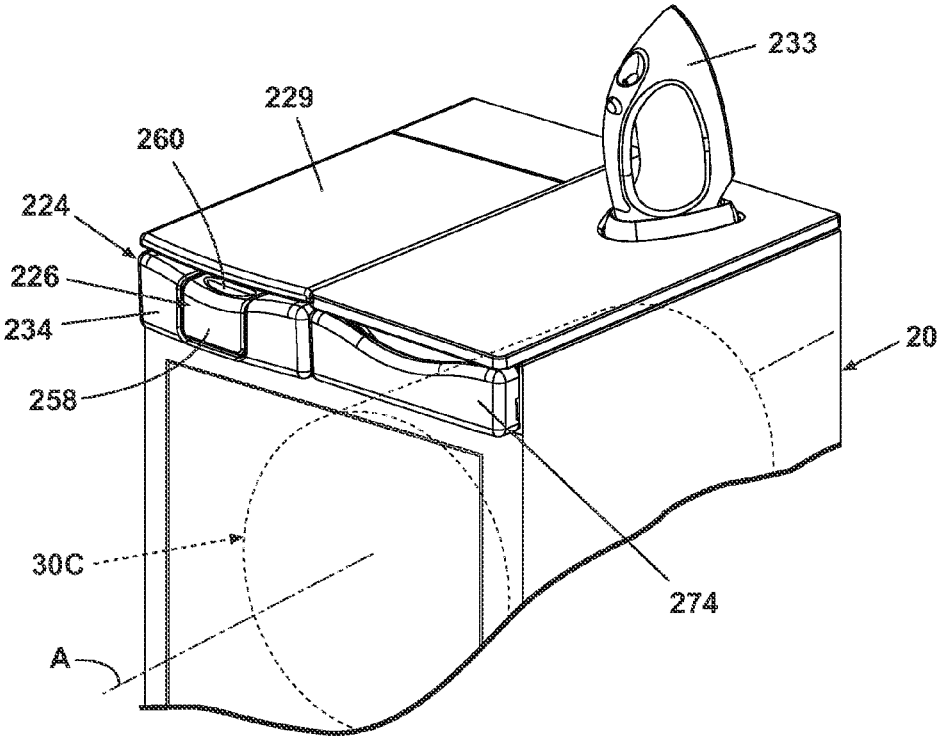
FIG. 25A depicts another exemplary stain removal station of the revitalization system built into the enclosure and having a work surface shown in a retracted position.

In the example illustrated in FIG. 25A, the stain treatment station 224 is located within the enclosure 20 along an upper edge region of the enclosure 20 and to one side of the drum 30C. The station treatment station 224 is oriented generally parallel to a longitudinal axis A of the drum 30C. However, it is within the scope of the invention for the stain treatment station 224 to be positioned in any suitable location in the enclosure and to have any orientation relative to the drum 30C.

The stain treatment station 224 comprises a front panel 234 generally flush with a front face of the enclosure 20 and a movable door 229 generally flush with a top face of the enclosure when the door 229 is in a closed position, as shown in FIG. 25A. The door 229 of the illustrated embodiment can pivot between the closed position of FIG. 25A to an opened position of FIG. 25B to enable access to a compartment 228 having a first pocket 240 that holds a removable fluid reservoir 227 configured to store a supply of treatment fluid or stain treatment agent and a second pocket 242 that holds a retractable treatment fluid dispenser 231 in the form of a wand 244 connected to a flexible hose 246. The wand 244 and the hose 246 can be extended from the second pocket 242 to treat a stain on a fabric item and retracted into the second pocket 242 for storage. The treatment fluid dispenser 231 is fluidly coupled to the fluid reservoir 227, such as through a first supply hose 248 and a second supply hose 250 located below the compartment 228, as illustrated in FIGS. 25C and 25D. The first supply hose 248 transports the treatment fluid from the fluid reservoir 227 to a pump 252, which pumps the treatment fluid through the second supply hose 250 to the treatment fluid dispenser 231. The wand 244 can be configured to dispense the treatment fluid in any suitable manner, such as by spraying, pouring, or misting the treatment fluid.

Figure 25C:
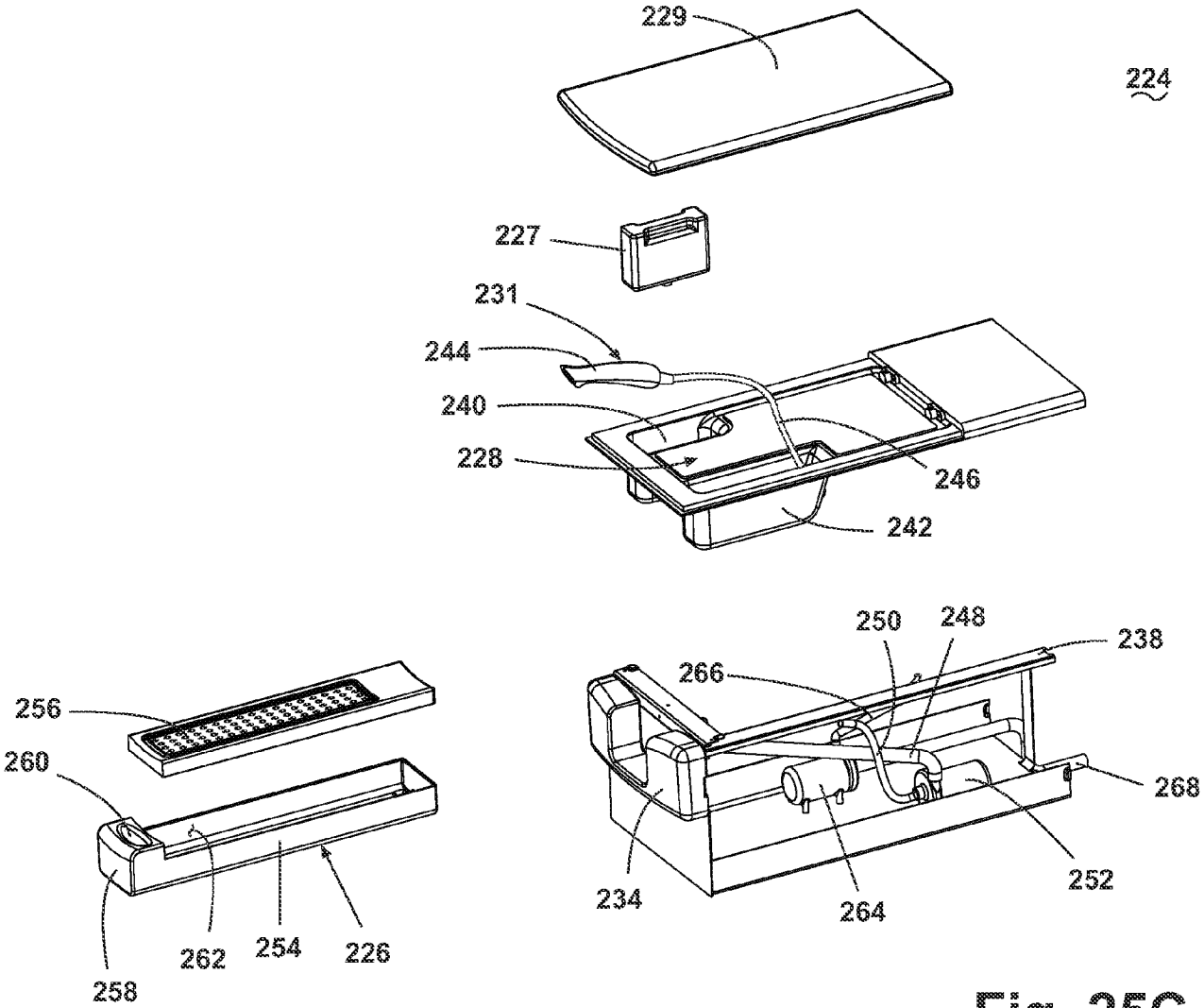
FIG. 25C depicts an exploded view of the exemplary stain removal station of FIG. 25A.
Figure 26A:
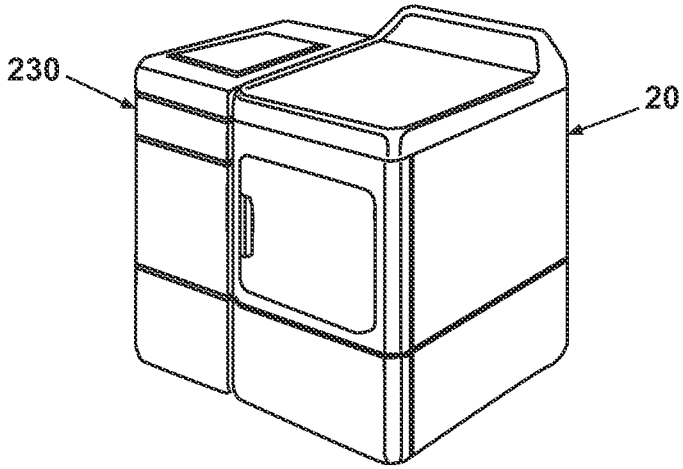
FIGS. 26A and 26B depict an exemplary embodiment of modular construction of the revitalization system.
Figure 26B:
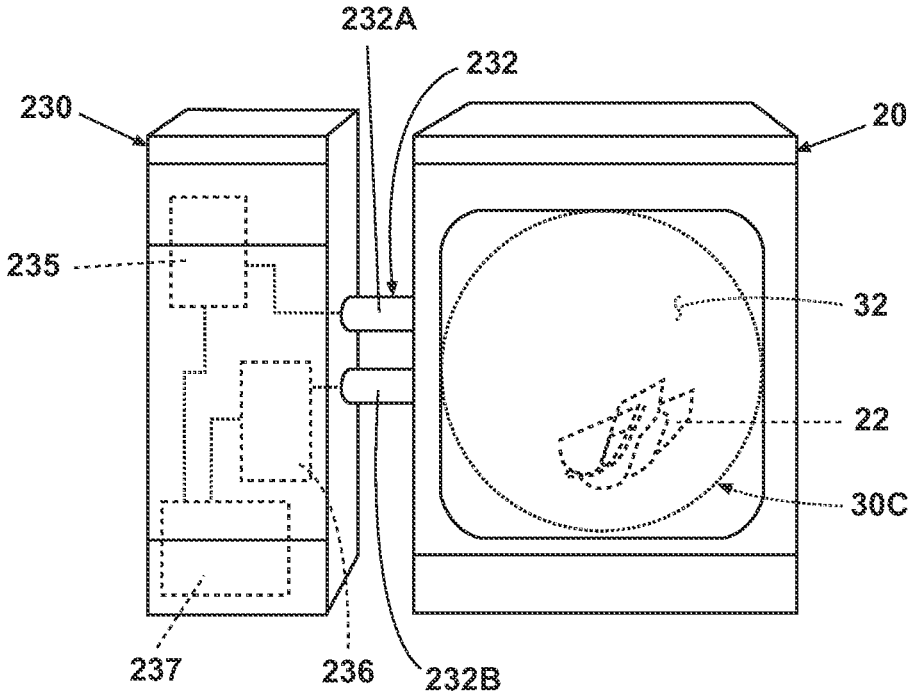

The stain treatment station 224 further comprises a work surface 226 horizontally slidable from a retracted position within the enclosure 20 below the compartment 228, as shown in FIG. 25A, to an extended position forwardly of the enclosure 20, as illustrated in FIG. 26B. Referring again to FIG. 25C, the work surface 226 is supported by and moves along a slide 238 located below the compartment 228. The work surface 226 can be in the form of shelf, drawer, or the like. The work surface 226 of the illustrated embodiment comprises an upwardly open, hollow main body 254 and a perforated surface 256, which can be a mesh material, disposed above the main body 254 to close the main body 254. A work surface front panel 258 with an integrally formed handle 260 is attached to or formed integrally with the main body 254. The handle 260 facilitates movement of the work surface 226 between the retracted and extended positions. When the work surface 226 is in the retracted position, the work surface front panel 258 can be generally flush with a front surface of the enclosure 20, as shown in FIG. 25A.

Referring again to FIG. 25C, a vacuum cavity 262 formed between the main body 254 and the perforated surface 256 is fluidly coupled to a vacuum source 264 located below the compartment 228 via a drain conduit 266. As shown in FIG. 25D, the stain treatment station 224 further includes a waste conduit 268 that couples the vacuum source 264 to an external drain.

To use the stain treatment station 224, the user pulls the work surface 226 forwardly from the enclosure 20 to expose the perforated surface 256. Optionally, the stain treatment station 224 can be configured to automatically activate the vacuum source 264 and/or the pump 252 when the work surface 226 is extended from the enclosure 20, such as when the work surface 226 is extended a predetermined distance from the enclosure 20. The stain treatment station 224 can include a control system to accomplish the automatic activation of the vacuum source 264 and/or the pump 252. Alternatively, the vacuum source 264 and/or the pump 252 can be activated manually, such as by the user actuating a switch. Next, the user places the fabric item on the perforated surface 256 and applies the treatment fluid to the fabric item on the perforated surface 256 through the treatment fluid dispenser 231. In particular, the pump 252 pumps the treatment fluid from the fluid reservoir 227, through the first supply hose 248, and through the second supply hose 250 to the flexible hose 246 and the wand 244. The vacuum generated by the vacuum source 264 pulls the treatment fluid applied to the fabric item through the perforated surface 256. The vacuum can also draw particulates in addition to fluids from the fabric item. The treatment fluid enters the vacuum cavity 262 and flows through the drain conduit 266 toward the vacuum source 264. The drained treatment fluid leaves the stain treatment station 224 via the waste conduit 268. When the treatment of the fabric item is complete, the user removes the fabric item from the perforated surface 256 and returns the work surface 226 to the retracted position in the enclosure 20. Optionally, the vacuum source 264 and/or the pump 252 can be disabled or deactivated, such as by the control system, upon returning the work surface 226 to the retracted position. Alternatively, the user can manually deactivate the vacuum source 264 and/or the pump 252, such as by actuating the aforementioned switch.

Optionally, the treatment fluid dispenser 231 can be fluidly connected to both the fluid reservoir 227 and a source of water in any suitable form, such as liquid, steam, or vapor. As an example, the stain treatment station 224 can be plumbed into a water source for the fabric revitalizing system in the enclosure 20. The treatment fluid dispenser 231 can be configured to dispense the treatment fluid, the water in any of the forms, and a mixture of the treatment fluid and the water. Furthermore, the stain treatment station 224 can be configured condition the treatment fluid and/or the water, such as by heating, cooling, mixing, and cavitating, prior to application to the fabric item.

The stain treatment station 224 can further include a heat source and a means for applying heat to the fabric item. The heat from the heat source can facilitate removal of stains from the fabric items. The stain treatment station 224 can also be configured to include a means for applying pressure to the fabric item to facilitate removal of stains from the fabric items.

It will be appreciated that the stain treatment station 224 could alternatively or additionally include multiple fluid dispensers (including dispensers that dispense hot or cold water) as well as other fabric treatment systems to supply, for example, heat, cooling medium, moving air, steam, vapor, friction, pressure, light, or other desired inputs to the fabric load 22 as part of a pre-treatment operation.

Figure 25B:
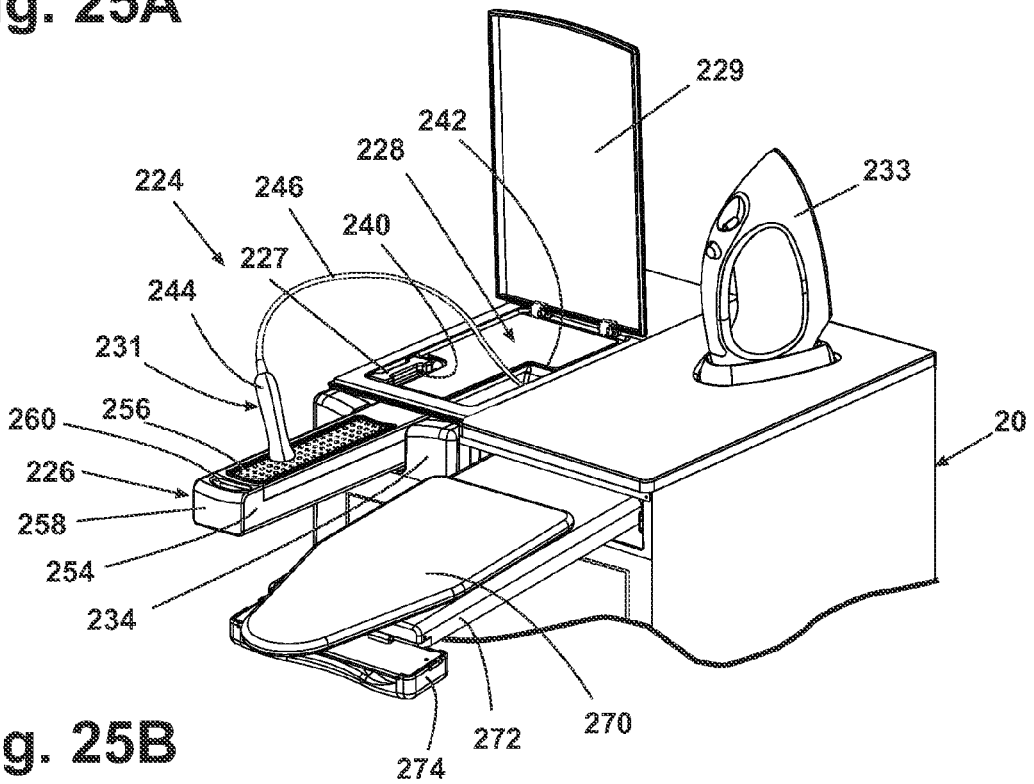
FIG. 25B depicts the exemplary stain removal station of FIG. 25A with the work surface shown in an extended position.
Figure 25D:
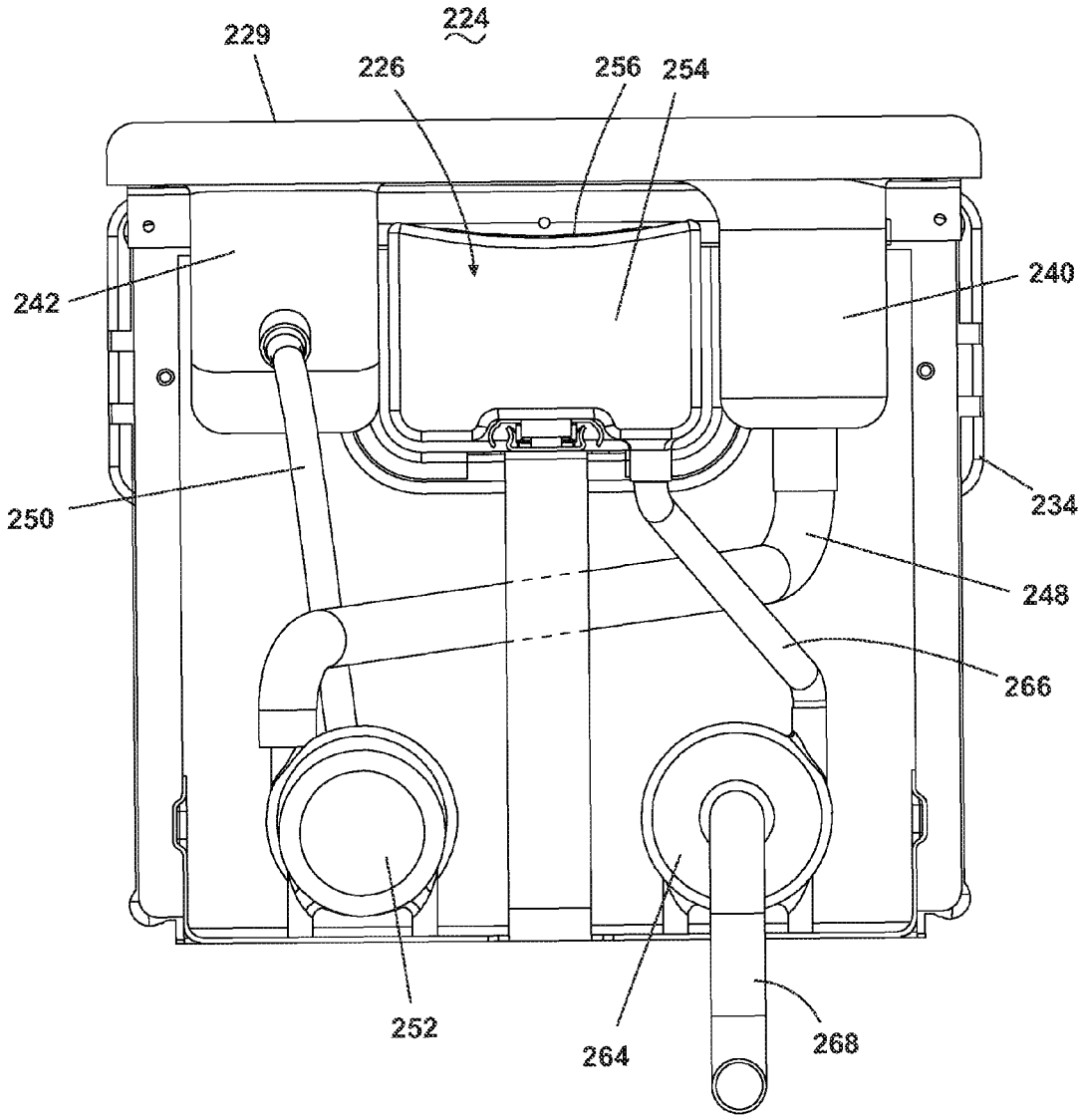
FIG. 25D depicts a rear view of the exemplary stain removal station of FIG. 25A.

The illustrated embodiment of the revitalizing system in FIGS. 25A and 25B further includes an optional ironing board 270. The ironing board 270 can be movable relative the enclosure 20, such as by being mounted on a support 272 slidably mounted within the enclosure 20. Further, the ironing board 270 can be slidable relative to the support 272 to extend the ironing board 270 after the slidably support is slid forwardly relative to the enclosure 20, as shown in FIG. 25B. The support 272 can be coupled to a front panel 274 that can pivot relative to the support 272 to accommodate forward movement of the ironing board 270. It is within the scope of the invention for the ironing board 270 to be movable relative to the enclosure 20 in other manners, such as by pivoting movement.

Typically, an article of clothing subjected to stain pretreatment at the stain treatment station 224 can be allowed to set for a predetermined period of time prior to being subjected to a refreshing process. The predetermined period of time enables the chemistries in the treatment fluid applied to the fabric load 22 by the stain treatment station 224 to dissolve or disrupt the interactions between the molecules comprising the stain or spot and the fabric fibers. Once the pre-treatment predetermined period of time is complete, the fabric load 22 can then be subjected to the refreshing process, whereby the debris associated with the stain or spot is removed from the article as other soils and particulates are removed.

Sanitization Processes:

According to one embodiment, it is highly desirable to have the refreshing process render the fabric load 22 sanitized, whereby the fabric load 22 is rendered free of microbial content, substantially free of microbial content, or having a reduced microbial content. When the fabric load 22 is to be sanitized, every component of the revitalization system in fluid communication with the chamber 26 and the fabric load 22 contained therein can be subject to sanitization measures that are directed at reducing or eliminating microbial content. The fluid delivery system represents one of the most critical areas for controlling microbial content, as the fluid delivery system introduces moisture into the fabric load 22 during the rehydration phase of the revitalization process. The rehydration of the fabric load 22 occurs as the final phase during the revitalization process and provides the fabric load 22 with its final appearance prior to wearing. Thus, the sanitization status of the components of the fluid delivery system will directly contribute to whether the fabric load 22 is in a sanitized condition after the rehydration phase.

Methods of reducing the microbial content include, but are not limited to: glutaraldehyde tanning, formaldehyde tanning at acidic pH, propylene oxide or ethylene oxide treatment, gas plasma sterilization, gamma radiation, electron beam processes, ultraviolet radiation, peracetic acid sterilization, thermal (heat or cold) treatment, chemical (antibiotics, microcides, cations, quaternary amine, etc.) treatment, mechanical (acoustic energy, structural disruption, filtration, etc.) treatment, coating the components/parts with silver or silver ions, ozone treatment, microtexturing the intersurface, and combinations thereof. When the sanitizing process includes applying heat or fluids, the sanitization can be controlled by controlling the amount and rate of heat application and fluid dispersion.

The components, such as the fluid tank 128, the fluid reservoir 132, the air entry chamber 134, the air flow channel 168/206, the fan(s) 136/208, the piezoelectric transducer 140, and various fluid flow controls 146, of the fluid delivery system that are accessible to air can be treated with conventional disinfectants, such as ozone ($O_3$).

Alternative Preferred Embodiments that Employ Principles of Component Modularity:

Though the invention contemplates several embodiments that contain all the components necessary for fabric revitalization within a single enclosure, the present invention also contemplates a modular construction to achieve unification of the components necessary to carry out the disclosed process.

With reference to FIGS. 26A and 26B, the present invention contemplates that the components necessary for carrying the fabric revitalization method can be located in one or more additional enclosures that comprise a functional module 230 separate from the enclosure 20 that contains the fabric load 22.

Referring particularly to FIG. 26B, the functional module 230 can be in fluid communication with the enclosure 20 that contains the fabric load 22 via appropriate conduits 232, such as a first conduit 232A and a second conduit 232B. The principles of modularity thereby, enable a consumer to adapt a conventional fabric processing machine lacking components necessary for the fabric revitalization process with the functional module 230 to effectively upgrade the conventional fabric processing machine to accomplish fabric revitalization process of the instant invention. In particular, for example, the functional module 230 can contain fluid reservoirs, pumps, heaters, atomizers, coolers, and other functional components used to provide the required fluids, via the conduits 232, to the revitalizing system. The functional module 230 can also contain appropriate controls and sensors useful in the carrying out the revitalization method.

In one embodiment, the functional module 230 can comprise a fluid delivery system 235 and a fluid removal system 236 similar to the fluid delivery and fluid removal systems described above. The fluid delivery system 235 can be coupled to the interior 32 of the drum 30C via the first conduit 232A, and the fluid removal system 236 can be coupled to the interior 32 of the drum 30C via the second conduit 232A. In operation, the fluid delivery system 235 delivers one or more fluids to the drum 30C, and the fluid removal system 236 removes the one or more fluids from the drum 30C. If the enclosure 20 houses a fluid removal system, then the functional module 230 need not include the fluid removal system 236. The functional module 230 can also include a fluid recycling system 237 coupled to the fluid delivery system 235 and the fluid removal system 236. The fluid recycling system 237 receives recovered fluid from the fluid recovery system 236 and supplies the recovered fluid to the fluid delivery system 235 so that that the recovered fluid can be delivered back to the drum 30C. The fluid recycling system 237 can be configured to condition the recovered fluid in addition to transporting the recovered fluid from the fluid recovery system 236 to the fluid delivery system 235.

The principles of modularity and the attendant advantages of using a modular configuration for fabric processing machines in other contexts of fabric care are disclosed in U.S. patent application Ser. No. 10/971,671, filed Oct. 22, 2004, now U.S. Pat. No. 7,513,132, issued Apr. 7, 2009, and U.S. patent application Ser. No. 10/027,160, filed Dec. 20, 2001, both entitled "Non-Aqueous Washing Apparatus and Method," which are incorporated herein by reference in their entirety.

Figure 27:
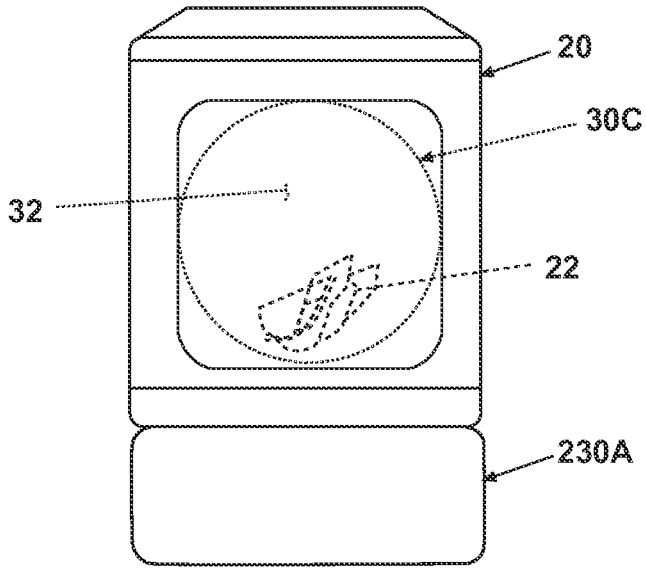
FIG. 27 depicts an alternative exemplary embodiment of modular construction of the revitalization system.

As illustrated in FIG. 27, it is contemplated that the functional module can be in the form of a horizontal pedestal 230A adapted to support the enclosure 20 of the revitalizing system. Alternatively, the functional module in the form of the horizontal pedestal 230A could be mounted above the enclosure 20 of the revitalizing system or in another configuration relative to the enclosure 20 of the revitalizing system. The functional module 230 can be located in any suitable position relative to the enclosure 20, such as adjacent to the enclosure 20 or above or below the enclosure 20.

Figure 28:
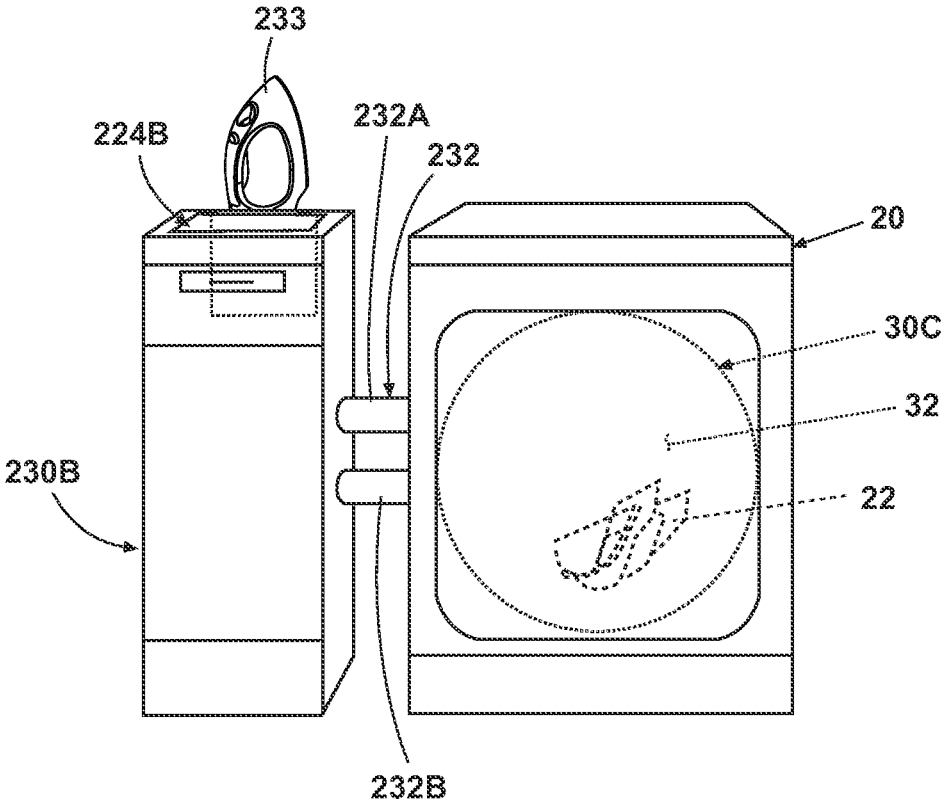
FIG. 28 depicts another alternative exemplary embodiment of modular construction of the revitalization system.

The functional module 230 can include additional functionality. For example, an alternative functional module 230B illustrated in FIG. 28 includes as a stain treatment station 224A similar to the stain treatment stations 224 described above with respect to FIGS. 23-25D and an iron 233. Alternatives for the additional functionality are disclosed in the several patent applications listed and incorporated at the end of this section.

Figure 29:
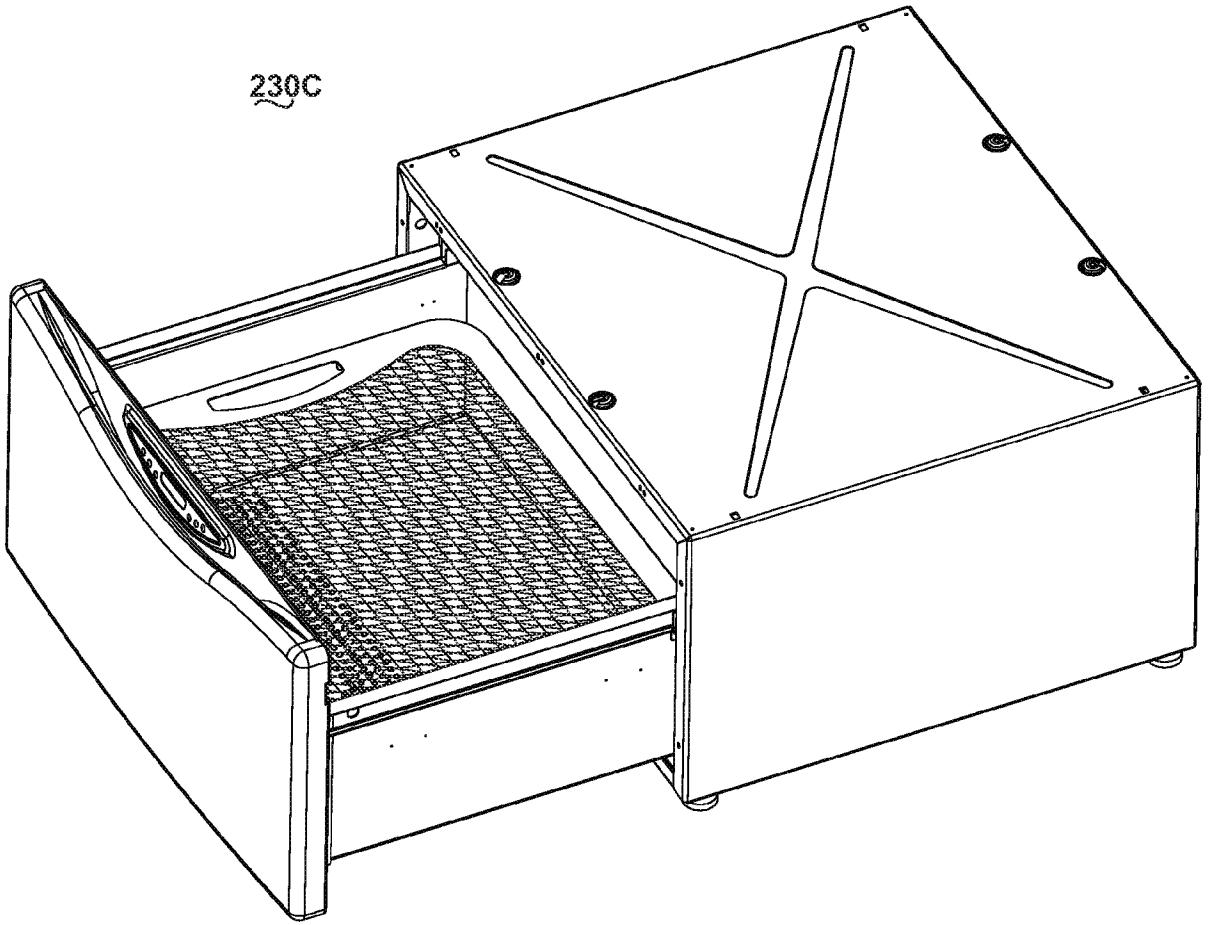
FIG. 29 depicts a first exemplary embodiment of a dryer module for use with the revitalization system.
Figure 30:
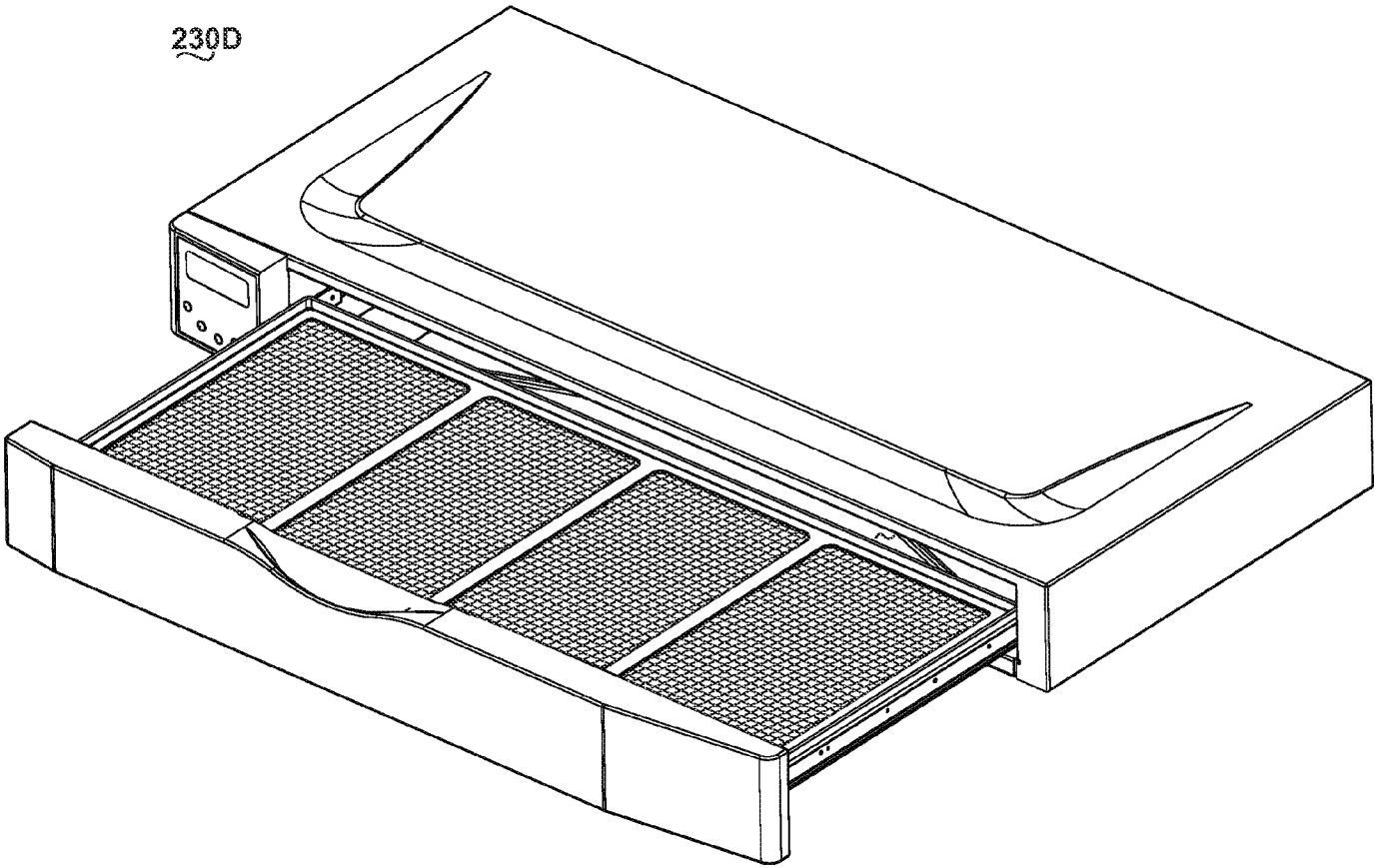
FIG. 30 depicts a second exemplary embodiment of a dryer module for use with the revitalization system.
Figure 31:
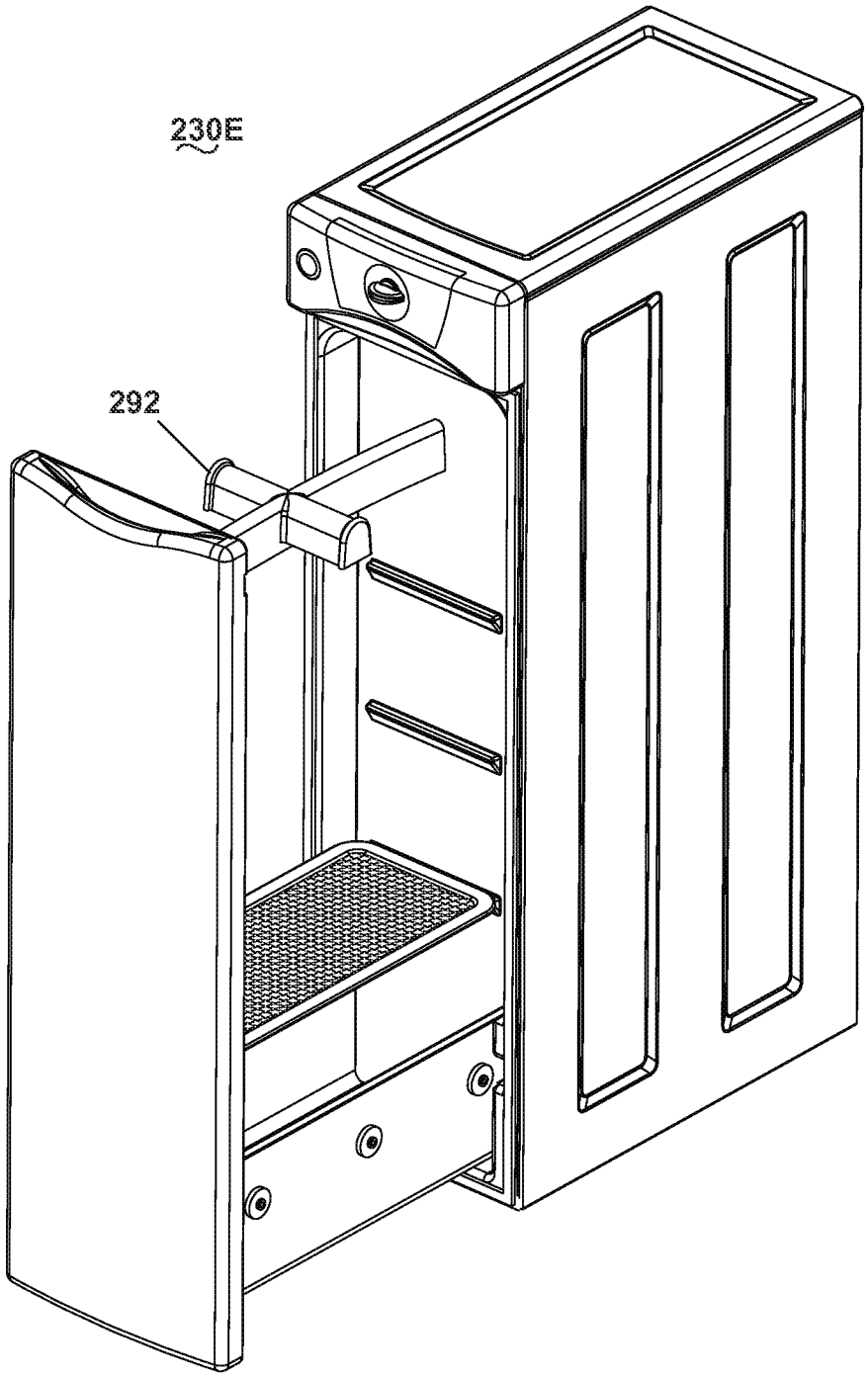
FIG. 31 depicts a third exemplary embodiment of a dryer module for use with the revitalization system.
Figure 32:
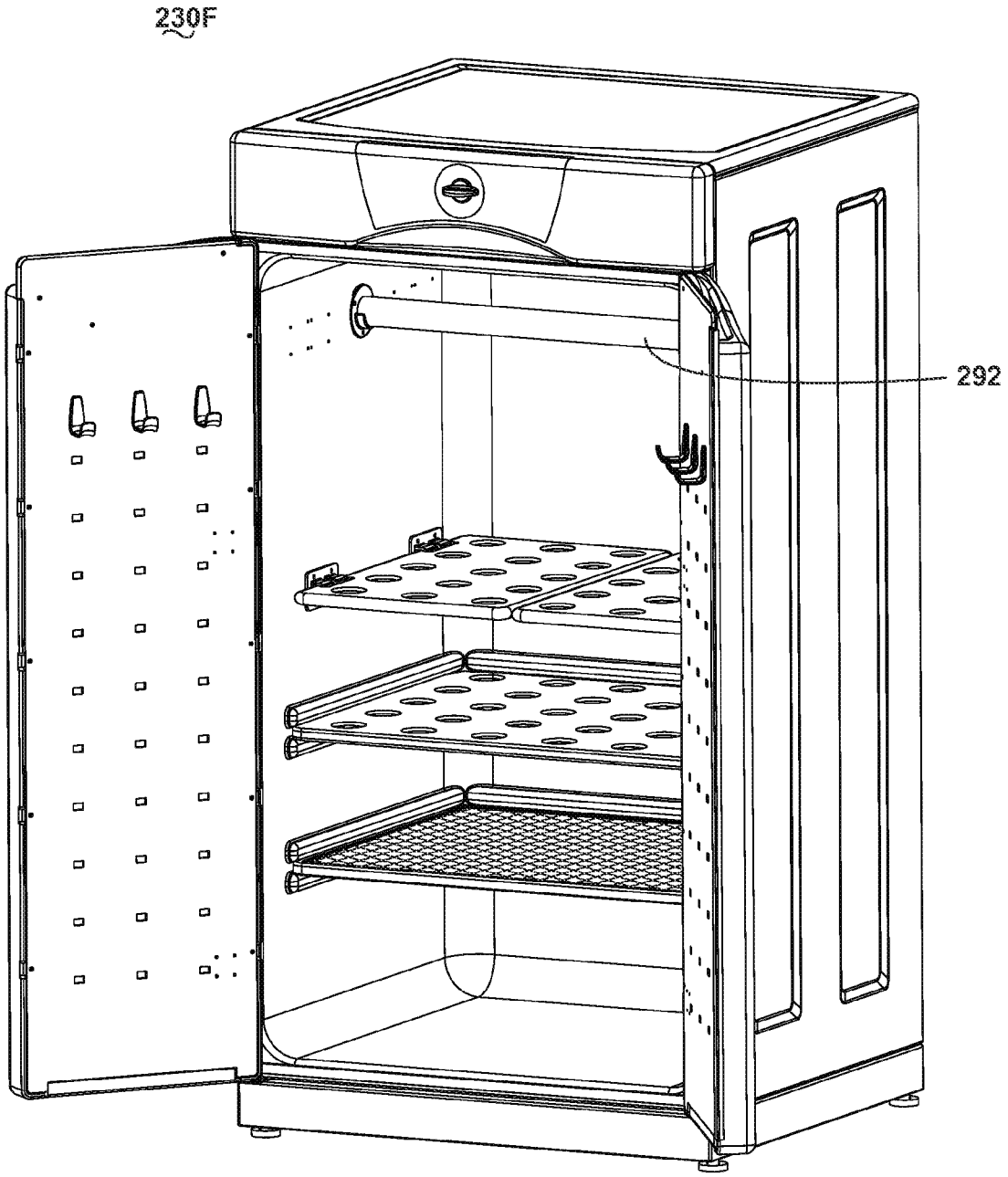
FIG. 32 depicts a fourth exemplary embodiment of a dryer module for use with the revitalization system.
Figure 33:
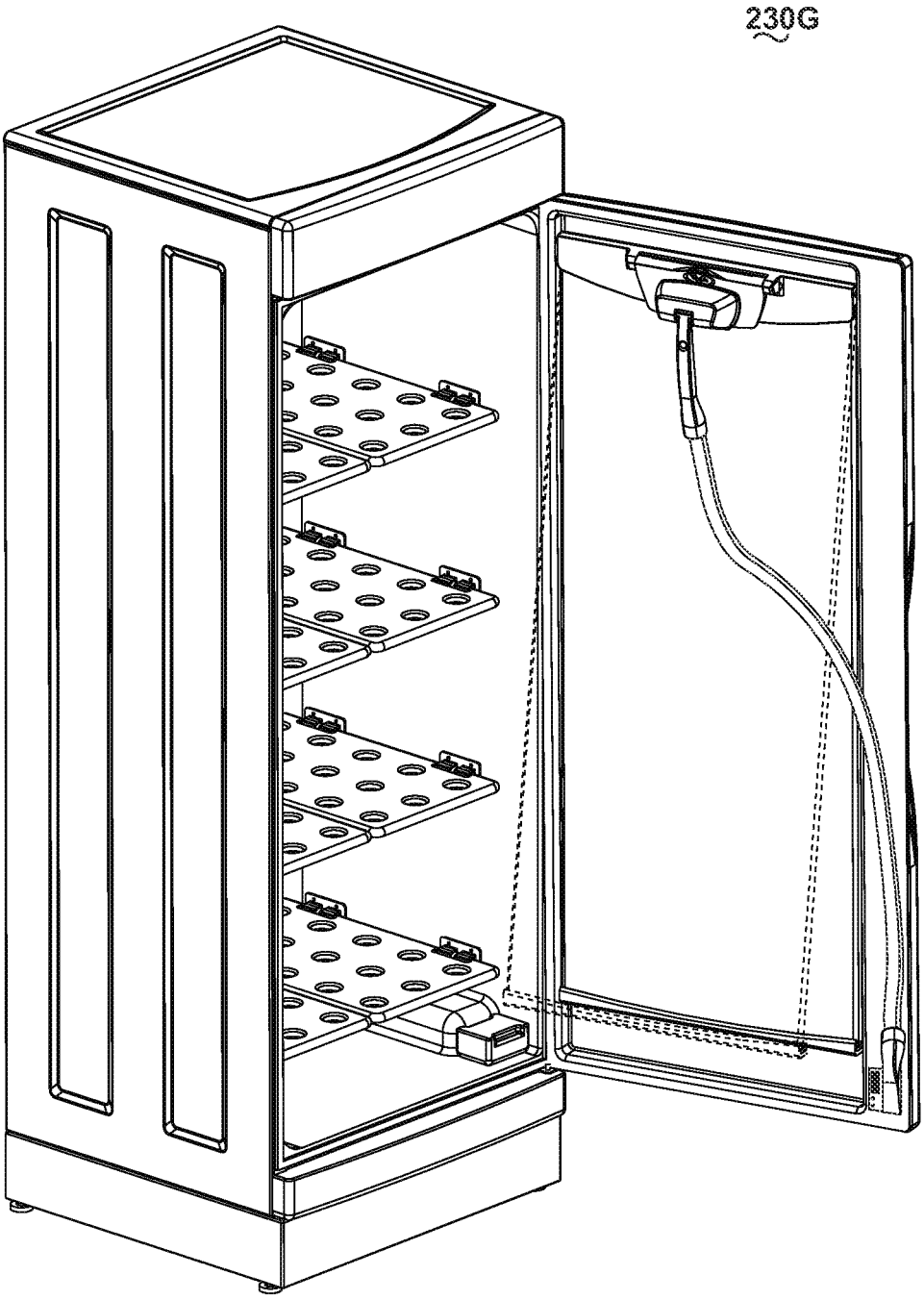
FIG. 33 depicts a fifth exemplary embodiment of a dryer module for use with the revitalization system.

Other exemplary functionalities include, but are not limited to, drying, sanitizing, and alternative chemistry. The drying module can be configured to dry fabric items by forcing heated or unheated air through a chamber that holds the fabric items. The air flow can be accompanied by mechanical movement of the fabric items, such as by tumbling the fabric items in a drum. Alternatively, the fabric items can remain stationary, such as in a vertical, hanging condition or a horizontal, flat condition, during the drying process. As an alternative to or in addition to utilizing air flow to dry the fabric items, the drying module can be configured to dispense one or more chemistries, such as alcohol, onto the fabric items to facilitate evaporation of moisture from the fabric items. Exemplary drying modules 230C-230G are shown in FIGS. 29-33. The drying modules 230C, 230D of FIGS. 29 and 30 are drawer-type horizontal modules, the drying module 230E of FIG. 31 is a drawer-type vertical module, and the drying modules 230F, 230G of FIGS. 32 and 33 are cabinet modules. These exemplary drying modules 230C-230G are described in more detail in the several patent applications listed and incorporated at the end of this section. The drying module can incorporate other functions, such sanitizing and refreshing.

The sanitizing module can be capable of sanitizing fabric items or sanitizing the revitalizing system. For sanitizing the fabric items, the sanitizing module can expose the fabric item in a chamber to a sanitizing medium that disinfects the fabric item by removal of germs, microbes, and the like. The fabric items can be subjected to mechanical movement, such as tumbling, or can be stationary during the sanitization process. For sanitizing the revitalizing system, the sanitizing module can store and dispense sanitizing media that disinfect the entire revitalizing system in the enclosure 20 or particular components of the revitalizing system.

The alternative chemistry module can store one or more revitalizing chemistries for use in the revitalizing system. For example, the alternative chemistry module can have the capacity to store a larger variety of and greater volumes of revitalizing chemistries than the revitalizing system housed within the enclosure 20. As a result, the alternative chemistry module can expand the capabilities of the revitalizing system. The revitalizing chemistries can be stored in the alternative chemistry module in any suitable manner, such as in individual drawers that can be easily accessed by the user by pulling the drawer from the alternative chemistry module. The alternative chemistry module can communicate with the control 213 for coordinating dispensing of the revitalizing chemistries from the alternative chemistry module to the revitalizing system in the enclosure 20. For example, the alternative chemistry module can have the ability of resetting the revitalizing system to operate with one or more preselected revitalizing chemistries.

Figure 34:
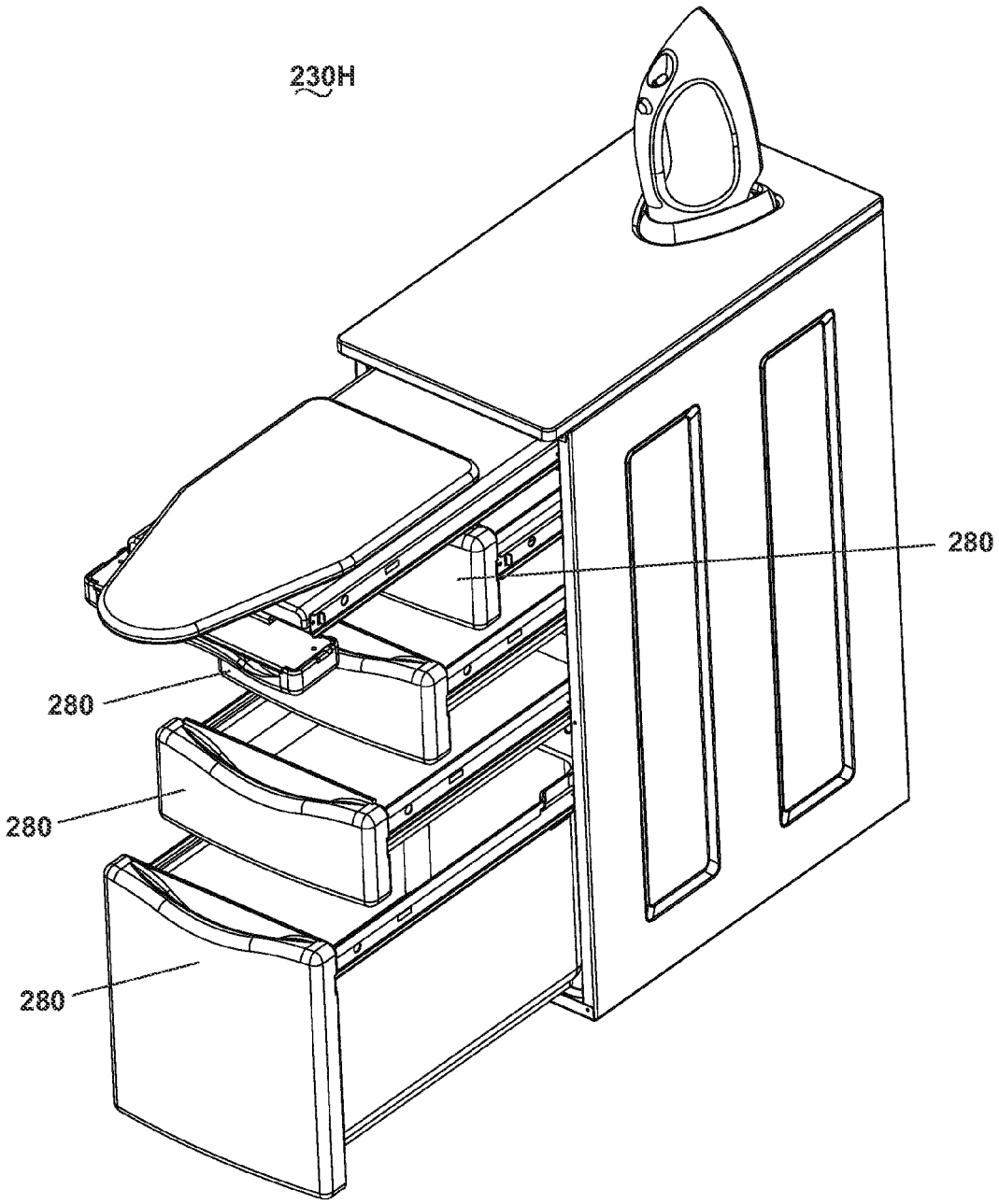
FIG. 34 depicts an exemplary embodiment of an ironing module for use with the revitalization system.
Figure 35:
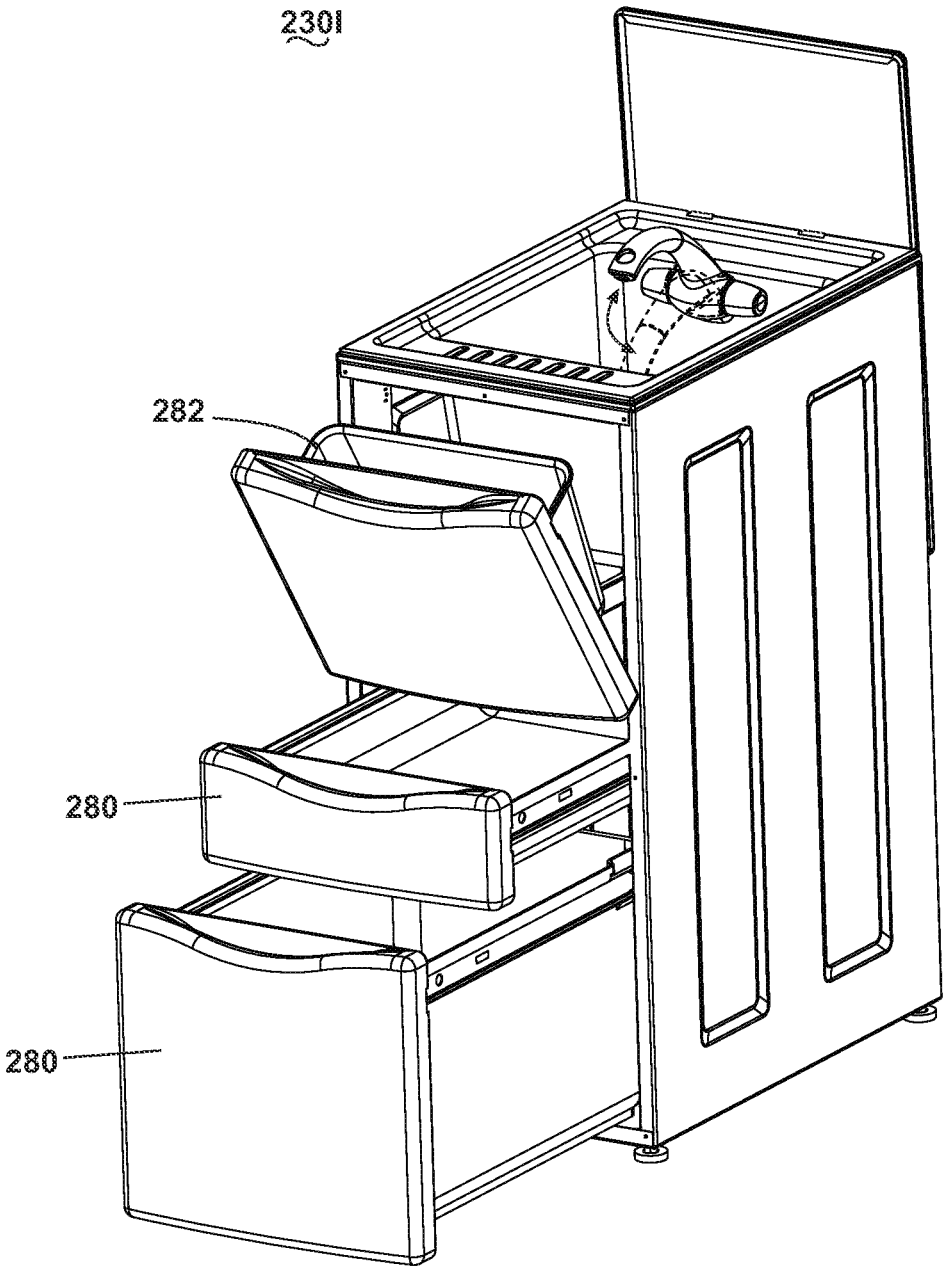
FIG. 35 depicts an exemplary embodiment of a sink module for use with the revitalization system.
Figure 36:
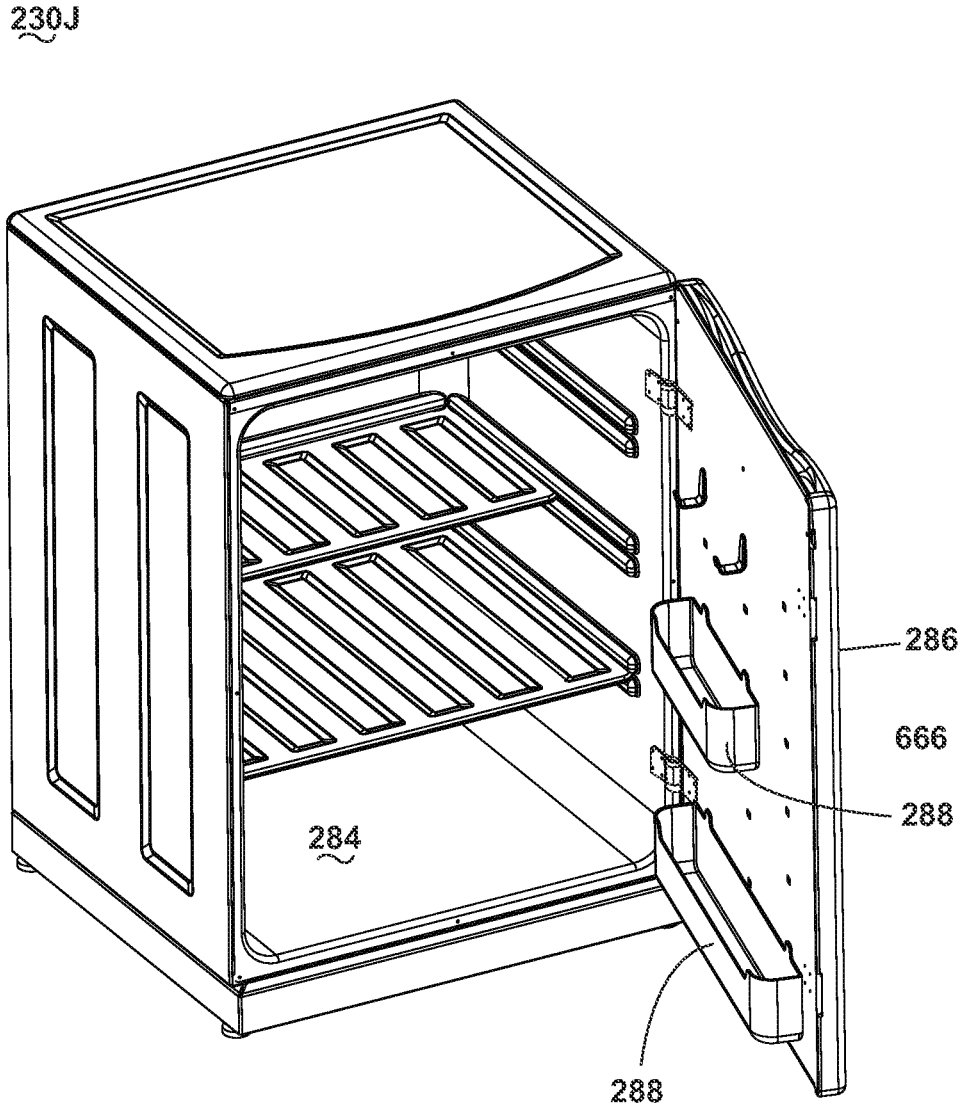
FIG. 36 depicts an exemplary embodiment of a storage module for use with the revitalization system.
Figure 37:
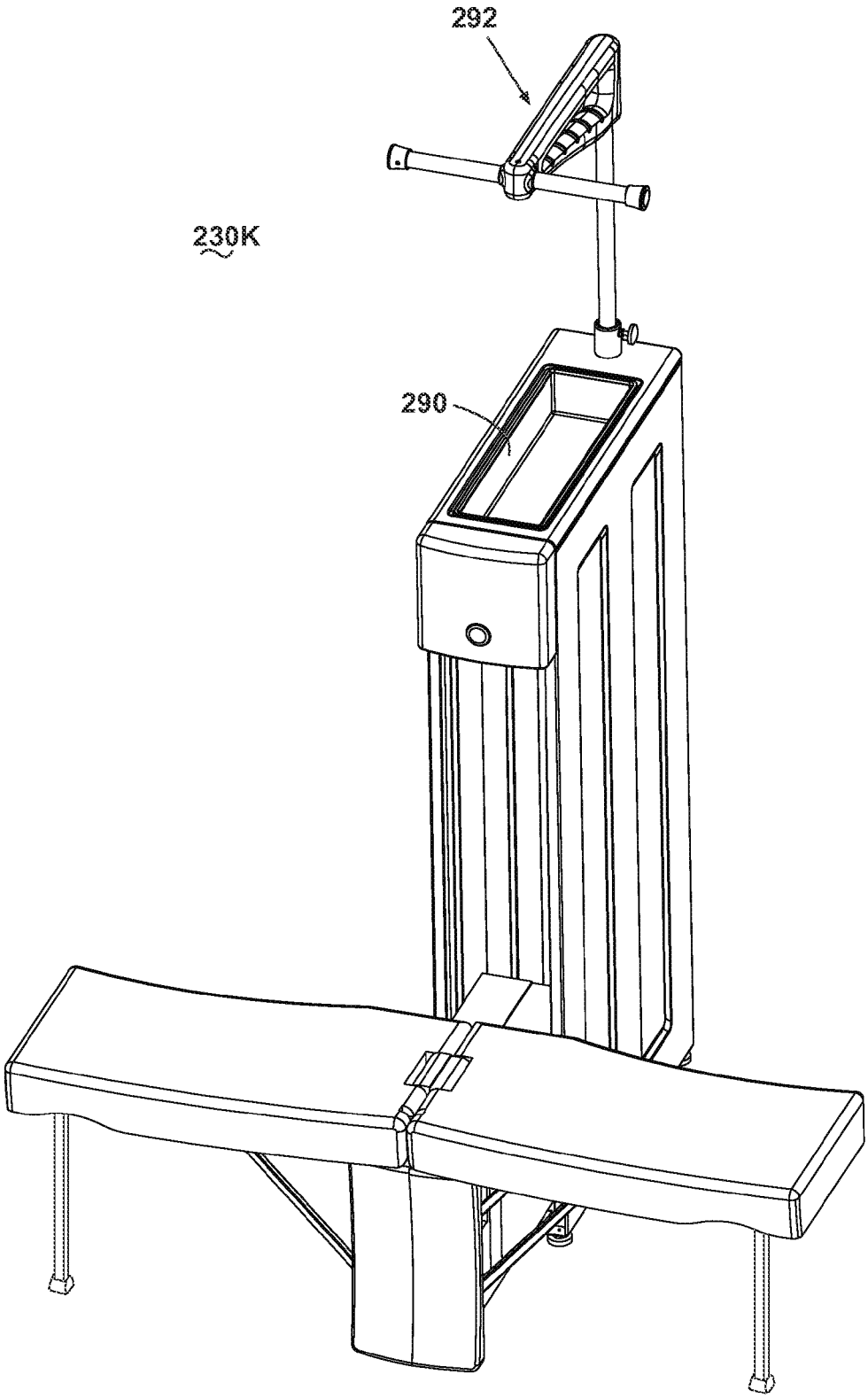
FIG. 37 depicts an exemplary embodiment of a shelf module for use with the revitalization system.

Additional exemplary functional modules are illustrated in FIGS. 34-37. FIG. 34 shows an exemplary ironing module 230H, FIG. 35 depicts an exemplary sink module 230I, FIG. 36 illustrates an exemplary storage module 230J, and FIG. 37 shows an exemplary shelf module 230K. These exemplary functional modules 230H-230K are described in more detail in the several patent applications listed and incorporated at the end of this section.

Several of the exemplary functional modules shown in the figures comprise common features. For example, the ironing module 230H and the sink module 230I both include storage drawers 280. The sink module 230I further includes a pivotable storage compartment 282, the storage module 230J provides a storage compartment 284 closable by a door 286, which supports a plurality of removable storage bins 288, and the shelf module 230K has an open-top storage cavity 290. Further, the drying modules 230E, 230F and the shelf module 230K each include a hanging element 292 for supporting fabric items.

Other exemplary functional modules and functionalities, including work surfaces, that can be incorporated into the functional module are disclosed in the following patent applications, which are incorporated herein by reference in their entirety: U.S. patent application Ser. No. 11/323,125, filed Dec. 30, 2005, now U.S. Pat. No. 7,628,043, issued Dec. 8, 2009, and titled "Modular Laundry System with Horizontal Modules," U.S. patent application Ser. No. 11/322,715, filed Dec. 30, 2005, and titled "Modular Laundry System with Horizontal Module Spanning Two Laundry Appliances," U.S. patent application Ser. No. 11/323,221, filed Dec. 30, 2005, now U.S. Pat. No. 7,624,600, issued Dec. 1, 2009, and titled "Modular Laundry System with Horizontally Arranged Cabinet Module," U.S. patent application Ser. No. 11/322,739, filed Dec. 30, 2005, and titled "Modular Laundry System with Horizontal and Vertical Modules," U.S. patent application Ser. No. 11/323,075, filed Dec. 30, 2005, and titled "Modular Laundry System with Vertical Module," U.S. patent application Ser. No. 11/323,417, filed Dec. 30, 2005, now U.S. Pat. No. 7,126,842, issued Oct. 24, 2006, and titled "Modular Laundry System with Cabinet Module," U.S. patent application Ser. No. 11/322,742, filed Dec. 30, 2005, and titled "Laundry Module for Modular Laundry System," U.S. patent application Ser. No. 11/323,220, filed Dec. 30, 2005, and titled "Modular Laundry System with Work Surface," U.S. patent application Ser. No. 11/322,773, filed Dec. 30, 2005, and titled "Modular Laundry System with Segmented Work Surface," U.S. patent application Ser. No. 11/322,741, filed Dec. 30, 2005, and titled "Modular Laundry System with Work Surface Having a Functional Insert," U.S. patent application Ser. No. 11/322,740, filed Dec. 30, 2005, and titled "Modular Laundry System with Work Surface Having a Functional Element," U.S. patent application Ser. No. 11/323,658, filed Dec. 30, 2005, now U.S. Pat. No. 7,587,917, issued Sep. 15, 2009, and titled "Modular Laundry System with Shelf Module," U.S. patent application Ser. No. 11/323,867, filed Dec. 30, 2005, and titled "Vertical Laundry Module," U.S. patent application Ser. No. 11/322,943, filed Dec. 30, 2005, now U.S. Pat. No. 7,562,543, issued Jul. 21, 2009, and titled "Vertical Laundry Module with Backsplash," U.S. patent application Ser. No. 11/322,503, filed Dec. 30, 2005, and titled "Retractable Hanging Element," U.S. patent application Ser. No. 11/322,502, filed Dec. 30, 2005, and titled "Non-Tumble Clothes Dryer," U.S. patent application Ser. No. 11/323,270, filed Dec. 30, 2005, now U.S. Pat. No. 7,555,856, issued Jul. 7, 2009, and titled "Ironing Station," U.S. patent application Ser. No. 11/322,944, filed Dec. 30, 2005, and titled "Sink Station with Cover."

Automated Fabric Processing System:

Various components and systems of the revitalizing system have been described above. The revitalizing system can comprise other components and systems such that the revitalizing system can be operated in any suitable manner. The components and system form an automated fabric processing system that provides at least one of mechanical energy, thermal energy, and chemical energy to the fabric load 22 in the chamber 26 to perform a fabric treatment process. For example, the automatic fabric processing system can comprise the fabric movement system and the heated air supply system whereby the fabric treatment process comprises drying the fabric load 22 much like in a conventional clothes dryer. Alternatively, the automatic fabric processing system can comprise the fabric movement system, a water supply system, and a water removal system whereby the fabric treatment process comprises washing the fabric load 22 much like in a conventional clothes washing machine. As another example, the automatic fabric processing system can comprise the fabric movement system, the heated air supply system, the water supply system, and the water removal system whereby the fabric treatment process comprises drying the fabric load 22 and washing the fabric load 22 much like in a conventional combination fabric washing and drying machine. The automatic fabric processing system can comprise, among other systems, the treatment fluid dispensing system whereby the fabric treatment process comprises revitalizing the fabric load 22.

Figure 38:
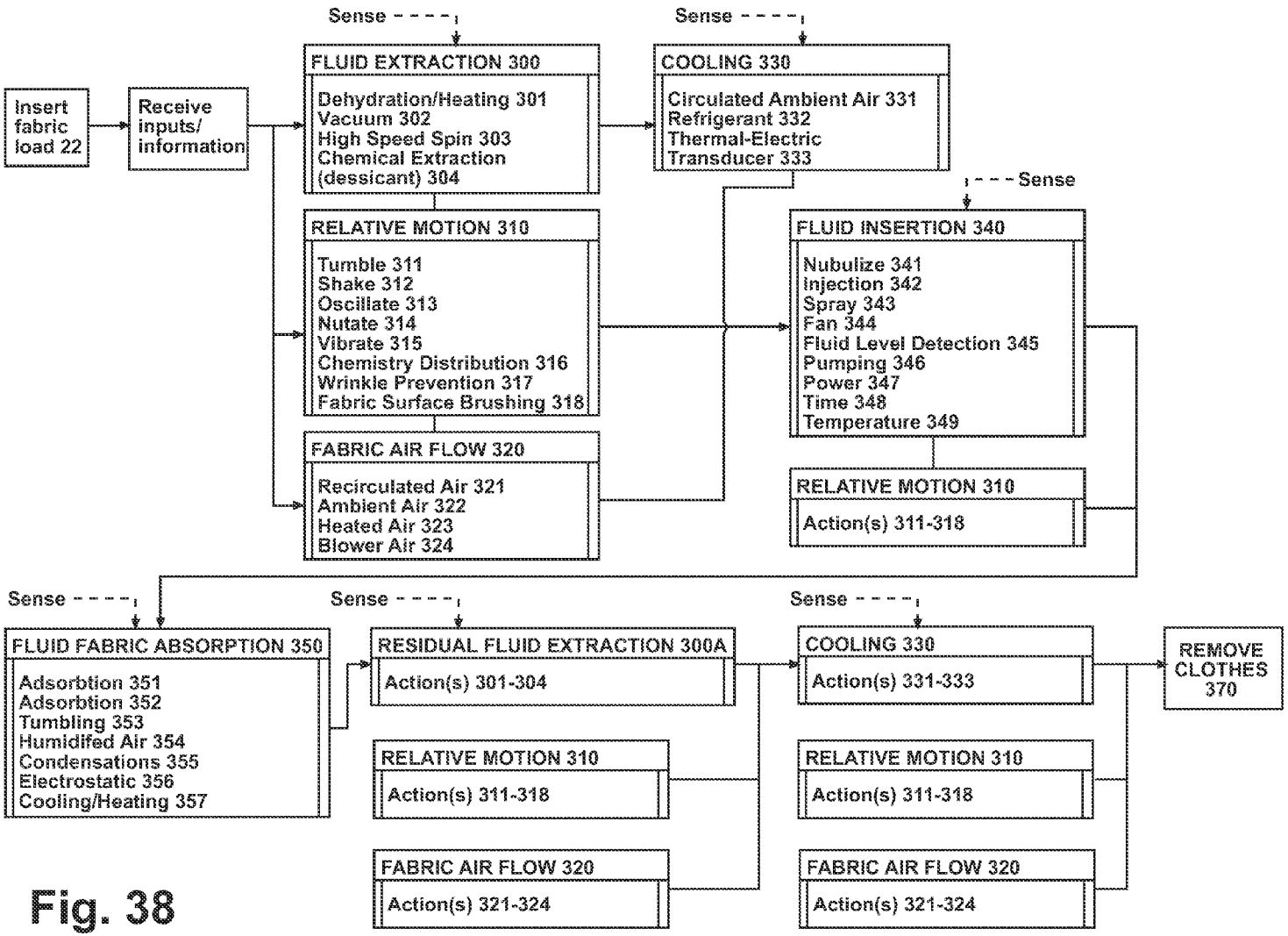
FIG. 38 depicts an exemplary embodiment of operations and actions performed during a revitalization process.

Revitalization Method:

Referring to FIG. 38, the present invention contemplates use of an assortment of operations and methods (herein termed "Actions") for using the revitalization system disclosed herein to achieve article refreshing for the fabric load 22. After the user inputs the fabric load 22 into the revitalization chamber 26 of the enclosure 20, the user inputs or enters a specific set of parameters into the control panel 212 of the user interface and control 210 for communication with the control 213. The control 213 can also receive inputs or information from other sources, including internal sources, such as the sensors associated with the revitalization system, and external sources. The parameters determine the set of operations and Actions to be performed on the fabric load 22 during the revitalization process. Alternatively, the user can manually select the operations and Actions from a menu on the control panel 212. After the control panel 212 receives input or engages an initiation entry, the control 213 commences with an initial action corresponding to a selected operation. One skilled in the art will understand that a plurality of operations can be performed simultaneously or sequentially on the fabric load 22, and, for any given operation, a plurality of Actions may be performed simultaneously or sequentially on the fabric load 22 during the course of the revitalization process.

Basic operations associated with fabric revitalization include Fluid Extraction 300, Relative Motion 310, Fabric Air Flow 320, Cooling 330, Fluid Insertion 340, Fabric Fluid Absorption 350, and Residual Fluid Extraction 300A. An exemplary order of the operations performed on the fabric load 22 begins with the Fluid Extraction 300, the Relative Motion 310, and the Fabric Air Flow 320. Because each of these three initial operations is independently controllable (e.g., the Fluid Extraction 300 is governed by the heater 76, the blower fan 80, and the motor 82; the Relative Motion 310 is governed by the motor 52; and the Fabric Air Flow 320 is governed by the blower fan 80 and the motor 82, and optionally the recycle/recirculation loop 86), it will be understood that the precise order of these three initial operations can be selectable by the user and can vary according to the type of the fabric load 22 present in the chamber 26. It will be understood to those skilled in the art that the user can select to use only a subset of these three initial operations to effect the desired treatment on the fabric load 22. It will also be understood to those skilled in the art that a plurality of operations can be performed sequentially or simultaneously and in varied order throughout the revitalization process. For example, the fabric load 22 can be subjected to multiple of the Relative Motion 310 operations during performance of the Fluid Extraction 300 and the Fabric Air Flow 320 operations.

Each of the Fluid Extraction 300, the Relative Motion 310, and the Fabric Air Flow 320 operations is associated with a set of specific Actions that can be selected by the user engaging the control panel 212 of the user interface and control 210. If the user selects the Fluid Extraction 300 as part of the revitalization program, then the control panel 212 of the user interface and control 210 prompts the user with a menu of the Actions associated with the Fluid Extraction 300 operation. The Actions associated with the Fluid Extraction 300 operation include Dehydration/Heating 301, Vacuum 302, High Speed Spin 303, and Chemical Extraction (e.g. dissicant) 304. If the user selects the Relative Motion 310 as part of the revitalization program, then the control panel 212 of the user interface and control 210 prompts the user with a menu of the Actions associated with the Relative Motion 310 operation. The Actions associated with the Relative Motion 310 operation include Tumble 311, Shake 312, Oscillate 313, Nutate 314, Vibrate 315, Chemistry Distribution 316, Wrinkle Prevention 317, and Fabric Surface Brushing 318. If the user selects the Fabric Air Flow 320 as part of the revitalization program, then the control panel 212 of the user interface and control 210 prompts the user with a menu of the Actions associated with the Fabric Air Flow 320 operation. The Actions associated with the Fabric Air Flow 320 operation include Recirculated Air 321, Ambient Air 322, Heated Air 323, and Blower Air 324.

If the Fluid Extraction 300 is selected as one of the operations, then the various sensors, such as the sensors 92, 94, 98 can become active to sense fluid content and temperature of the fabric load 22 as the Fluid Extraction 300 operation proceeds. Optionally, the user can specify in the Fluid Extraction 300 operation the extent of the fluid extraction from the fabric load 22, which can be prompted by selection of the type of fabric included in the fabric load 22 (e.g., linen, silk, polyester blend, cotton, wool, etc.) at the control panel 212 of the user interface and control 210. Other operations associated with the Fluid Extraction 300 include the Cooling 330. The Actions associated with the Cooling 330 include Circulate Ambient Air 331, Refrigerant 332, and Thermal-Elastic Transducer 333. In a manner similar to selection of the Fluid Extraction 300, election of the Cooling 330 operation can result in temperature sensors becoming activated to sense the temperature of the fabric load 22. The Cooling 330 operation returns the fabric load 22 to ambient temperature. Because the Relative Motion 310 and the Fabric Air Flow 320, when not performed with the Heated Air 323 Action or other Action including heating the fabric load 22, are not associated with Actions that result in heat being imparted to the fabric load 22, the Cooling 330 will not be an option typically available to the user through operation of the control panel 212 of the user interface and control 210 absent the selection of the Fluid Extraction 300. However, the Relative Motion 310 and the Fabric Air Flow 320 are user selectable options available at the control panel 212 of the user interface and control 210 following completion of the Cooling 330.

Following the completion of the selected operations, which can include any combination of the Fluid Extraction 300, the Relative Motion 310, the Fabric Air Flow 320, and the Cooling 330, the fabric load 22 can be subjected to rehydration, which is performed by the Fluid Insertion 340 operation. The Actions associated with the Fluid Insertion 340 operation include Nebulize 341, Injection 342, Spray 343, Fan 344, Fluid Level Detection 345, Pumping 346, Power 347, Time 348, and Temperature 349. Sensors, such as those included in the system and on the fabric load 22, can be activated to sense moisture content or temperatures within the chamber 26 and the fabric load 22 during the Fluid Insertion 340. The fabric load 22 can be subjected to any of the Actions 311-318 of the Relative Motion 310 during or after the Fluid Insertion 340 operation.

The rehydration is further promoted by subjecting the fabric load 22 to the Fabric Fluid Absorption 350 operation. The Actions associated with the Fabric Fluid Absorption 350 operation include Adsorption 351, Absorption 352, Tumbling 353, Humidified Air 354, Condensation 355, Electrostatic 356, and Cooling/Heating 357. Sensors, such as those included in the system and on the fabric load 22, can be activated to sense moisture content or temperature within the chamber 26 and the fabric load 22 during the Fabric Fluid Absorption 350 operation.

Following completion of the Fabric Fluid Absorption 350 operation, the fabric load 22 can be subjected to the Residual Fluid Extraction 300A operation to remove extraneous fluid from the fabric load 22 or within the chamber 26. The Actions associated with the Residual Fluid Extraction 300A include the Actions 301-304 associated with the Fluid Extraction 300 operation. Optionally, the fabric load 22 can be subjected to the Relative Motion 310 and the Fabric Air Flow 320 operations and their respective Actions during the Residual Fluid Extraction 300A. Sensors, such as those included in the system and on the fabric load 22, can be activated to sense moisture content and temperature in the chamber 26 and the fabric load 22 during the Residual Fluid Extraction 300A.

Following completion of the Residual Fluid Extraction 300A, the temperature of the fabric load 22 can be returned to ambient temperature through the Cooling 330 operation and its attendant Actions 331-333. Optionally, the fabric load 22 can be subjected to the Relative Motion 310 and the Fabric Air Flow 320 operations and their respective Actions 311-318, 321-324 during the Cooling 330 operation. Sensors, such as those included in the system and on the fabric load 22, can be activated to sense temperature in the chamber 26 and the fabric load 22 during the Cooling 330 operation.

After completion of a final Action of an operation of the selected program, the user interface and control 210 communicates, such as via an audio or visual signal, to the user that the revitalization process is completed, and the system powers off. Thereafter, the user effects Clothes Removal 370 by removing the refreshed fabric load 22 from the chamber 26.

Optionally, the fabric revitalization can proceed without the steps associated with rehydration, such as the Fluid Insertion 340 operation and the Fluid Fabric Absorption 350 operation, whereby the process corresponds to a dry operation similar to that of a conventional clothes dryer.

Cadence and Evolutionary Development of Embodiments:

It will be apparent to those skilled in the art that the revitalization system and method disclosed herein for fabric materials can be configured in a variety of formats for fabric care systems, including an independent revitalization system in a sealed, stand-alone enclosure, a combination dryer-revitalization system, and a combination washer-dryer-revitalization system that employs a combination of aqueous and non-aqueous processes.

Furthermore, it will be evident to those skilled in the art that features, components, and processes of the revitalization system and method disclosed herein for fabric materials have broad applications to removing particulates, such as stains, soils, and other foreign matter, from any number of different surfaces, including: human hair and skin; pet hair and skin; metallic materials associated with precious metals and coins, jewelry, flatware; cars, boats, bicycles, and the like; as well as ceramic materials associated with jewelry, flatware, and dishware, such as china.

Exemplary enclosures 20 for exemplary embodiments of the revitalization systems for various applications include tanning or spa booths (to remove debris and dead cells from the skin and hair of humans and pets), automated car washes or stand alone garage enclosures (to remove debris from automobile, bikes, boats), enclosures for a combination dishwasher/revitalization system (to remove debris and stains from flatware and dishware, such as china), and table top enclosure systems (to remove debris and stains from jewelry and precious metals and coins). Each of these exemplary enclosures, though already well established in the art for particular applications, can be modified, upon reading the present detailed description and understanding the system disclosed herein, to include components of the revitalization system and method for revitalization of fabric materials.

Figure 39A:
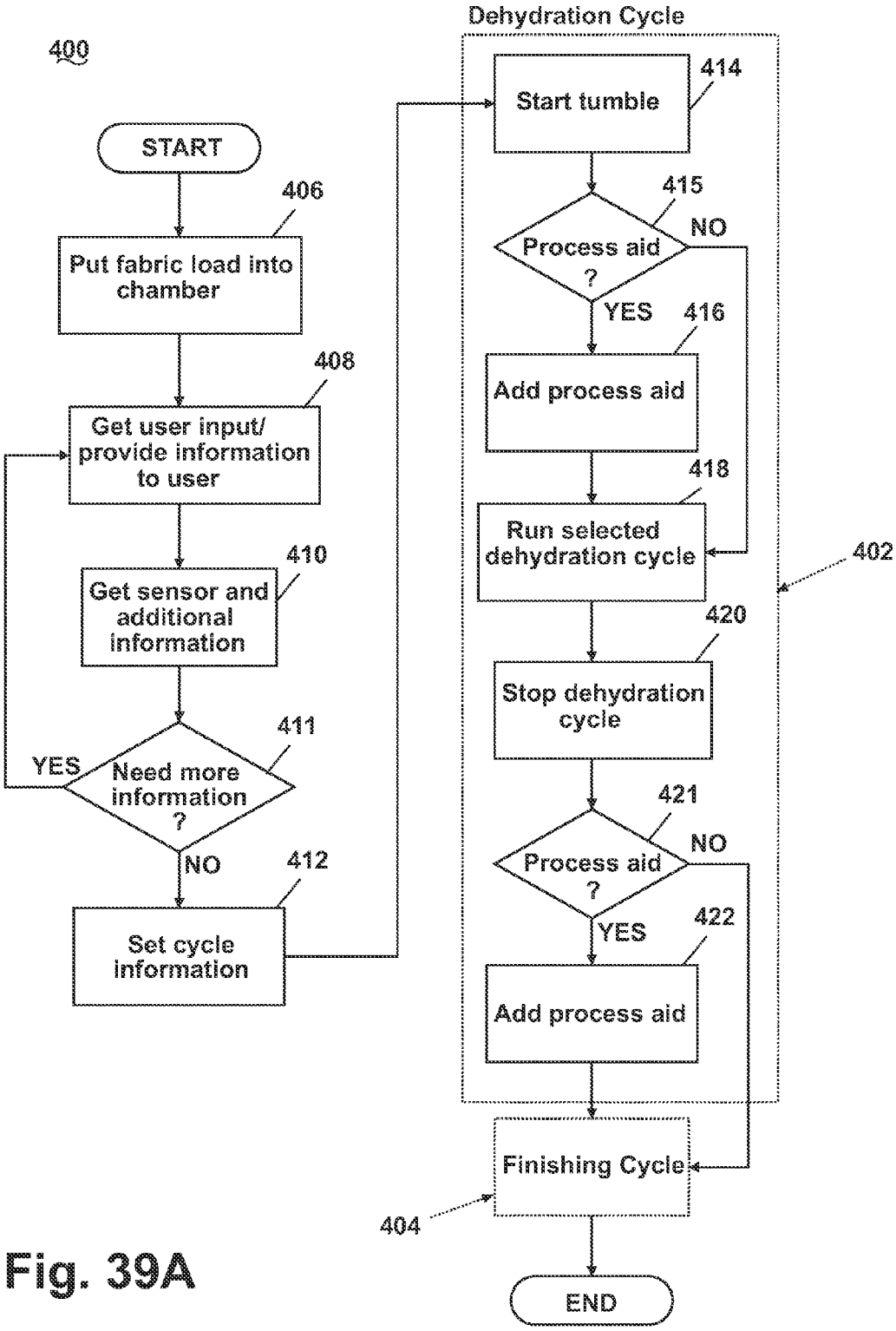
FIGS. 39A and 39B together depict an exemplary control flow chart for a user interface and control for the revitalization system.
Figure 39B:
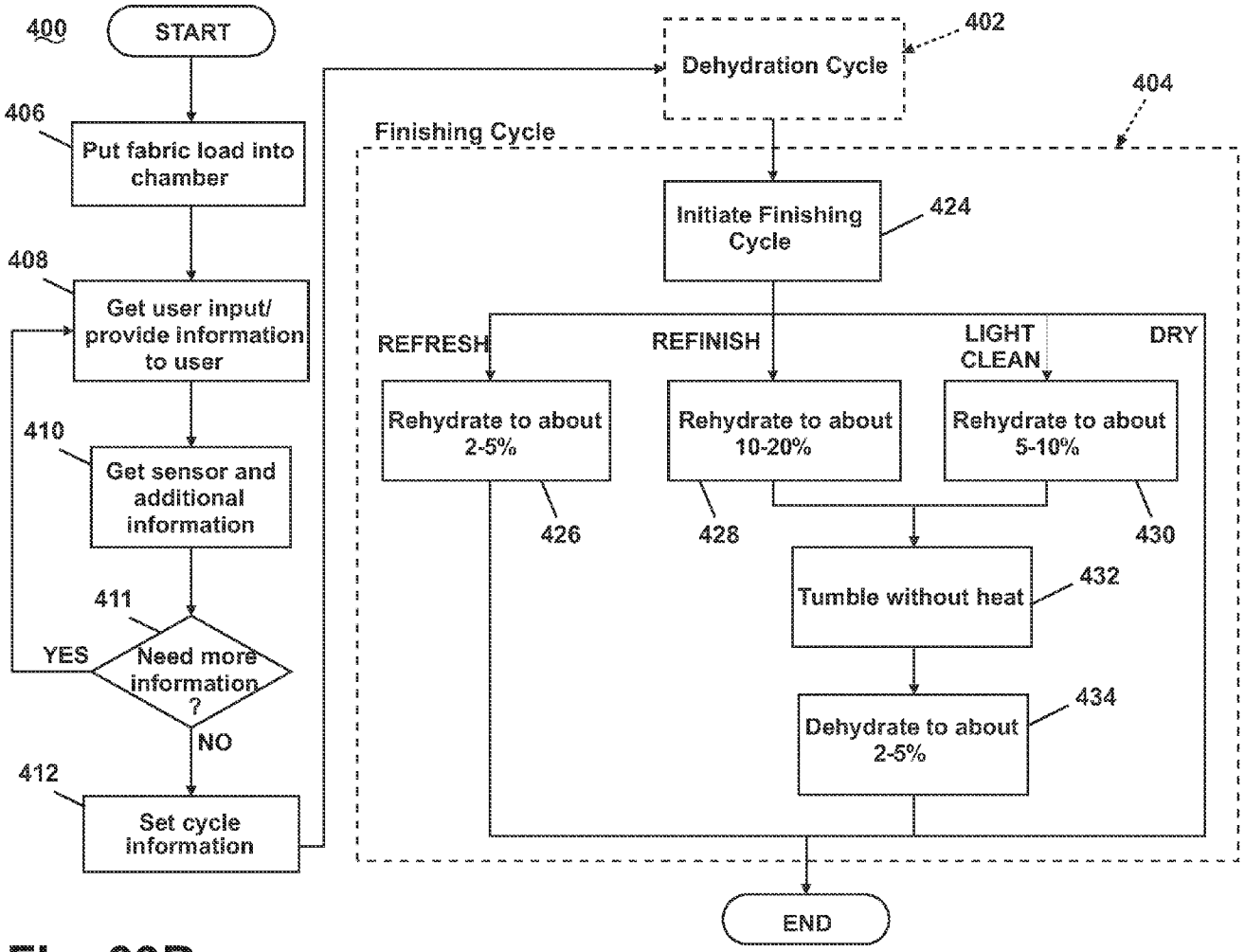

Exemplary Control Process:

A control chart 400 illustrating a user interface and control process as well as alternative cycles for the revitalization system and method is provided in FIGS. 39A and 39B, which include multiple alternative operations for treating fabric. In contrast to FIG. 38, which illustrates a wide variety of alternative Actions possible for each operation in a revitalization process, the control process of FIGS. 39A and 39B is described in the context of an exemplary production control for a specific configuration of the revitalization system. More particularly, FIGS. 39A and 39B are directed to a control process for a revitalization system incorporated into a horizontal axis clothes dryer or a horizontal axis combination washer/dryer, such as that illustrated by example in FIG. 1, which offers the user a small number of pre-programmed alternative cycles as well as a small number of specific variable parameters for each of these cycles. It will be appreciated by those skilled in the art that principles behind the control process chart of FIGS. 39A and 39B can be applied to other configurations of the revitalization systems, such as those illustrated in FIGS. 2A-2D and 3A-3F.

The control process illustrated on the control chart 400 is divided into two primary cycles, a dehydration cycle 402 and a finishing cycle 404. The dehydration cycle 402 is shown in detail in FIG. 39A, while the finishing cycle 404 is illustrated in detail in FIG. 39B.

Referring now to FIG. 39A, the control process begins, prior to running the dehydration cycle 402 and the finishing cycle 404, with loading the fabric load 22 into the chamber at step 406 and determining which cycle is to be run at steps 408, 410, and 412, as described in more detail below.

After the fabric load 22 is loaded into the chamber, the operator provides information to and receives information from the control 213 via the control panel 212 of the user interface and control 210 at step 408. The information input by the user can include load type, load size, soil level of the load, the presence of stains, the presence of odors, cycle selection, special operations, details of the operation of the motor (e.g., speed, direction of movement, duration of operation), the type of fluid to use or to be dispensed, details of the operation of the fluid delivery system, and details of operation of the fluid removal system. Alternatively, the user might choose to directly select a cycle of operation from a list of pre-programmed cycles. The information received by the user from the control panel 212 of the user interface and control 210 could include status information, safety information, emergency information, time remaining, cycle step status, unbalanced load, blocked conduit, valve failure, clogged filter, breach of close system, fluid leak, fluid level, pressure drops, temperature increase, and chemical leakage.

The control 213 retrieves additional information at step 410. This can include information delivered from sensors that can be built into the revitalizing system. Such sensors can include sensors that detect aspects of the internal environment of the revitalization system, the condition of the system, or the ambient environment of the room in which the system resides. The sensors can specifically include sensors detecting temperature, pressure, humidity, vapor, moisture, oxygen, carbon monoxide, carbon dioxide, electrical condition, enzyme, aqueous vapor, non-aqueous vapor, turbidity, optical spectrum, ultrasonic, sharp electronic field, float, laser deflection, petrotape (for petroleum and fuels), chemtape (for chemicals and petro-chemicals), electric field imaging, capacitance, resistance, pH, non-disperse infrared, acoustic wave, and oxidation reduction potential sensors. The information provided to the control 213 at the step 410 can also include information received from other data sources available to the control 213. Examples of such information include online look up tables, data from the fluids added to the revitalization system or from the fluid packaging, data integrated into the fabric load 22, or data from a washing machine or other pre-treatment machine relating to the fabric load 22.

The control 213 uses both the information provided by the user and the additional information to select cycles and set parameters at step 412, unless more information is needed from the user, as determined at step 411 prior to step 412. More information is needed, for example, if the control 213 finds that there is any inconsistency between the cycle or fluid selected by the user and the type of the fabric load 22 detected. Exemplary parameters that can be set for a cycle are the type of fluid and the amount of fluid used during the cycle, such as to obtain a desired rehydration, which will be explained in more detail below.

Next, the dehydration cycle 402 begins by tumbling the fabric load 22 at step 414. If the revitalization system is capable of different types of tumbling motion, the tumbling is determined by the cycle selected. The type of motion can be, for example, unidirectional, bi-directional, random, and/or cradle, and the motion can vary in speed and duration, depending upon the cycle and cycle parameters set at step 412. The drum rotation can be controlled to minimize damage to the fabric load 22.

If the drum 30C has the textured substrate surface 56, then the fabric load 22 will contact, at least intermittently, the textured substrate surface 56 as the drum 30C rotates. During the rotation of the drum 30C, the fabric load 22 moves, such as by tumbling, thereby causing relative movement between the fabric load 22 and the textured substrate surface 56. During the relative motion, the textured substrate surface 56 can draw particulates away from the fabric load 22 and trap the particulates. Further, if the textured substrate surface 56 includes fluid dispensing means, the fluid can be dispensed onto the fabric load 22.

A process aid can optionally be provided at step 416 of the process depending upon the cycle selected at step 412 and as determined at step 415. The process aids introduced at step 416 can be aqueous fluids, semi-aqueous fluids, non-aqueous fluids, or a mixture of these fluids. The fluids can contain a washing additive, such as a washing additive selected from builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control and removal agents, odor neutralizers, polymeric dye transfer inhibiting agents, softening agents, anti-static agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, wrinkle release agents, soil release polymers, soil repellency agents, sunscreen agents, anti-fade agents, and mixtures thereof. The process aid can optionally be added to the fabric load 22 uniformly by using the fluid delivery system of the present invention as described above.

A dehydration process of the dehydration cycle 402 is formally initiated at step 418. A variety of dehydration cycles and cycle parameters are possible based on both the information input by the operator and the additional information received from external sources, such as sensors. In particular, the dehydration cycle 402 can vary depending on whether the fabric load 22 has been placed in the chamber at step 406 at near ambient humidity or is damp, such as from being washed in an automatic washer or being pretreated. The dehydration cycle 402 can also vary depending on the type of fabric load 22. The dehydration cycle 402 can typically employ a combination of the heater control, the air flow, the fluid removal system, and the particle removal and recovery system. The dehydration cycle 402 can terminate at step 420 based on a period of time set at step 412 or, alternatively, when a sensor detects directly or permits an inference that the fabric load 22 has reached a predetermined level of dryness. The predetermined level of dryness for washable fabrics can be, for example, 0% to 10% by weight.

A process aid can be optionally added at step 422 as determined by step 421 and can be selected from the list provided above and in tone of the manners described above for process aid that can be added in step 416. In one embodiment, the process aid added in step 416 can be a different process aid added at step 422. The process aids can be, for example, two different fluids. A first fluid added at step 416 can provide a revitalizing function on the fabric, while a second fluid can be released at the time of use of the fabric for the benefit of the user. Alternatively, the second fluid can activate the first fluid. During the dehydration cycle run at step 418, the first fluid can be at least partially extracted from the fabric before the second fluid is added at step 421. Alternatively, the two fluids can be added to the fabric during the finishing cycle 404.

Referring now to FIG. 30B, the finishing cycle 404, which can bet set in step 412, is initiated at step 424. Options offered for the finishing cycles in the illustrated embodiment include "Refresh," "Refinish," "Light Clean," and "Dry." The primary differences in the operation of the revitalizing system between the exemplary finishing cycles are the level of rehydration, as shown by steps 426, 428, and 430, and whether there is a step of tumbling without heat at step 432 followed by a dehydration step 434.

The four exemplary finishing cycles shown in FIG. 30B are provided as examples and do not represent all of the possible contemplated finishing cycles. Each of the exemplary finishing cycles performs a different function for the fabric load 22. In the "Refresh" cycle, which can also be referred to as a "Revitalize" cycle, the fabric load 22 is only rehydrated at step 426 to about 2-5% moisture by weight of the fabric for dewrinkling, rinsing mild odors, and delivery of functional chemistry, if desired. In the "Refinish" cycle, which can also be referred to as a "Reshape" cycle, the fabric is rehydrated at step 428 to about 10-20% moisture by weight of the fabric and tumbled without heat for a predetermined period of time at step 432 to provide significantly more wrinkle removal and reshaping of the fabric load 22 than would occur at the lower moisture level of the "Refresh" cycle. In the exemplary "Light Clean" cycle, the fabric load 22 is rehydrated at step 430 to an intermediate level of about 5-10% moisture by weight of the fabric and tumbled without heat for a predetermined period of time at step 432 for the removal of soils. The soil removal is obtained at least in part from the mechanical action of tumbling and rubbing against the textured surface substrate 56 in the drum 30C. Chemistry can be added for additional soil removal. Both the "Refinish" and the "Light Clean" cycles can include the dehydration step 434 following the tumbling step 432 to dehydrate the fabric load 22 to a predetermined level, such as about 2-5% moisture by weight of the fabric. In the exemplary "Dry" cycle, the revitalization system stops after the completion of the dehydration cycle 402, and, thus, the revitalization system functions similar to a conventional clothes dryer. It follows that the revitalization system can dry a wet fabric load 22 and then revitalize the fabric load 22, such as by using the "Dry" cycle followed by another cycle, or revitalize an initially dry fabric load 22.

In the finishing cycle, the fabric load 22 can be hydrated to or near an equilibrium moisture level to provide a predetermined amount of free moisture that can participate in background soil removal. By hydrating the fabric load 22 in such a manner, the fabric load 22 becomes saturated or slightly saturated, and any additional fluid added will be the free moisture that can facilitate soil removal from the saturated or slightly saturated fabric load 22.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A modular system for treating a fabric load, the modular system comprising:

a first module comprising:

a chamber with an interior;

at least one opening into the chamber for enabling user access to the interior of the chamber;

a drying air flow system contained within the first module and configured to move air into the chamber, through the chamber drying the fabric load within the chamber, and out of the chamber;

a particulate removal system in communication with the air flow system; and a fabric movement system for causing movement of the fabric load within the chamber;

a second module having a revitalization fluid delivery system and a revitalization fluid removal system, the revitalization fluid delivery and removal systems being contained within the second module separate from the air flow system;

a first conduit fluidly coupling the revitalization fluid delivery system with the interior of the chamber; and a second conduit fluidly coupling the revitalization fluid removal system with the interior of the chamber.

2. The system of claim 1 wherein the second module further comprises at least one of:

a stain treatment system;

an ironing system;

a working surface;

a storage compartment for a stain treatment fluid;

a fluid dispenser;

a means for applying pressure to fabric;

a means for applying heat to fabric;

a means for drawing fluid and particulates from fabric;

a sink;

a water dispenser;

a water heater;

a fluid cooling system;

a fabric hanger;

a drawer;

a recirculation system for recirculating fluids removed from the chamber back into the chamber; and a storage compartment.

3. The system of claim 1 wherein the first module and second module are configured to be stacked vertically.

4. The system of claim 1 wherein the first module is adjacent the second module.

5. The system of claim 1, further comprising a stain pretreatment module.

6. The system of claim 1, further comprising a sanitization module.

7. The system of claim 1 wherein the rev fluid delivery system comprises at least one of:

a steamer; and a vapor insertion system.

8. The system of claim 1 wherein the revitalization fluid delivery system comprises at least one chemistry delivery device comprising one of a soft-sided pouch and a hard-sided cartridge container.

9. The system of claim 1, wherein the particulate removal system comprises a filter within the air flow system.

10. The system of claim 1 wherein the air flow system comprises an ionizer configured to ionize the air.

11. The system of claim 1 wherein the chamber and the air flow system can be operated as a conventional clothes dryer.

12. The system of claim 1 wherein the chamber and the air flow system can be used to at least one of: (a) dry a wet load of clothes and then revitalize the clothes and (b) revitalize an initially dry load of clothes.

13. The system of claim 1 wherein the air flow system includes a filter selected from:

a locked down sealed edge filter;

a filter for at least one of a vapor, a fog, and a colloidal suspension;

an electrostatic filter;

a filter impregnated with a catalyst for producing at least one of a species and radical for cleaning;

a filter impregnated with a reactant to chemically treat a substance present in air;

a neutralizing filter to remove a previous treatment; and an air permeable matrix having a plurality of pores with a greatest pore dimension in a range from about 0.10 micron to about 1500 microns.

14. A modular system for treating a fabric load, the modular system comprising:

a first module comprising:

a rotatable container having an interior for holding a fabric load;

at least one opening into the container for enabling user access to the interior;

a drying air flow system contained within the first module and configured to move air into the interior, through the container interior drying the fabric load within the interior, and out of the interior; and a particulate removal system in communication with the air flow system;

a second module having a revitalization fluid delivery system and a revitalization fluid removal system, the revitalization fluid delivery and removal systems being contained within the second module separate from the air flow system; and a conduit fluidly coupling the revitalization fluid delivery system with the interior.

15. The system of claim 14 wherein the second module further comprises at least one of:

a stain treatment system;

an ironing system;

a working surface;

a storage compartment for a stain treatment fluid;

a fluid dispenser;

a means for applying pressure to fabric;

a means for applying heat to fabric;

a means for drawing fluid and particulates from fabric;

a sink;

a water dispenser;

a water heater;

a fluid cooling system;

a fabric hanger;

a drawer;

a recirculation system for recirculating fluids removed from the interior into the interior; and a storage compartment.

16. The system of claim 14 wherein the first module and second module are configured to be stacked vertically.

17. The system of claim 14 wherein the first module is adjacent the second module.

18. The system of claim 14, further comprising at least one of:

a stain pre-treatment module; and a sanitization module.

19. The system of claim 14 wherein the air flow system comprises an ionizer configured to ionize the air.

20. The system of claim 14 wherein the container and air flow system can be operated to at least one of: (a) dry a wet load of clothes as a conventional clothes dryer, (b) dry a wet load of clothes and then revitalize the clothes, and (c) revitalize an initially dry load of clothes.

21. The system of claim 14 wherein the delivery system comprises at least one of:

a steamer; and a vapor insertion system.

22. The system of claim 14 wherein the revitalization fluid delivery system comprises at least one chemistry delivery device comprising one of a soft-sided pouch and a hard-sided cartridge container.

23. The system of claim 14 wherein the air flow system includes a filter selected from:

a locked down sealed edge filter;

a filter for at least one of a vapor, a fog, and a colloidal suspension;

an electrostatic filter;

a filter impregnated with a catalyst for producing at least one of a species and radical for cleaning;

a filter impregnated with a reactant to chemically treat a substance present in air;

a neutralizing filter to remove a previous treatment; and an air permeable matrix having a plurality of pores with a greatest pore dimension in a range from about 0.10 micron to about 1500 microns.

* * * * *